US007631865B2

(12) United States Patent
Okuda

(10) Patent No.: US 7,631,865 B2
(45) Date of Patent: Dec. 15, 2009

(54) MEDIUM GUIDE ELEVATING DEVICE, RECORDING APPARATUS AND LIQUID EJECTING APPARATUS

(75) Inventor: Yasumichi Okuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 137 days.

(21) Appl. No.: 11/860,340

(22) Filed: Sep. 24, 2007

(65) Prior Publication Data

US 2008/0074457 A1 Mar. 27, 2008

(30) Foreign Application Priority Data

Sep. 25, 2006 (JP) ..... 2006-259333

(51) Int. Cl.
*B65H 31/04* (2006.01)

(52) U.S. Cl. ..... 271/213; 347/104; 271/163; 271/214

(58) Field of Classification Search ..... 271/162, 271/163, 207, 213, 214; 347/104; 270/58.14, 270/58.15, 58.18, 58.19, 58.28
See application file for complete search history.

(56) References Cited

U.S. PATENT DOCUMENTS 5,715,071 A * 2/1998 Takashimizu et al. ..... 358/498
5,882,003 A * 3/1999 Fujiwara et al. ..... 271/10.11
5,951,000 A * 9/1999 Sato et al. ..... 270/58.11
6,322,070 B2 * 11/2001 Yamada et al. ..... 271/293
2006/0244195 A1 * 11/2006 Shibahara ..... 271/109

FOREIGN PATENT DOCUMENTS

JP 2005-125766 5/2005
JP 2005-144931 6/2005
JP 2006-082323 3/2006

* cited by examiner

*Primary Examiner*—Patrick H Mackey
*Assistant Examiner*—Ernesto Suarez
(74) *Attorney, Agent, or Firm*—Workman Nydegger

(57) ABSTRACT

A medium guide elevating device includes a rotor, a medium guide unit, a sensor, a first engaging portion and a second engaging portion. The rotor is driven in forward rotation or in reverse rotation. The medium guide unit is moved to a first position when the rotor is driven in forward rotation, and is moved to a second position when the rotor is driven in reverse rotation. The sensor has a selector switch that switches between an on state and an off state. The sensor enters the off state when the medium guide unit is located between the first position and the second position. The first engaging portion engages the selector switch to switch the sensor to the on state when the medium guide unit is moved to the first position. The second engaging portion engages the selector switch to switch the sensor to the on state when the medium guide unit is moved to the second position.

5 Claims, 39 Drawing Sheets

MEDIUM GUIDE ELEVATING DEVICE, RECORDING APPARATUS AND LIQUID EJECTING APPARATUS

BACKGROUND

1. Technical Field

The present invention relates to a medium guide elevating device that is provided with a medium guide unit that is moved to a first position or to a second position by power that drives a motor in forward rotation or in reverse rotation in a recording apparatus that performs recording on a recording medium by discharging ink from a recording head provided in a recording unit, a recording apparatus that is provided with the medium guide elevating device, and a liquid ejecting apparatus.

2. Related Art

Here, the liquid ejecting apparatus includes not only a recording apparatus, such as an ink jet recording apparatus, a copying machine, or a facsimile, that ejects ink from a recording head, which serves as a liquid ejecting head, to record images on a recording material, such as recording paper, but also an apparatus that ejects a liquid corresponding to an intended purpose, instead of ink, from a liquid ejecting head, which corresponds to the above mentioned recording head, onto a liquid ejected target material corresponding to the recording material, to attach liquid to the liquid ejected target material. In addition to the recording head, the liquid ejecting head can be a color material ejecting head used for manufacturing a color filter for a liquid crystal display, an electrode material (conductive paste) ejecting head used for forming an electrode for an organic EL display or a field emission display (FED), a bio-organic material ejecting head used for manufacturing a bio-chip, or a sample ejecting head that ejects a sample as a precision pipette. Furthermore, the recording apparatus includes an ink jet printer, a wire dot printer, a laser printer, a line printer, a copying machine, a facsimile, or the like.

In an existing art, as described in Japanese Patent No. 3695661, there is a recording apparatus that is able to record images on a label face of an optical disk using a tray. The recording apparatus is provided with a manually openable and closable tray guide at a front face of the recording apparatus for guiding the tray. Specifically, the tray guide is provided, when it is opened, to guide the tray to a recording unit that is located upstream in a direction in which a recording medium is transported during recording and, after recording is performed, to receive the tray that is sent from the recording unit to the downstream side. Then, when recording is performed on a normal sheet of paper, the tray guide is configured to be retracted so that the tray guide is closed.

In addition, in order to detect an open/close state of the tray guide, a tray guide open/close sensor is provided. Then, it is determined whether the tray guide is closed or not, and it is determined whether recording is performed onto the optical disk or not. For example, even when recording may be performed onto the optical disk, and when recording data are intended for a cut sheet that is fed from an automatic sheet feeder (ASF), recording is prohibited onto the cut sheet so as to prevent sheet jam and, in addition, unnecessary recording is prevented from being performed onto the optical disk.

However, the tray guide open/close sensor is configured to enter an on state when the tray guide is closed and to enter an off state when the tray guide is opened. That is, there is a possibility that the position of the tray guide, which is being opened or closed, cannot be determined. In other words, the sensor enters an off state when the tray guide is located at a position other than the closed state, so that there is a possibility that the opened state of the tray guide cannot be reliably detected. As a result, even when the tray guide is actually not in an opened state, that is, when it is not allowed to perform recording onto the optical disk, there is a possibility that the recording apparatus determines, through the tray guide open/close sensor, that the tray guide is opened and recording may be performed onto the optical disk, and then performs recording.

SUMMARY

An advantage of some aspects of the invention is that it provides a medium guide elevating device that is suitable for reliably detecting a plurality of positions of a medium guide unit with a simple structure, a recording apparatus that is provided with the medium guide elevating device and a liquid ejecting apparatus.

A first aspect of the invention provides a medium guide elevating device. The medium guide elevating device includes a rotor, a medium guide unit, a sensor, a first engaging portion and a second engaging portion. The rotor is driven in forward rotation or in reverse rotation. The medium guide unit is moved to a first position when the rotor is driven in forward rotation, and is moved to a second position when the rotor is driven in reverse rotation. The sensor has a selector switch that switches between an on state and an off state. The sensor enters the off state when the medium guide unit is located between the first position and the second position. The first engaging portion engages the selector switch to switch the sensor to the on state when the medium guide unit is moved to the first position. The second engaging portion engages the selector switch to switch the sensor to the on state when the medium guide unit is moved to the second position.

The above first aspect may further include a control unit. The control unit controls driving of the rotor. The control unit detects that the sensor is switched from the off state to the on state. The control unit determines that the medium guide unit is moved to the first position or to the second position on the basis of a rotational direction of the rotor when the control unit detects that the sensor is switched from the off state to the on state. A second aspect of the invention provides a recording apparatus that includes the medium guide elevating device of the above first aspect. A third aspect of the invention provides a liquid ejecting apparatus that includes the medium guide elevating device of the above first aspect.

BRIEF DESCRIPTION OF THE DRAWINGS

The invention will be described with reference to the accompanying drawings, wherein like numbers reference like elements.

DESCRIPTION OF EXEMPLARY EMBODIMENTS

A delivery stacker elevating unit according to the aspects of the invention and a recording apparatus, which is an example of a liquid ejecting apparatus that employs the delivery stacker elevating unit, will now be described. Firstly, an ink jet printer 100 is employed as an example embodiment of a liquid ejecting apparatus according to the aspects of the invention and a recording apparatus, which is an example of the liquid ejecting apparatus, and the whole configuration will be schematically described with reference to the accompanying drawings.

Figure 1:
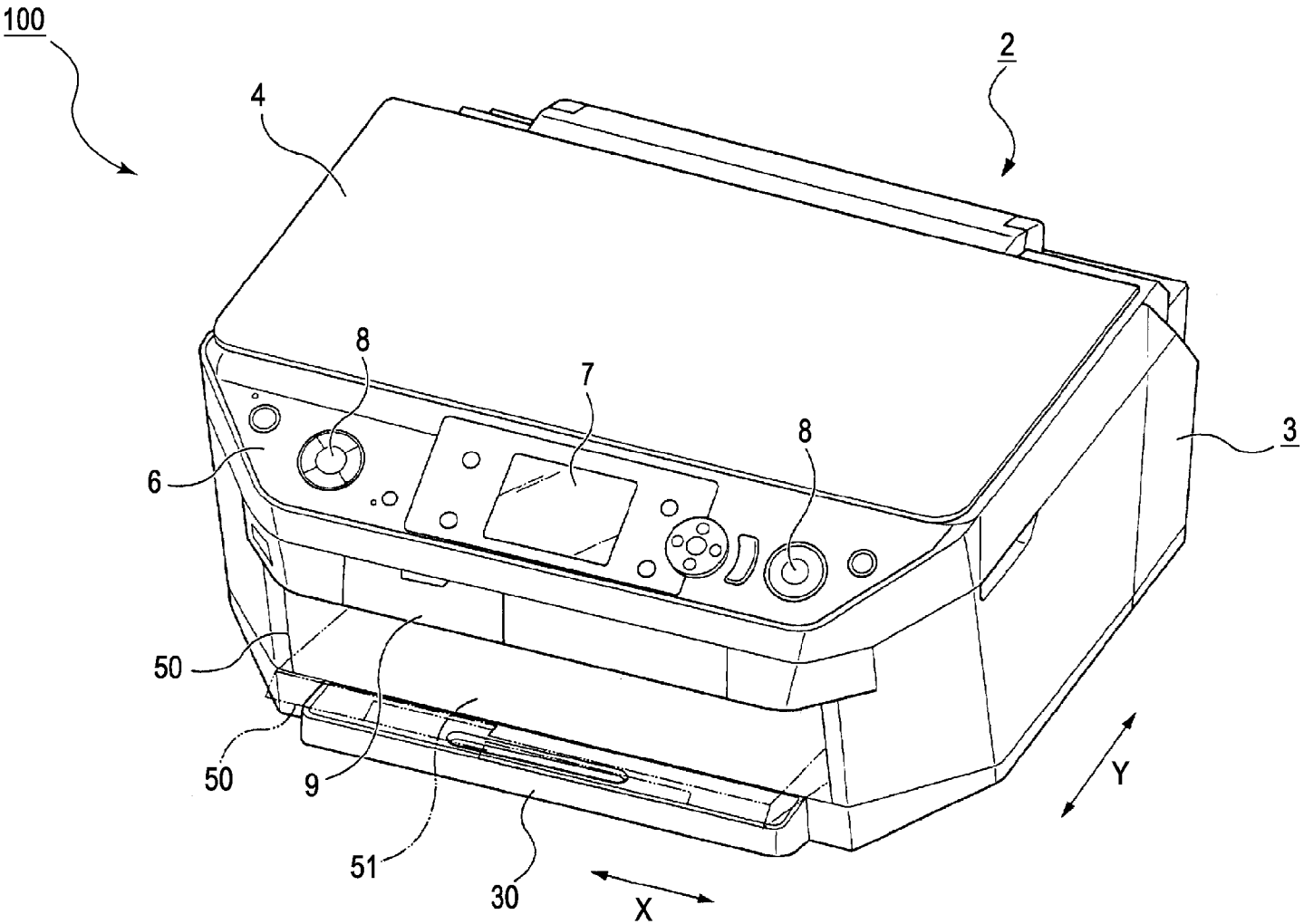
FIG. 1 is a perspective view that shows the appearance of an ink jet printer.
Figure 2:
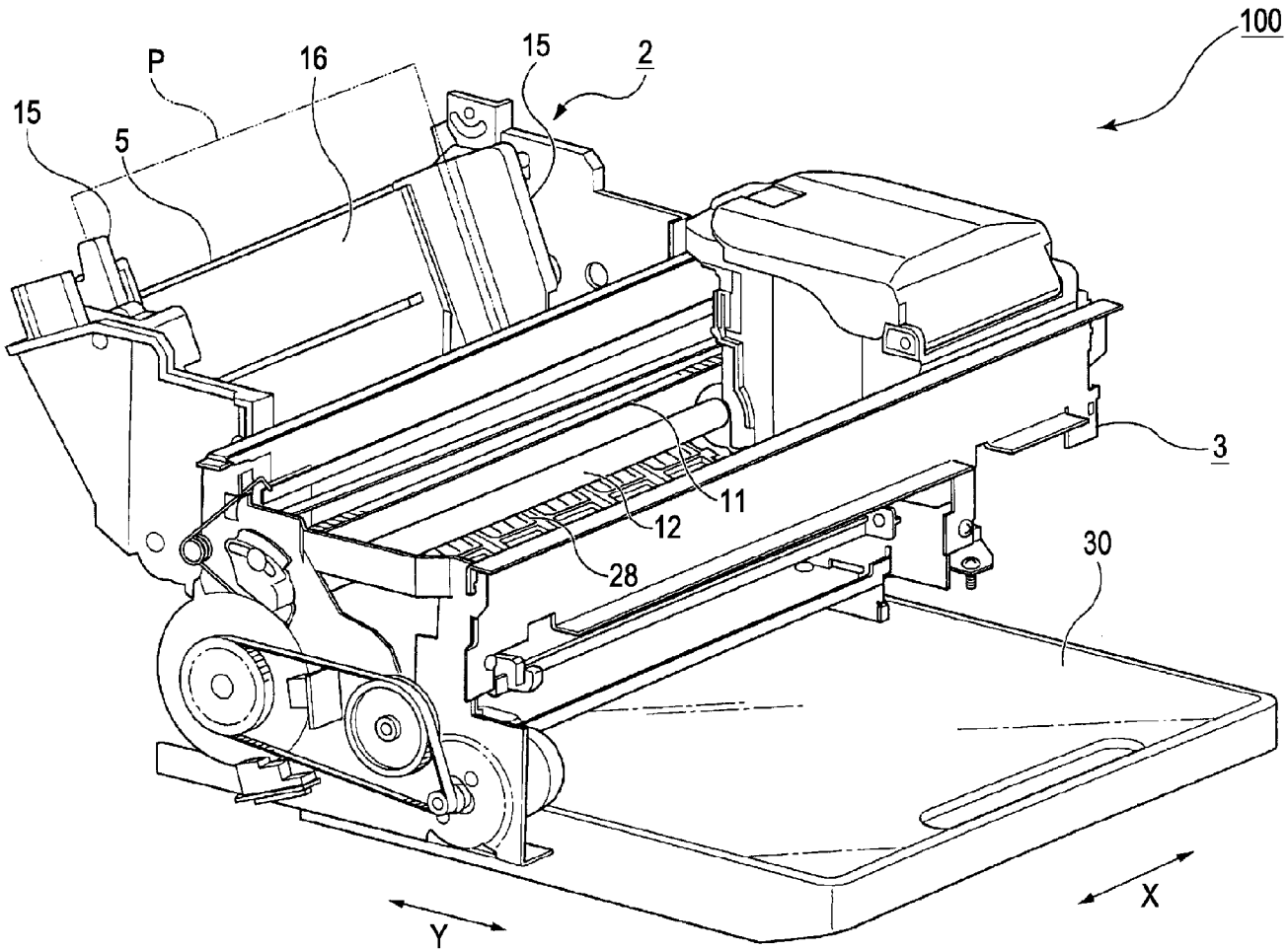
FIG. 2 is a perspective view that shows the internal structure of the ink jet printer when a casing is removed.
Figure 3:
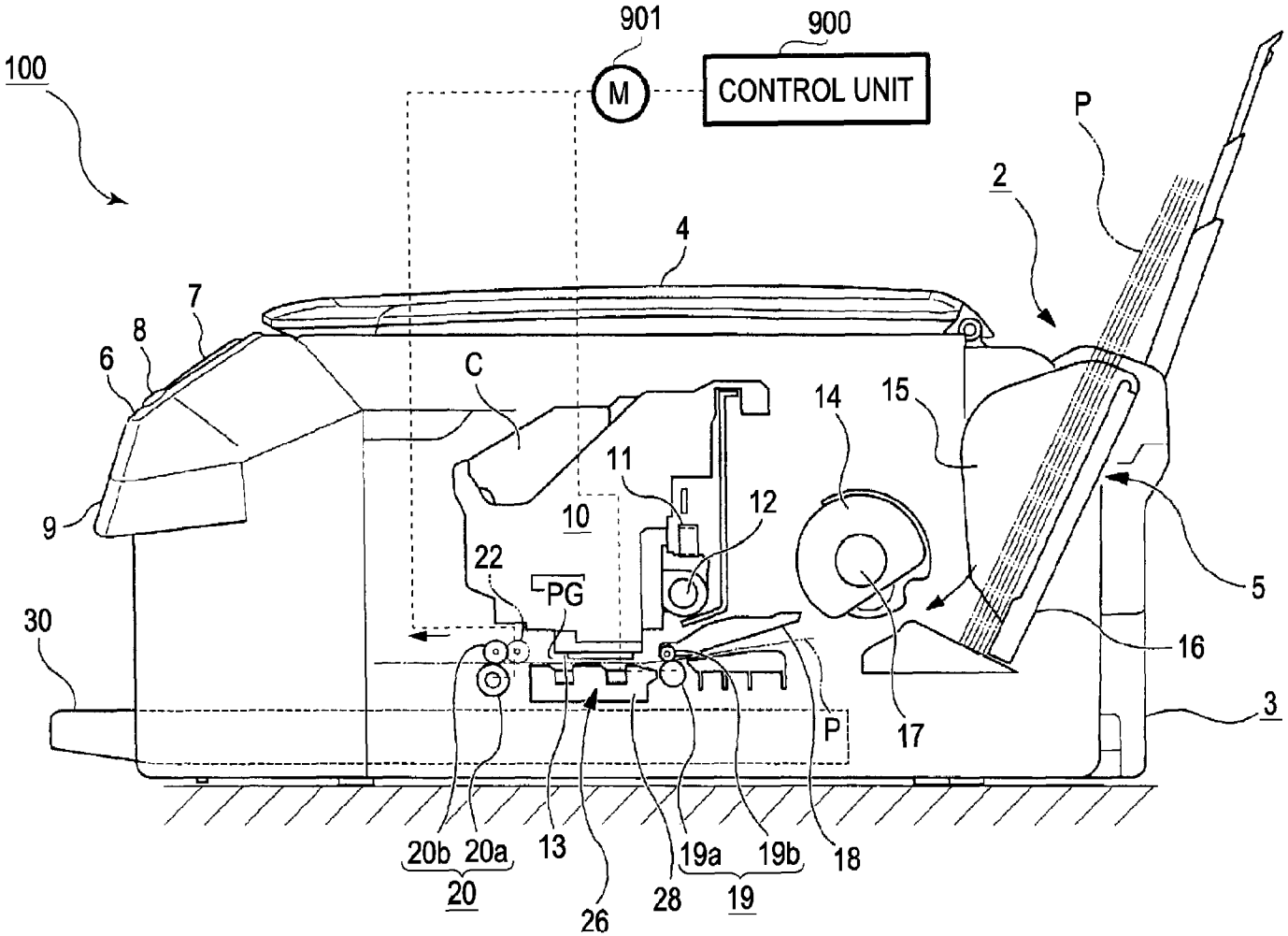
FIG. 3 is a side cross-sectional view that schematically shows the internal structure of the ink jet printer.

FIG. 1 is a perspective view of the appearance of the ink jet printer. FIG. 2 is a perspective view that shows the internal structure of the ink jet printer when a housing is removed. FIG. 3 is a side cross-sectional view that schematically shows the internal structure of the ink jet printer.

Note that the ink jet printer 100, described herein, includes a scanner unit 4 on the upper side of a printer body 3, which is an example of a liquid ejecting apparatus body and also an example of a recording apparatus body. The printer body 3 includes a liquid crystal monitor screen 7 at the middle of a front face panel 6 and operation buttons 8 on both sides of the liquid crystal monitor screen 7. A memory card insertion portion 9, which is used for inserting a memory card, or the like, containing photo data taken by a digital camera, is provided at the middle portion of the lower side of the front race panel 6. In addition, the ink jet printer 100 of this type is a relatively compact ink jet printer that has multiple functions of being able to perform direct recording without using a personal computer and being able to use the printer as a copying machine.

In addition, a feeding cassette 30 is provided at the lower side of the front face of the printer body 3 so that it may be removed or set in a longitudinal direction (front-rear direction). A delivery stacker 50 is provided above the feeding cassette 30. As shown by solid line in FIG. 1, the delivery stacker functions as a portion of front face cover of the printer body 3 when it is not being used. Note that the delivery stacker 50 is expanded to the front side when it is being used, as shown by hypothetical line in FIG. 1, and is used in a state where a mounting face 51 is directed upward. In addition, the liquid crystal monitor screen 7, a portion of the operation buttons 8 and the memory card insertion portion 9 are used when direct recording is performed without being connected to a personal computer. That is, by inserting a memory card (not shown) into the memory card insertion portion 9 and then manipulating the operation buttons 8 while viewing the liquid crystal monitor screen 7, it is possible to simply print any number of desired pictures with high quality at home.

In addition, an automatic sheet feeder 2 is provided at the upper portion of the rear side of the printer body 3. The automatic sheet feeder 2 is able to automatically and continuously feed a recording material P (hereinafter, simply referred to as "sheet of paper P, where appropriate), which is an example of a liquid ejected target material. The automatic sheet feeder 2 includes a feeding tray 5, a hopper 16, a feeding roller 14, a retard roller, a separation pad and the like (not shown), and a return lever and the like (not shown). The feeding tray 5 may stack a plurality of sheets of paper P. The hopper 16 pushes up a sheet of paper P stacked on the feeding tray 5 toward the feeding roller 14. The feeding roller 14 picks up the uppermost sheet of paper P on the feeding tray 5 by pinching and feeding the sheet with the hopper 16. The retard roller, the separation pad, and the like, are an example of a separation action unit that separates a subsequent sheet of paper P, when being fed together with the uppermost sheet of paper P, from the uppermost sheet of paper P in order to feed the uppermost sheet of paper P only. The return lever, and the like, returns the separated subsequent sheet of paper P to the feeding tray 5.

The internal structure of the ink jet printer 100 will be schematically described in order of a path in which the sheet of paper P is transported. The feeding tray 5 is provided on the most upstream side in the transport direction. The feeding tray 5 is an example of a liquid ejected target material stacking unit that stacks a plurality of sheets of paper P. In addition, the feeding tray 5 is provided with an edge guide 15 that contacts the side periphery (edge) of the sheet of paper P and that guides the sheet of paper P to be smoothly transported in a vertical scanning direction Y, which is the transport direction of the sheet of paper P. The sheet of paper P on the feeding tray 5 is pushed up toward the feeding roller 14 as the hopper 16 is lifted up at a predetermined timing in accordance with rotation of a rotary shaft 17 of the feeding roller 14. Then, the uppermost sheet of paper P is sequentially picked up by receiving separation force of the retard roller (not shown), and the like, which is the separation action unit provided in proximity to the feeding roller 14, and then fed toward the downstream side in the transport direction.

A recording material detection device (hereinafter, simply referred to as "detection lever" and not shown in the drawing) is provided downstream of the feeding roller 14. The recording material detection device is an example of a liquid ejected target material detection device that detects a passage of the sheet of paper P. A transporting roller 19 is provided downstream of the detection lever. The transporting roller 19 includes a transporting drive roller 19*a* and a transporting driven roller 19*b*. The transporting driven roller 19*b* is rotatably coupled to the downstream end of a roller holder 18. The roller holder 18 rotatably urges the transporting driven roller 19*b* by a torsion coil spring (not shown) so that the transporting driven roller 19*b* is always pressed to contact the transporting drive roller 19*a*, that is, a nipped state.

Then, the sheet of paper P, which is transported while being pinched by the transporting roller 19, is guided to a recording position 26. A carriage 10 is provided at the recording position 26. The carriage 10 is one of components of a record performing device, which is an example of a liquid ejection performing device that performs recording on the sheet of paper P. The carriage 10 is pivotally coupled to a carriage guide shaft 12 so that it is reciprocally movable in a main (horizontal) scanning direction X, which is a widthwise direction of the sheet of paper P and a CD-R tray Q, which will be described later. The carriage 10 is reciprocally moved by means of an endless belt 11. Then, a recording head 13 is mounted on the lower face of the carriage 10. The recording head 13 is an example of a liquid ejecting head that performs recording by discharging (ejecting) ink, which is an example of liquid, onto the sheet of paper P, or the like. In addition, an ink cartridge C, which is an example of a liquid cartridge, is set in the carriage 10.

A platen 28 is provided on the lower side of the recording head 13. The platen 28 is opposed to the recording head 13 to regulate a gap PG between a head face of the recording head 13 and the sheet of paper P, or the like. Then, between the recording head 13 and the platen 28, the operation in which the sheet of paper P, or the like, is transported in the vertical scanning direction Y perpendicular to the horizontal scanning direction X at a predetermined amount of transportation and the operation in which ink is ejected from the recording head 13 to the sheet of paper P, or the like, while reciprocally moving the recording head 13 once in the horizontal scanning direction X are alternated, so that desired recording is performed over the substantially entire area of a recording face of the sheet of paper P, or the like. Note that the gap PG is an extremely important element in terms of performing highly accurate recording, and the gap PG is appropriately adjusted in accordance with variation in thickness of the sheet of paper P.

A delivery roller 20 is provided downstream of the recording head 13. The delivery roller 20 is an example of a liquid ejected target material delivery device and includes a delivery drive roller 20*a* and a plurality of first delivery driven rollers 20*b*. In addition, a plurality of delivery support driven rollers 22 are provided in proximity to and upstream of the first delivery driven rollers 20*b* in the transport direction. Then, the sheet of paper P that is delivered by the delivery roller 20 is delivered onto the mounting face 51 formed on the delivery stacker 50, which is an example of a liquid ejected target material receiving unit, located further downstream in the transport direction.

The first delivery driven rollers 20*b* and the delivery support driven rollers 22 are tooth rollers that have a plurality of teeth on their outer peripheries and are freely rotatably supported by roller holders that hold the first delivery driven rollers 20*b* and the delivery support driven rollers 22, respectively. Furthermore, the transporting driven roller 19*b* is arranged so that the axis of the transporting driven roller 19*b* is positioned slightly downstream in the transport direction than that of the transporting drive roller 19*a*. The first delivery driven rollers 20*b* are arranged so that the axes of the first delivery driven rollers 20*b* are positioned slightly upstream in the transport direction than that of the delivery drive roller 20*a*. By employing such arrangement, the sheet of paper P is formed to be in a curved state called "inversed warp" in which the sheet of paper P is slightly convex downward between the transporting roller 19 and the delivery roller 20. In this manner, the sheet of paper P that is opposed to the recording head 13 is pressed against the platen 28 and the sheet of paper P is prevented from being lifted. Thus, recording is normally performed. Note that the transporting drive roller 19*a* and the delivery drive roller 20*a* are provided so as to be driven by driving force of a first motor 901 that is controlled by a control unit 900.

Embodiment

Figure 4:
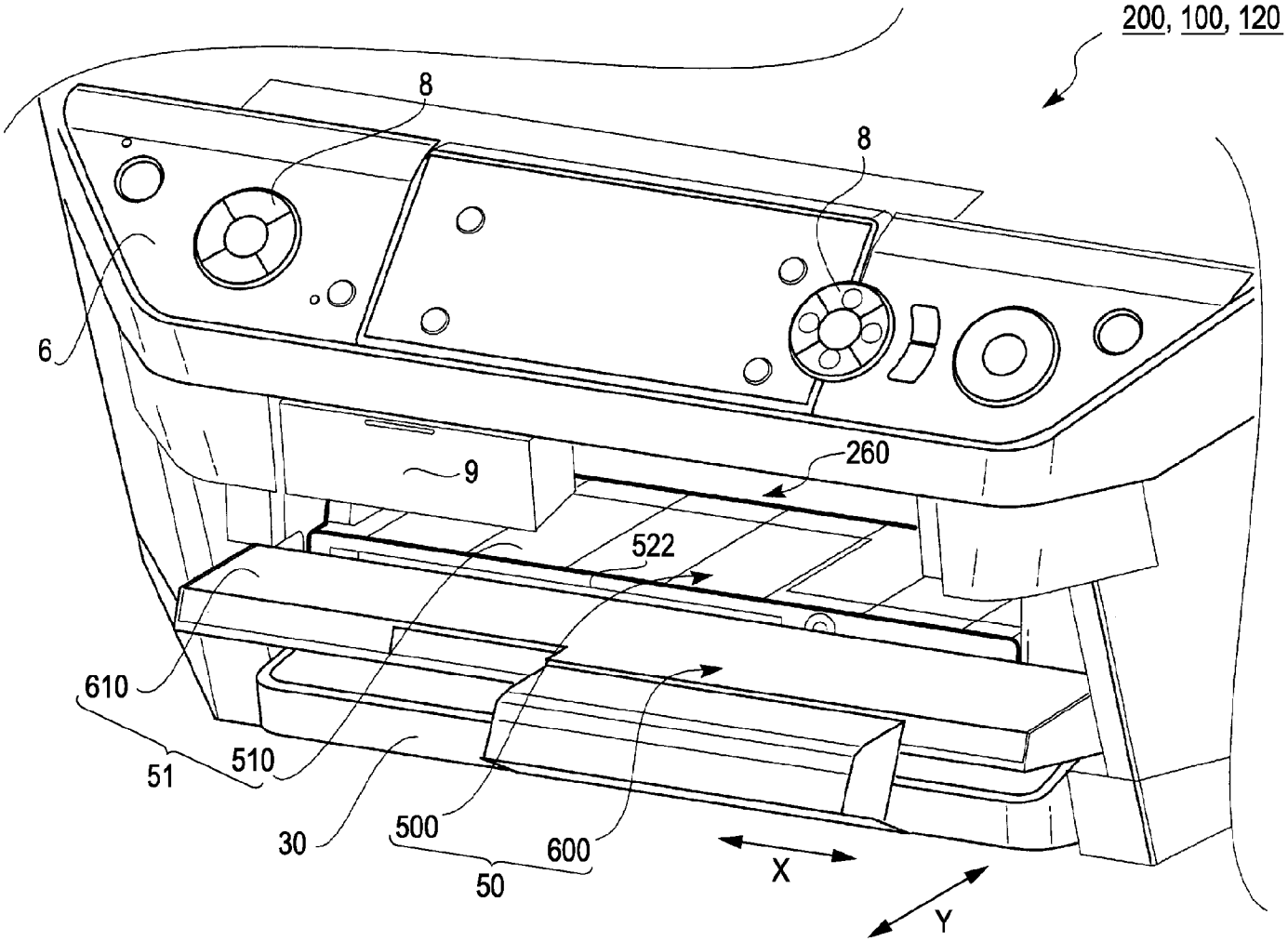
FIG. 4 is a perspective view that shows a sheet recording mode of a delivery stacker elevating unit (first position) according to an embodiment of the invention.
Figure 5:
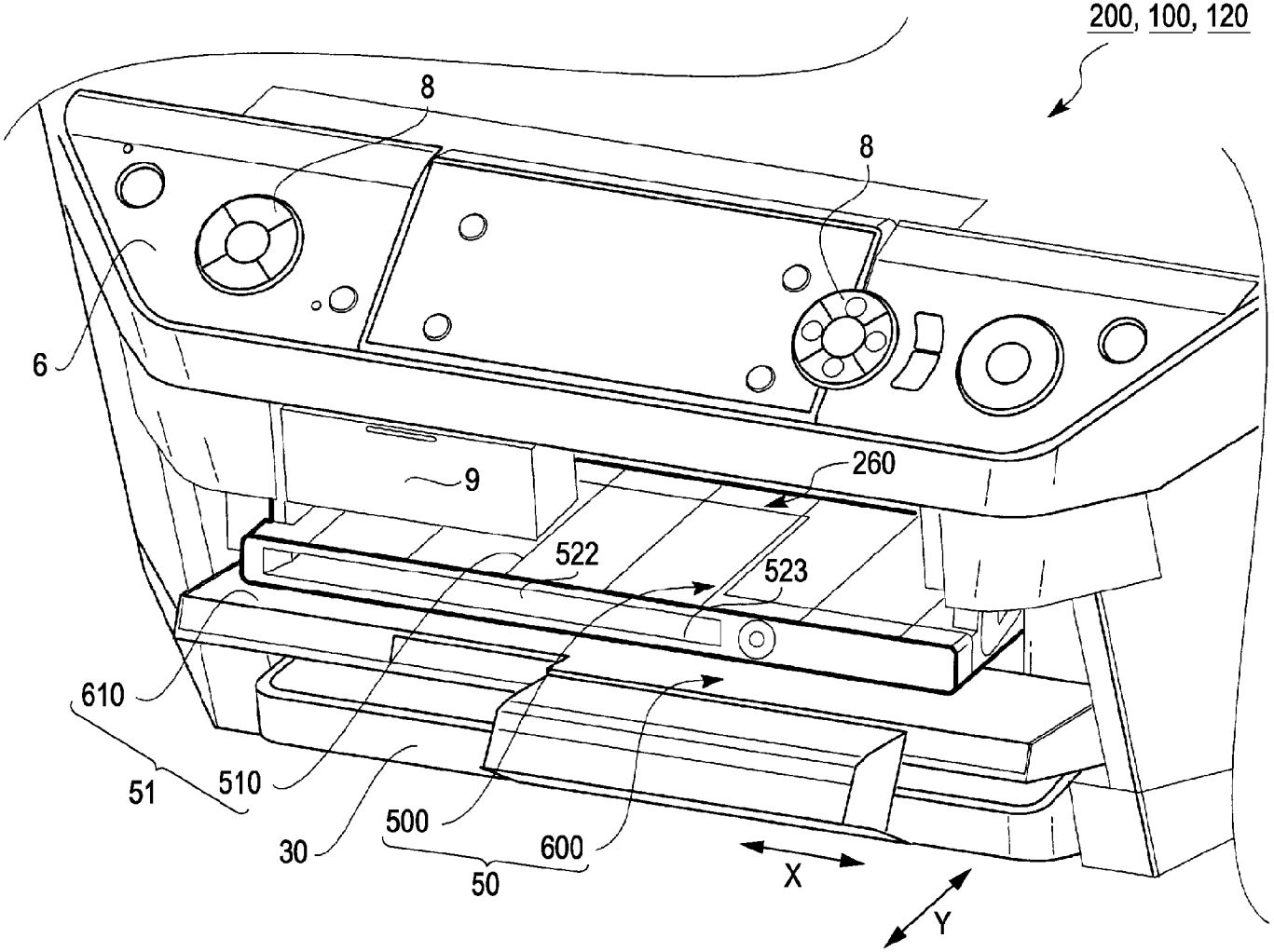
FIG. 5 is a perspective view that shows a CD-R recording mode of the delivery stacker elevating unit (second position) according to the embodiment of the invention.
Figure 6:
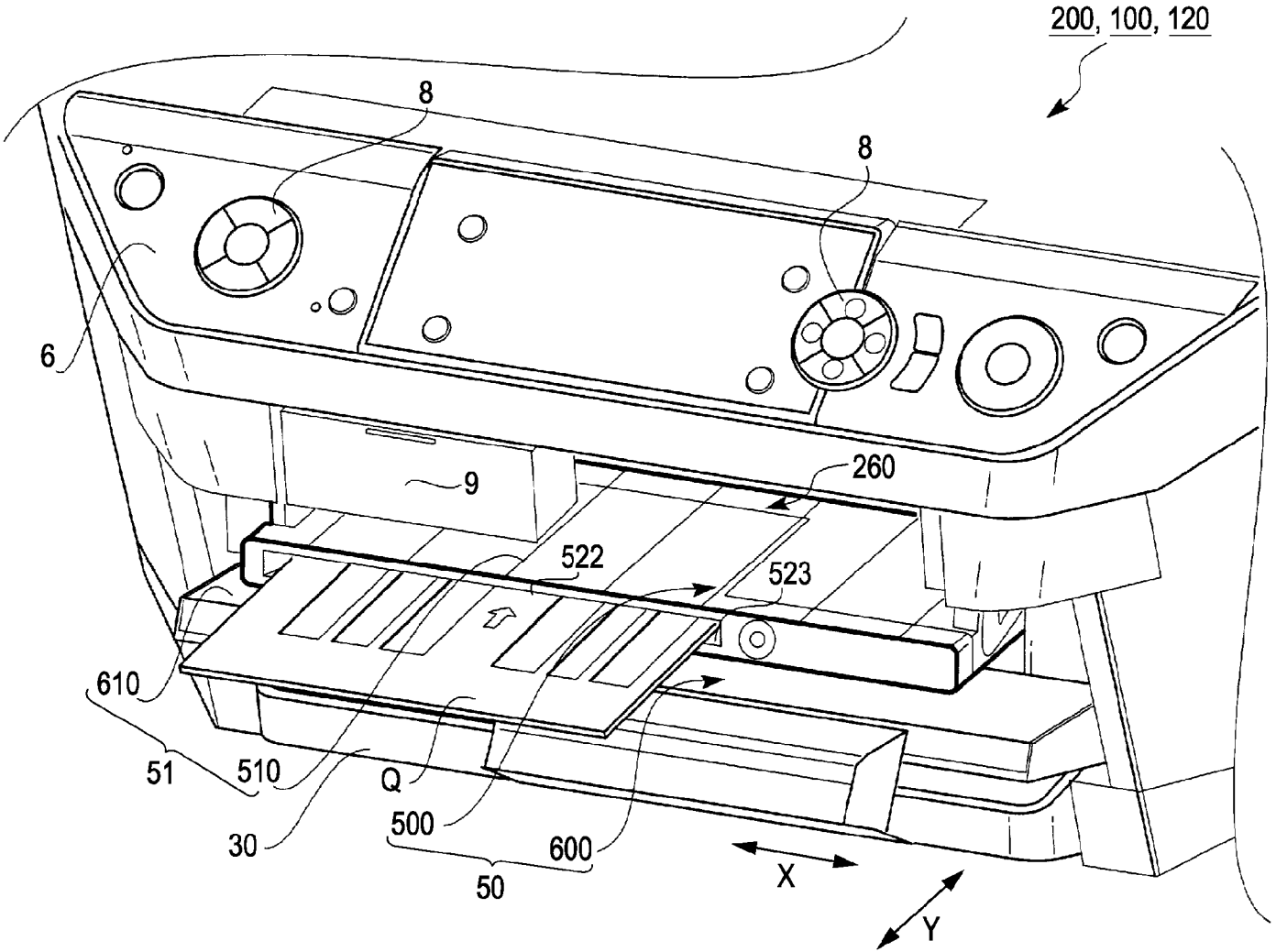
FIG. 6 is a perspective view that shows a state where a CD-R tray is set in the CD-R recording mode (second position).

A delivery stacker elevating unit according to the embodiment of the invention, which is provided in the above described ink jet printer 100, will be specifically described with reference to the accompanying drawings. FIG. 4 to FIG. 6 are front perspective views that show the delivery stacker elevating unit according to the embodiment of the invention. FIG. 4 is a view that shows a state where a first delivery stacker is located at a first position in a sheet recording mode. FIG. 5 is a view that shows a state where the first delivery stacker is located at a second position in a CD-R recording mode. Then, FIG. 6 is a view that shows a state where a CD-R tray is set in FIG. 5.

As shown in FIG. 4 to FIG. 6, a delivery unit 120 that delivers a sheet of paper, or the like, in the recording apparatus 100 is provided with a delivery stacker elevating unit 200. The delivery stacker elevating unit 200 has a sheet recording mode in which recording is performed on the sheet of paper P and a CD-R recording mode in which recording is performed on the label of a CD-R. Switching of the recording modes is switched by a user manipulating the operation buttons 8. Then, when the recording mode is switched, a first delivery stacker 500 provided in the delivery stacker elevating unit 200 is configured to be moved to the first position or the second position by the first motor 901 (see FIG. 3), which is a power source of the delivery drive roller 20*a*. Movement of the first delivery stacker 500 will be described later. Here, the first position and the second position will be described first. Note that switching of the recording modes may be performed so that the control unit 900 (see FIG. 3) determines to perform switching of the recording modes at the time when recording information data are set to the control unit 900. In addition, in FIG. 4 to FIG. 6, the right side in the X direction in the drawings corresponds to a first digit side and the left side corresponds to an eightieth digit side.

As shown in FIG. 4, the delivery stacker 50 is provided with the first delivery stacker located downstream in the transport direction, which is the vertical scanning direction Y and a second delivery stacker 600 located downstream in the transport direction. Then, the second delivery stacker 600 is configured to open and close a mount opening portion 260 that is provided at the front face of the recording apparatus 100. FIG. 4 is a view that shows an opened state of the mount opening portion 260. In the sheet recording mode, when the recorded sheet of paper P is delivered by the delivery roller 20, the sheet of paper P is placed on the upper face of the mounting face 51 that includes a first mount portion 510 of the first delivery stacker 500 and a second mount portion 610 of the second delivery stacker 600. Then, the level of the downstream end of the first delivery stacker 500 in the transport direction is configured to be higher than the level of the upstream end of the second delivery stacker 600. Thus, it is not likely to cause the inconvenience that the distal end portion of the sheet of paper P, that is, the downstream end of the sheet of paper P in the transport direction, is erroneously caught in a gap between the first delivery stacker 500 and the second delivery stacker 600, that is, sheet jam.

As shown in FIG. 5, in the CD-R recording mode, the first delivery stacker 500 is moved to the upper side of the second delivery stacker 600 which is located downstream in the transport direction. This position is the second position of the first delivery stacker 500. The first delivery stacker 500 includes a CD-R tray guide opening portion 522 and a CD-R tray guide face 523. The CD-R tray guide opening portion 522 is located downstream of the first mount portion 510 in the transport direction. The CD-R tray guide face 523 is a bottom face of the CD-R tray guide opening portion that guides a CD-R tray Q (see FIG. 6) in the transport direction (Y). At the second position, the CD-R tray guide face 523 is parallel to the transport direction (Y) and the horizontal scanning direction X and is flush with the level of the upper portion of the delivery drive roller 20*a* and the level of the platen 28.

As shown in FIG. 6, when the recording mode is switched to the CD-R recording mode, the first delivery stacker 500 is moved to the second position. Then, a user attaches a CD-R used for recording on its label to an exclusive CD-R tray Q, and inserts and sets the CD-R tray Q into the CD-R tray guide opening portion 522 of the first delivery stacker 500. The CD-R tray Q, when being set, is held by the delivery drive roller 20*a* and two second delivery driven rollers 503 (see FIG. 10 to FIG. 22), which will be described later. After that, the CD-R tray Q is sent to the upstream side in the transport direction by driving the delivery drive roller 20*a* in reverse rotation. Then, the downstream end of the CD-R in the transport direction, which is attached to the CD-R tray Q, stops at a position opposed to the recording head 13, that is, a recording start position. Then, the upstream side of the CD-R tray Q is not held by the transporting roller 19 in order to prevent failure of data stored in the CD-R due to the transporting driven roller 19*b* contacting the label face of the CD-R. Note that the delivery drive roller 20*a* and the two second delivery driven rollers 503 are provided so as not to directly hold the CD-R but hold the CD-R tray body (Q) at two portions adjacent to both ends of the CD-R tray body (Q) in the horizontal scanning direction. Thus, there is no possibility to occur failure of data information stored in the CD-R. In addition, in order to improve the accuracy of transportation of the CD-R tray, it is, of course, applicable that the CD-R tray is held not only by the delivery drive roller 20*a* and the second delivery driven rollers 503 but also by the transporting roller 19.

After that, the recording head 13 performs scanning in the horizontal scanning direction X while the delivery drive roller 20*a* is driven in forward rotation to move the CD-R tray Q to the downstream side in the transport direction, so that recording is performed on the label of the CD-R. Then, when recording is completed, the delivery drive roller 20*a* and the second delivery driven rollers 503 cooperate to deliver the CD-R tray Q to the downstream side in the transport direction. At this time, because the upstream end of the CD-R tray Q in the transport direction is released from the nipping by the delivery drive roller 20*a* and the second delivery driven rollers 503, the CD-R tray Q stops again at a position which is further projected from the position, shown in FIG. 6, where part of the CD-R tray Q is projected from the CD-R tray guide opening portion 522.

In the CD-R recording mode, because the first delivery stacker 500 that is provided with the CD-R tray guide opening portion 522 is moved to the downstream side in the transport direction, a user may easily set the CD-R tray Q. In addition, after recording, the user is able to easily take out the CD-R tray Q. At this time, because part of the CD-R tray Q is projected from the CD-R tray guide opening portion 522, it is possible to further easily take out the CD-R tray Q. In addition, because the first delivery stacker 500 is moved to the downstream side in the transport direction, it is possible to support the center of gravity of the CD-R tray Q. Thus, it is possible to stabilize the attitude of the CD-R tray Q.

Change of PG and Switching of Recording Mode

Figure 7:
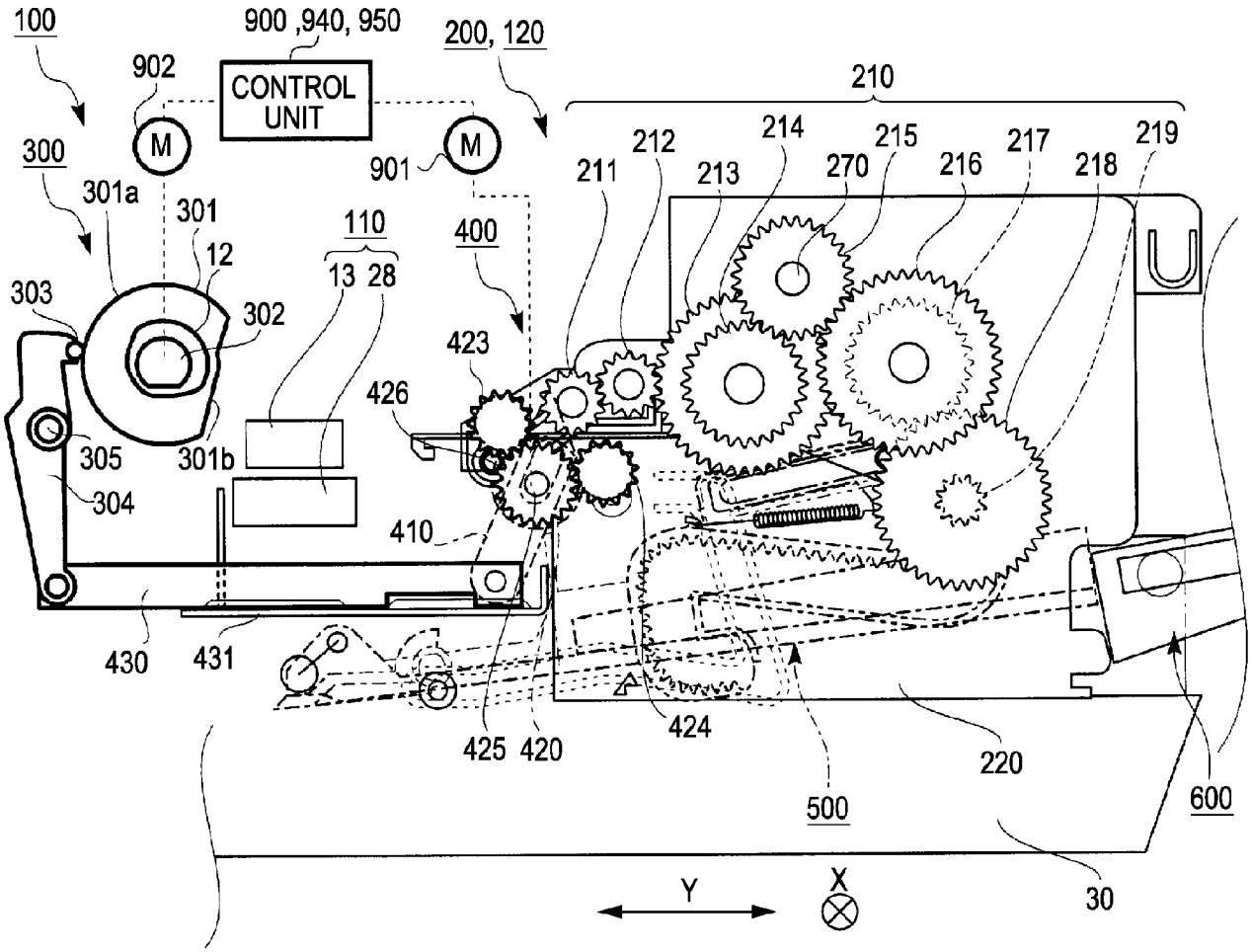
FIG. 7 is a schematic side view, with partially cut away, that shows power transmission to the delivery stacker elevating unit according to the embodiment of the invention (interrupting power transmission).
Figure 8:
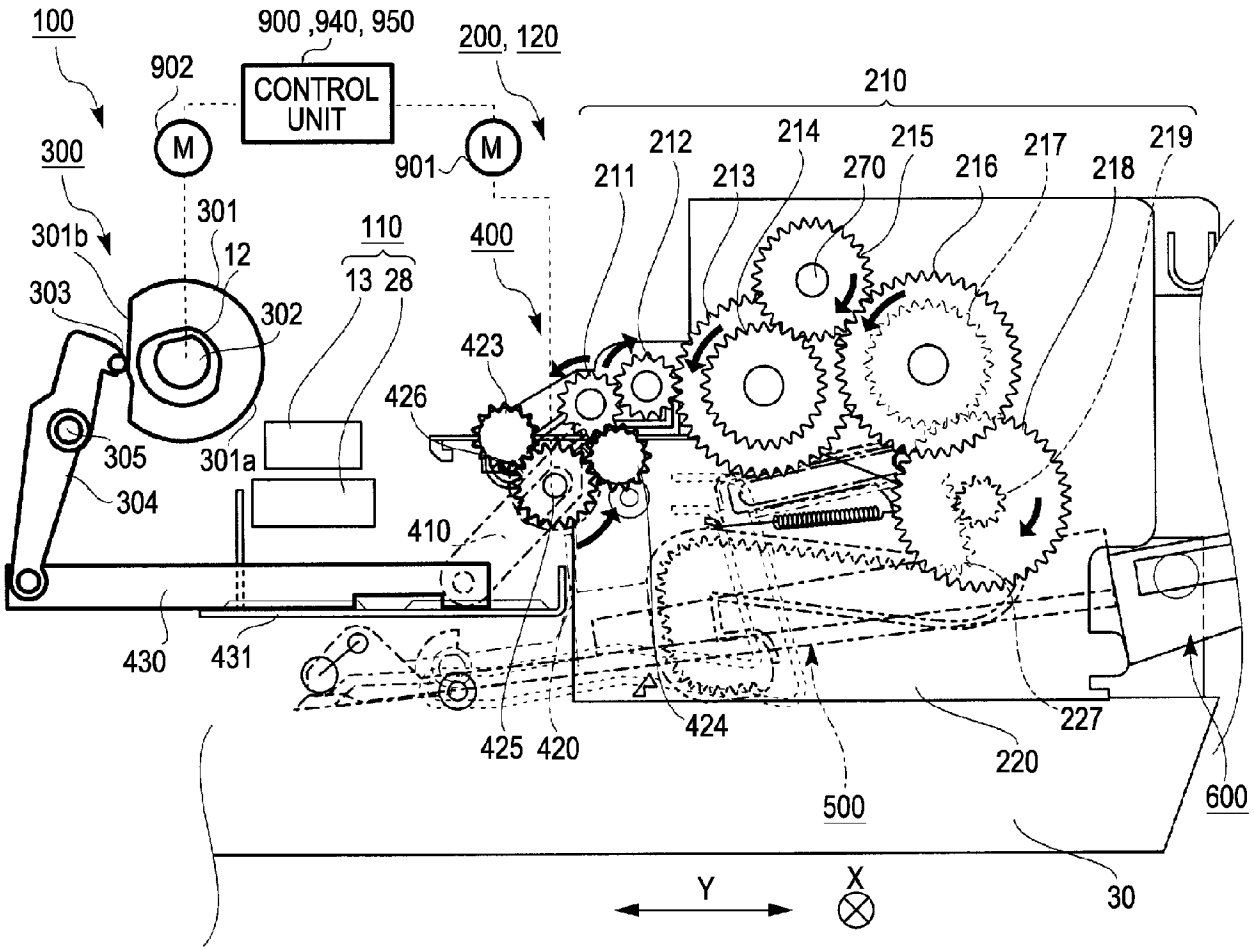
FIG. 8 is a schematic side view, with partially cut away, that shows power transmission to the delivery stacker elevating unit according to the embodiment of the invention (performing power transmission in reverse rotation).
Figure 9:
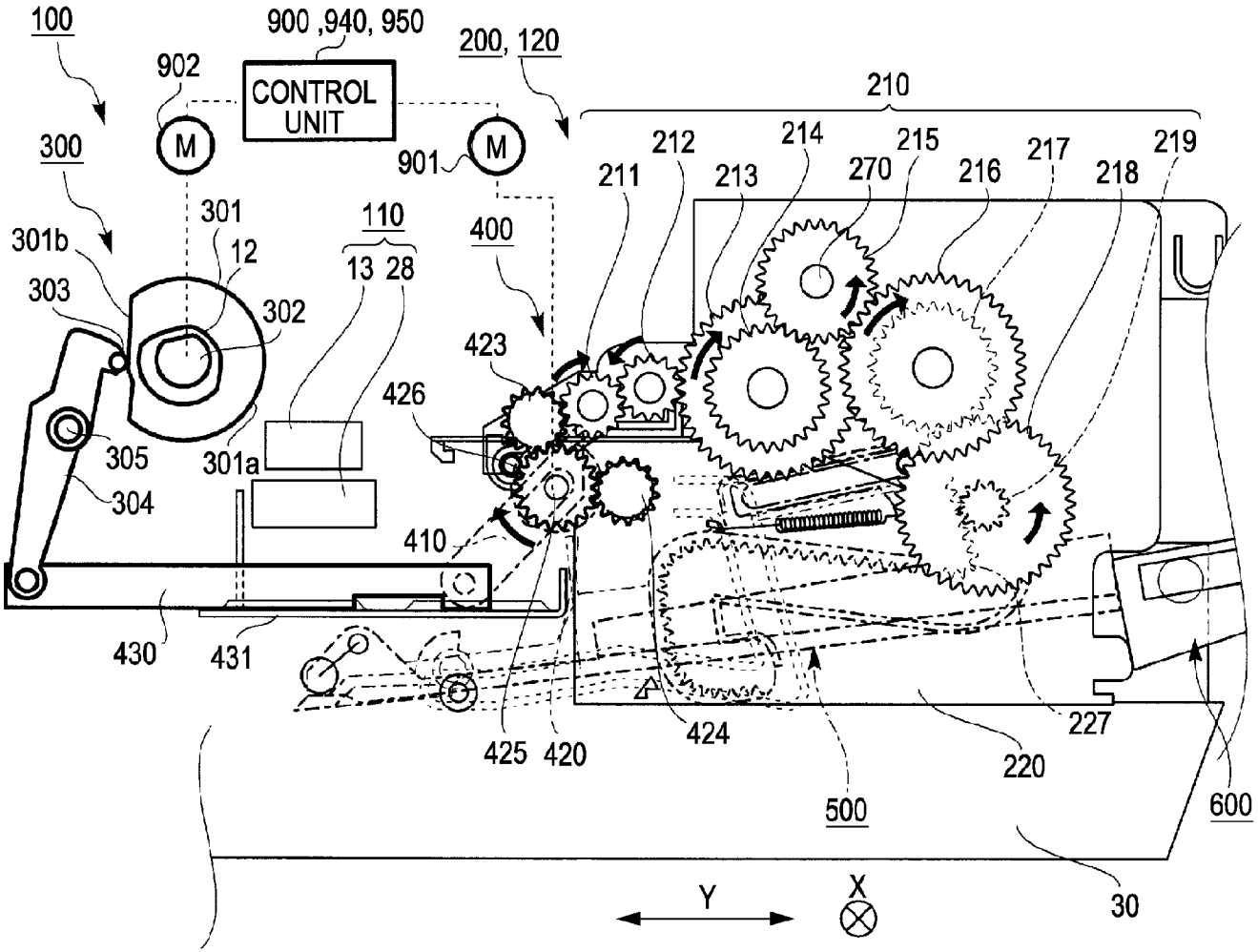
FIG. 9 is a schematic side view, with partially cut away, that shows power transmission to the delivery stacker elevating unit according to the embodiment of the invention (performing power transmission in forward rotation).

FIG. 7 to FIG. 9 are schematic side views that show power transmission to the delivery stacker elevating unit according to the embodiment of the invention. FIG. 7 is a view that shows a state where power is interrupted. FIG. 8 is a view that shows a state where power is transmitted when the delivery drive roller is driven in reverse rotation. FIG. 9 is a view that shows a state where power is transmitted when the delivery drive roller is driven in forward rotation.

As shown in FIG. 7, the recording apparatus 100 includes a recording unit gap adjustment unit 300, the delivery stacker elevating unit 200, and a power transmission switching unit 400. The recording unit gap adjustment unit 300 is able to adjust a gap between the platen 28 and the recording head 13, which is provided in the recording unit 110, in response to the thickness of the sheet of paper, or the like. The delivery stacker elevating unit 200 moves the first delivery stacker 500 in order to guide and receive the CD-R tray Q when recording is performed on the label of the CD-R. The power transmission switching unit 400 switches power of the delivery drive roller 20*a* being transmitted to the delivery stacker elevating unit 200.

The recording unit gap adjustment unit 300 includes a cam shaft 302, a carriage guide shaft 12, a PG adjustment cam portion 301, and a lever member 304. The cam shaft 302 is rotated by means of a second motor 902, which serves as a PG adjustment motor. The carriage guide shaft 12 is provided offset from the rotational fulcrum of the cam shaft 302. The PG adjustment cam portion 301 is provided on the cam shaft 302. The lever member 304 always urges the PG adjustment cam portion 301 by a torsion coil spring (not shown). In addition, the delivery stacker elevating unit 200 includes a base portion 220, a power transmitting device 210, and the first delivery stacker 500. The power transmitting device 210 transmits power, which is transmitted from the power transmission switching unit 400, to the first delivery stacker 500. The first delivery stacker 500 is moved between the first position and the second position.

Furthermore, the power transmission switching unit 400 includes a sun gear 426, a first planetary gear 423, a second planetary gear 424, a planetary gear holder portion 420, a first gear 211, and a lock lever 410. The sun gear 426 is provided coaxially with the delivery drive roller 20*a*, rotated by the first motor 901, and integrally rotates with the delivery drive roller 20*a*. The first planetary gear 423 and the second planetary gear 424 are circumscribed on the sun gear 426. The planetary gear holder portion 420 holds the first planetary gear 423 and the second planetary gear 424 and rotatably swings about the rotation fulcrum shaft 425 of the sun gear 426. The first gear 211 receives power of the first planetary gear 423 and power of the second planetary gear 424. The lock lever 410 restricts the attitude of the planetary gear holder portion 420. Here, the first motor 901 is configured to rotate the transporting drive roller 19*a* and the feeding roller 14.

The recording head 13 is provided on the carriage 10 that moves in the horizontal scanning direction X owing to the carriage guide shaft 12. When the thickness of the sheet of paper P is changed, or when the recording mode is changed from the sheet recording mode in which recording is performed on the sheet of paper P to the CD-R recording mode in which recording is performed on the label face of the CD-R, the cam shaft 302 is rotated by the second motor 902 which serves as the PG adjustment motor. At this time, the carriage guide shaft 12 is offset from the cam shaft 302. Thus, the recording unit gap adjustment unit 300 is able to adjust a gap between the recording head 13 and the platen 28, that is, a so-called platen gap or a paper gap (hereinafter, referred to as "PG"), by rotating the cam shaft 302.

In addition, the cam shaft 302 is provided with the PG adjustment cam portion 301. Then, a lever contact portion 303 of the lever member 304, which is urged in a clockwise direction in the drawing about the lever shaft 305 by means of a torsion coil spring (not shown), is provided so as to press/contact the PG adjustment cam portion 301. At this time, PG adjustment is performed so that the cam shaft 302 is rotated within a range in which an arc portion 301*a* of the PG adjustment cam portion 301 is in contact with the lever contact portion 303. Then, when the recording mode is switched between the sheet recording mode and the CD-R recording mode, the power transmission switching unit 400, which will be described later, is switched by rotating the cam shaft 302 so that a chord portion 301*b* of the PG adjustment cam portion 301 is opposed to the lever contact portion 303.

One end of the lever member 304, which is opposite to the end at which the lever contact portion 303 is provided, is pivotally coupled to one end of a slide bar 430 that reciprocally is moved in a horizontal direction by a bar guide 431 provided in the base portion 220. On the other hand, the other end of the slide bar 430 is pivotally coupled to one end of the lock lever 410.

As described above, the sun gear 426 is provided so as to be rotated by the rotation of the delivery drive roller 20*a*. Then, the planetary gear holder portion 420 that holds the first planetary gear 423 and the second planetary gear 424 tries to rotate in the same direction as the direction in which the sun gear 426 rotates by the rotation of the sun gear 426, but the attitude of the planetary gear holder portion 420 is restricted by the lock lever 410. Then, both of the first planetary gear 423 and the second planetary gear 424 are spaced apart from the first gear 211. Thus, power of the sun gear 426 is not transmitted to the first gear 211.

Here, the planetary gear holder portion 420 may be configured to rotate in the same direction as the direction in which the sun gear 426 rotates by frictional resistance generated between the planetary gear holder portion 420 and the rotation fulcrum shaft 425. In addition, it may also be configured to rotate in the same direction as the direction in which the sun gear 426 rotates by frictional resistance generated between the planetary gear holder portion 420 and both of the first planetary gear 423 and the second planetary gear 424.

Switching from Sheet Recording Mode to CD-R Recording Mode

As shown in FIG. 8, when the cam shaft 302 is rotated in a clockwise direction and the chord portion 301*b* is then opposed to the lever contact portion 303, the lever member 304 is pivoted in a clockwise direction. Then, the slide bar 430 is moved to the left side in the drawing. Furthermore, in accordance with the movement of the slide bar 430 to the left side, the lock lever 410 is also moved, so that the planetary gear holder portion 420 is released from the restriction of the lock lever 410. Thus, force is generated to rotate the planetary gear holder portion 420 in the rotational direction of the sun gear 426. At this time, the delivery drive roller 20*a* is rotated in a counterclockwise direction in the drawing, which is a reverse rotational direction in which the sheet of paper P may be moved to the upstream side. Then, the sun gear 426 is provided so as to rotate in the same direction as the direction in which the delivery drive roller 20*a* rotates. Thus, the planetary gear holder portion 420 rotates in the counterclockwise direction about the rotation fulcrum shaft 425 of the sun gear 426, and the second planetary gear 424 then contacts the first gear 211. That is, power of the sun gear 426 is transmitted through the second planetary gear 424 to the first gear 211. At this time, the second planetary gear 424 is rotated in the clockwise direction while being in contact with the first gear 211, so that the first gear 211 is rotated in the counterclockwise direction.

The power transmitting device 210 of the delivery stacker elevating unit 200 includes the first gear 211, a second gear 212 that is circumscribed on the first gear 211, a third gear 213 that is circumscribed on the second gear 212, a fourth gear 214 that is integrally formed with the third gear 213, a fifth gear 215 that is circumscribed on the fourth gear 214, a sixth gear 216 that is circumscribed on the fifth gear 215, a seventh gear 217 that is integrally formed with the sixth gear 216, an eighth gear 218 that is circumscribed on the seventh gear 217, a pinion 219 that is integrally formed with the eighth gear 218, and a rack 227 that receives power of the pinion 219.

Note that each of the fifth gear 215, the sixth gear 216, the seventh gear 217, the eighth gear 218, the pinion 219 and the rack 227 is paired and provided at both sides in the widthwise direction with respect to the transport direction (Y), that is, in the horizontal scanning direction. Then, the pair of fifth gears 215 are provided so as to synchronously rotate through a power transmitting shaft 270. Thus, each of the pairs of sixth gears 216, seventh gears 217, eighth gears 218, pinions 219 and racks 227 may be synchronously rotated. Because the left side and the right side are synchronously rotated, in the following description, only one side will be described and a description of the other side is omitted.

As the first gear 211 rotates in the counterclockwise direction, power is transmitted to the second gear 212 and the second gear 212 then rotates in the clockwise direction. Then, power of the second gear 212 is transmitted to the third gear 213 and the third gear 213 then rotates in the counterclockwise direction. Since the fourth gear 214 is integrally formed with the third gear 213, the fourth gear 214 rotates in the counterclockwise direction together with the third gear 213. Power of the fourth gear 214 is transmitted to the fifth gear 215 and the fifth gear then rotates in the clockwise direction. Power of the fifth gear 215 is transmitted to the sixth gear 216 and the sixth gear then rotates in the counterclockwise direction. Since the seventh gear 217 is integrally formed with the sixth gear 216, the seventh gear 217 rotates in the counterclockwise direction together with the sixth gear 216. Power of the seventh gear 217 is transmitted to the eighth gear and the eighth gear 218 then rotates in the clockwise direction. Since the pinion 219 is integrally formed with the eighth gear 218, the pinion 219 rotates in the clockwise direction together with the eighth gear 218.

As the pinion 219 rotates in the clockwise direction, the pinion 219 is configured to move the first delivery stacker 500 from the first position to the second position through the rack 227 provided on the first delivery stacker side. Then, when the first delivery stacker 500 completes moving to the second position, the cam shaft 302 is rotated in the counterclockwise direction to a range in which the arc portion 301*a* contacts the lever contact portion 303, and the lever member 304 is rotated in the counterclockwise direction to a state shown in FIG. 7. Then, the cam shaft 302 rotates so that the PG is made into the CD-R recording mode.

Switching from CD-R Recording Mode to Sheet Recording Mode

On the other hand, when the recording mode is switched from the CD-R recording mode to the sheet recording mode, the cam shaft 302 is rotated from the state shown in FIG. 7 in the clockwise direction and the lever member 304 is rotated in the clockwise direction to the position shown in FIG. 9. Then, as described above, the planetary gear holder portion 420 is released from the restriction of the lock lever 410. At this time, as shown in FIG. 9, the delivery drive roller 20*a* is being rotated in the clockwise direction in the drawing, which is the forward rotation direction in which the sheet of paper P may be moved to the downstream side. Thus, as described above, the sun gear 426 also rotates in the clockwise direction, which is the same direction in which the delivery drive roller 20*a* rotates. Then, as described above, the sun gear 426 rotates the planetary gear holder portion 420 in the clockwise direction.

The planetary gear holder portion 420 is rotated in the clockwise direction to circumscribe the first planetary gear 423 on the first gear 211. Thus, power of the sun gear 426 is transmitted through the first planetary gear 423 to the first gear 211. Then, because the sun gear 426 rotates in the clockwise direction, the first planetary gear 423 rotates in the counterclockwise direction and the first gear 211 rotates in the clockwise direction. In accordance with the rotation of the first gear 211, from the upstream side to the downstream side in a power transmitting path, the second gear 212 rotates in the counterclockwise direction, the third gear 213 and the fourth gear 214 rotate in the clockwise direction, the fifth gear 215 rotates in the counterclockwise direction, the sixth gear 216 and the seventh gear 217 rotate in the clockwise direction, and the eighth gear 218 and the pinion 219 rotate in the counterclockwise direction.

As the pinion 219 rotates in the counterclockwise direction, the pinion 219 is configured to move the first delivery stacker 500 from the second position to the first position, which will be described later, through the rack 227 provided on the first delivery stacker side. Then, when the first delivery stacker 500 completes moving to the first position, the cam shaft 302 rotates in the counterclockwise direction to a range in which the arc portion 301*a* contacts the lever contact portion 303 and the lever member 304 is rotated in the counterclockwise direction to the state shown in FIG. 7. At this time, the cam shaft 302 rotates so that the PG is made into the sheet recording mode.

Movement of First Delivery Stacker from First Position to Second Position

Movement of the first delivery stacker 500 from the first position to the second position will be described. Here, the first position is, in the sheet recording mode, a position at which the sheet of paper P that is recorded and delivered by the delivery drive roller 20*a* may be received, and, in order to place the sheet of paper P, the first position is located at a position downstream than the delivery drive roller 20*a*. On the other hand, the second position is, in the CD-R recording mode, a position at which the CD-R tray Q that holds a CD-R before recording is guided to the pair of delivery rollers formed of the delivery drive roller 20*a* and the second delivery driven rollers 503 and the CD-R tray Q that holds the recorded CD-R that is delivered by the pair of delivery rollers formed of the delivery drive roller 20*a* and the second delivery driven rollers 503 may be received, and at the second position the CD-R tray guide face 523 of the first delivery stacker 500 is substantially flush with the upper end of the delivery drive roller 20*a*.

Figure 10:
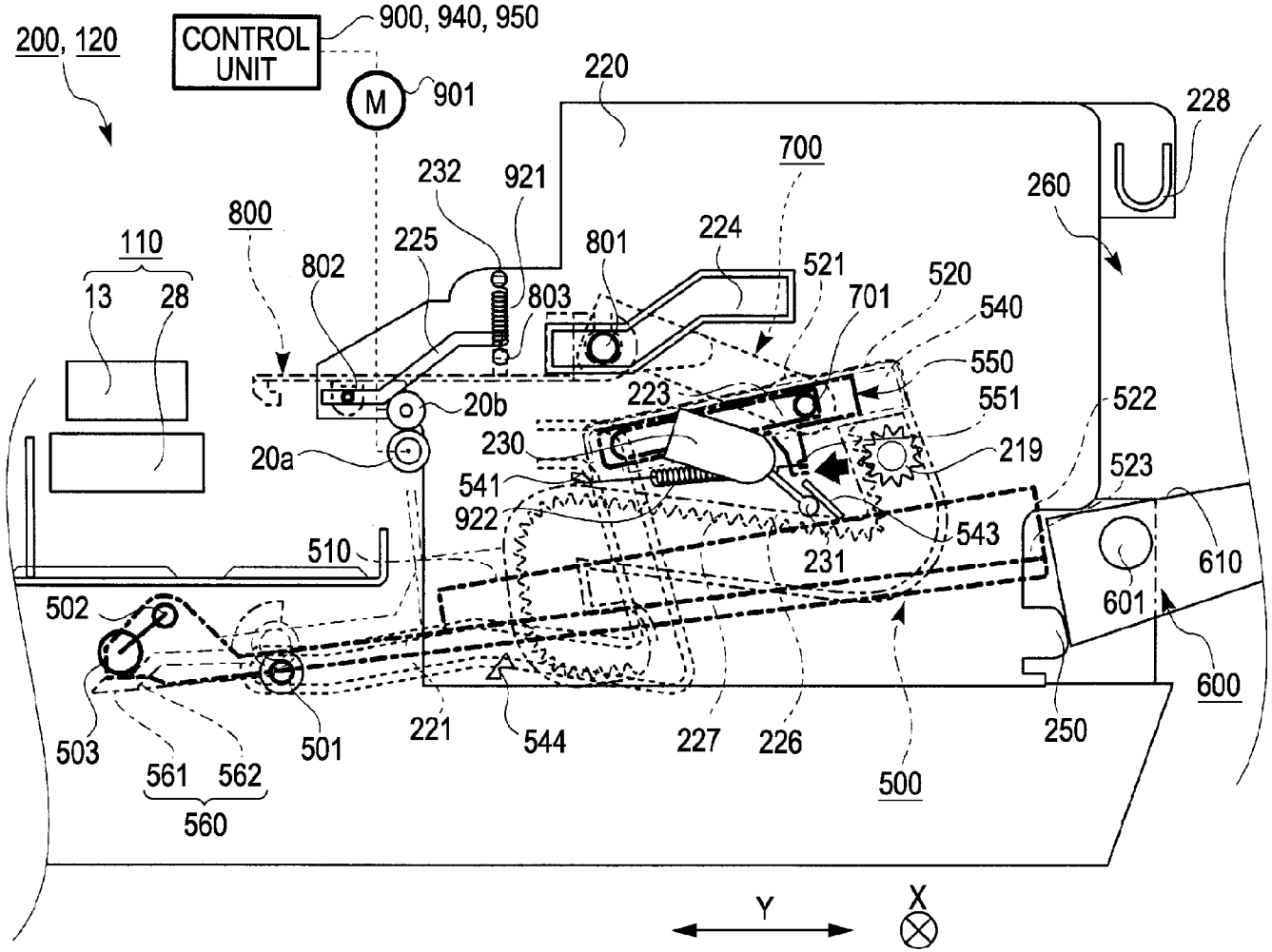
FIG. 10 is a side view, with partially cut away, that shows movement of a first delivery stacker of the delivery stacker elevating unit according to the embodiment of the invention (first position).

FIG. 10 to FIG. 24 are side views that show the movement of the first delivery stacker of the delivery stacker elevating unit according to the embodiment of the invention. FIG. 10 is a view that shows the first position of the first delivery stacker. FIG. 11 to FIG. 23 are views that show a state where the first delivery stacker is being moved from the first position to the second position. FIG. 24 is a view that shows the second position of the first delivery stacker. As shown in FIG. 10, the delivery stacker elevating unit 200 includes the first delivery stacker 500, the second delivery stacker 600, the delivery drive roller 20*a*, a delivery frame portion 800, coupling arm portions 700, and the power transmitting device 210. The first delivery stacker 500 is moved between the first position and the second position. The second delivery stacker 600 is arranged downstream of the first delivery stacker 500 in the transport direction. The delivery drive roller 20*a* is provided on the base portion side. The delivery frame portion 800 that includes the first delivery driven rollers 20*b* that deliver the sheet of paper P in the delivery direction in cooperation with the delivery drive roller 20*a*. The coupling arm portions 700 couple the delivery frame portion 800 with the first delivery stacker 500. The power transmitting device 210 transmits power of the delivery drive roller 20*a* to the first delivery stacker 500.

A first groove is formed on the right side of the base portion 220 as viewed in the transport direction, that is, on the eightieth digit side in the horizontal scanning direction, so as to guide the movement of the first delivery stacker 500. In addition, a pair of third grooves 224 and a pair of fourth grooves 225 are provided at both sides of the base portion 220 in the horizontal scanning direction so as to guide the movement of the delivery frame portion 800. Furthermore, an attitude restricting portion 228 is provided above the first digit side of the base portion 220 in the horizontal scanning direction so as to restrict the attitude of the first delivery stacker 500 while it is being moved.

The first delivery stacker 500 includes a first mount portion 510, a CD-R tray guide opening portion 522, a first projecting portion 501, the second delivery driven rollers 503, a contact face 520 and a contact projecting portion 521. The sheet of paper P delivered at the first position is placed on the upper face of the first mount portion 510. The CD-R tray guide opening portion 522, inside the first mount portion, guides the CD-R tray Q before recording to the pair of the delivery rollers formed of the delivery drive roller 20*a* and the second delivery driven rollers 503 and receives the recorded CD-R tray Q at the second position. The first projecting portion 501 is engaged with and guided by the first groove 221 of the base portion 220. The second delivery driven rollers 503 are provided upstream of the first mount portion 510 in the transport direction. The second delivery driven rollers 503 swing about the swing shaft 502 while being urged by a spring (not shown), and moves the CD-R tray Q in the transport direction (Y) in cooperation with the delivery drive roller 20*a*. The contact face 520 and the contact projecting portion 521 will contact the attitude restricting portion 228 of the base portion 220.

In addition, the first delivery stacker 500 includes a pair of slider guide grooves 540, a pair of slider portions 550, a pair of second springs 922. The pair of slider guide grooves 540 are formed at both sides in the horizontal scanning direction. The pair of slider portions 550 are guided by the slider guide grooves 540 and slide inside the slider guide grooves 520. The pair of second springs 922 are urging devices that urge the slider portions 550 toward the upstream side in the transport direction with respect to the first delivery stacker 500. One ends of the second springs 922 engage slider side spring engaging portions 551 that are provided in the slider portions 550, and the other ends of the second springs 922 engage delivery stacker side spring engaging portions 541 that are provided on the first delivery stacker 500. Furthermore, the pair of slider portions 550 are provided with a pair of second grooves 223 that engage the coupling arm portions 700.

Moreover, the first delivery stacker 500 is provided with a pair of fifth grooves 226 that are provided at both sides in the horizontal scanning direction. Then, the pair of fifth grooves 226 each have the rack 227 formed on one face thereof and are configured to be mesh with the above described pair of pinions 219. In addition, the first delivery stacker 500 includes a first sensor contact portion 543 and a second sensor contact portion 544. The first sensor contact portion 543 contacts a position sensor 230, which is provided on the base portion 220, at the first position, which is a so-called home position. The second sensor contact portion 544 contacts the position sensor 230 at the second position. The position sensor 230 is configured to switch among an ON state (upper side position), an OFF state (intermediate position) and an ON state (lower side position) on the basis of the position of a protrusion 231 of the position sensor 230. Thus, at the first position, the first sensor contact portion 543 contacts the position sensor 230 and pushes the protrusion 231 downward, so that the position sensor 230 becomes an ON state.

The second delivery stacker 600 is pivoted about a cover shaft 601 and includes a second mount portion 610 that places the delivered sheet of paper P in cooperation with the first delivery stacker 500 located at the first position. The second delivery stacker 600, when recording is not performed, is configured to pivot about the cover shaft 601 to close the mount opening portion 260. In other words, the second delivery stacker 600 also serves as a cover case. When the second delivery stacker 600 is opened, the attitude of the second delivery stacker 600 is restricted by a cover restricting portion 250 that is provided on the base portion 220.

The delivery frame portion 800 includes a pair of third projecting portions 801, a pair of fourth projecting portions 802, and the first delivery driven rollers 20*b*. The pair of third projecting portions 801 are engaged with and guided by the pair of third grooves 224 formed in the base portion 220. The pair of fourth projecting portions 802 are engaged with and guided by the pair of fourth grooves 225 formed in the base portion 220. The first delivery driven rollers 20*b* are circumscribed on the delivery drive roller 20*a* on the base portion side while being urged by a spring (not shown). In addition, the delivery frame portion 800 is always urged by a first spring 921, which is an urging device, to a position, which is a position upstream in the transport direction, where the delivery frame portion 800 should be located when the first delivery stacker 500 is located at the first position. One end of the first spring 921 engages a delivery frame side spring engaging portion 803 that is provided in the delivery frame portion 800, and the other end of the first spring 921 engages a base side spring engaging portion 232 that is provided in the base portion 220.

The coupling arm portions 700 have a pair of second projecting portions 701 at one ends thereof. The pair of second projecting portions 701 are engaged with and guided by the pair of second grooves 223 of the first delivery stacker 500. The other ends of the coupling arm portions 700 are pivotally coupled to the third projecting portions 801 that are provided at the downstream side of the delivery frame portion 800 in the transport direction.

At the first position, the level of the downstream end of the first delivery stacker 500 in the transport direction is provided so as to be higher than the level of the upstream end of the second delivery stacker 600 in the transport direction. Thus, in the sheet recording mode, there is no possibility that the distal end portion of the sheet of paper P delivered from the delivery roller 20 is erroneously caught by a step formed between the first mount portion 510 of the first delivery stacker 500 and the second mount portion 610 of the second delivery stacker 600.

In addition, at the first position, the second springs 922 urge the slider portions 550 toward the upstream side in the transport direction in the first delivery stacker 500. At this time, the urging force of the second springs 922 is applied to the coupling arm portions 700 because the second projecting portions 701 of the coupling arm portions 700 abut against the downstream ends of the second grooves 223 of the slider portions 550. That is, the urging force of the second springs 922 is applied through the coupling arm portions 700 to the delivery frame portion 800. Thus, the delivery frame portion 800 is positioned with high accuracy owing to the abutment of the upstream sides of the third grooves 224 against the third projecting portions 801 and the abutment of the upstream sides of the fourth grooves 225 against the fourth projecting portions 802. On the other hand, almost no urging force of the first spring 921 is applied to the delivery frame portion 800.

Note that the amount of driving of the first motor 901 when the first delivery stacker 500 is moved from the first position to the second position is controlled so that the first motor 901 stops when a motor load increases due to the abutment when the first delivery stacker 500 reaches the second position or the first motor 901 stops a predetermined steps after the first sensor contact portion 543 provided in the first delivery stacker 500 leaves the position sensor 230. On the other hand, the amount of driving of the first motor 901 when the first delivery stacker 500 is moved from the second position to the first position is controlled so that the first motor 901 stops when a motor load increases due to the abutment when the first delivery stacker 500 reaches the first position or the first motor 901 stops a predetermined steps after the second sensor contact portion 544 provided in the first delivery stacker 500 leaves the position sensor 230. Incidentally, in the following description, because the pairs of second springs, slider portions, second projecting portions, third projecting portions, fourth projecting portions, slider guide grooves, second grooves, third grooves and fourth grooves, which are provided in pairs in the horizontal scanning direction, have the same shape on both sides and operate synchronously with each other, only one side will be described, and a description of the other side is omitted.

Figure 11:
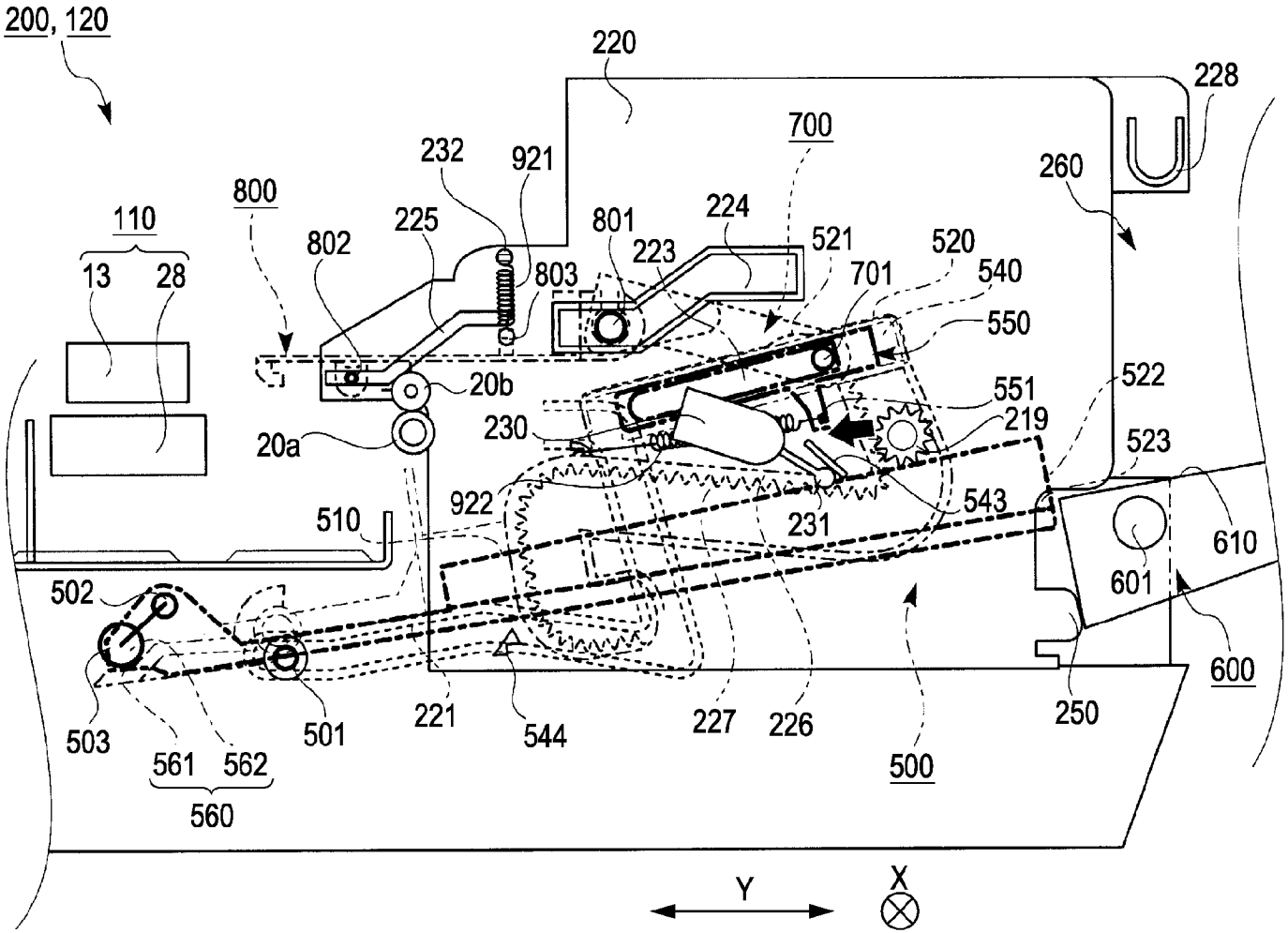
FIG. 11 is a side view, with partially cut away, that shows movement of the first delivery stacker according to the embodiment of the invention (lifting downstream end).

As shown in FIG. 11, as the pinion 219 rotates from the state shown in FIG. 10 in the clockwise direction, power is transmitted to the rack 227 of the first delivery stacker 500. At this time, because the position of the pinion 219 is fixed to the base portion side, the pinion 219 tries to move the first delivery stacker 500 upward as it advances downward within the fifth groove 226 that has the rack 227 therein. That is, force is applied to the first delivery stacker 500 to move upward. Then, the first delivery stacker 500 inclines so that the downstream end in the transport direction is lifted about the first projecting portion 501 located upstream in the transport direction. At this time, the slider portion 550, as it is restricted by the second projecting portion 701 of the coupling arm portion 700, is gradually moved downstream in the transport direction within the slider guide groove against the urging force of the second spring 922.

Figure 12:
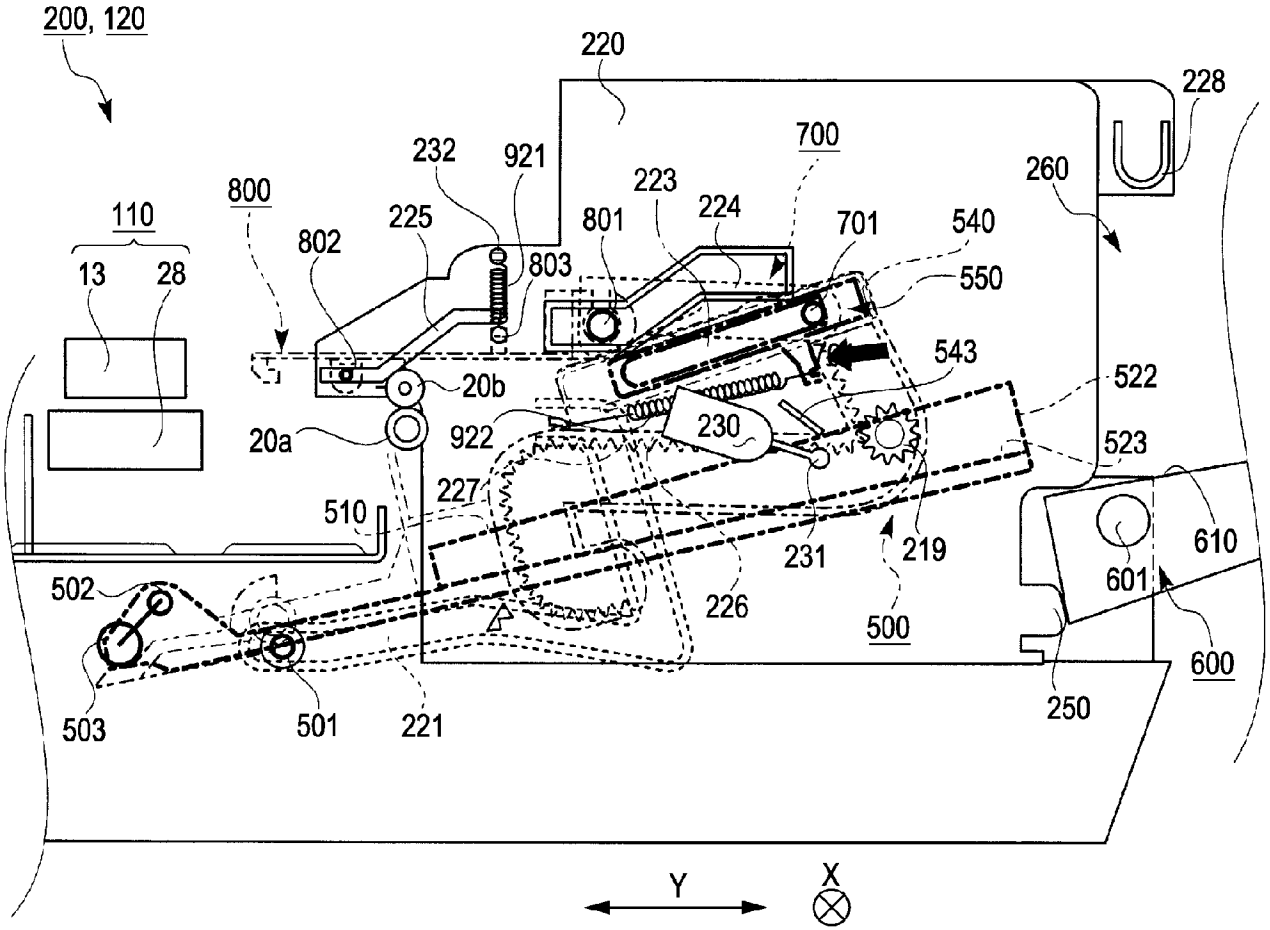
FIG. 12 is a side view, with partially cut away, that shows movement of the first delivery stacker according to the embodiment of the invention (lifting downstream end).

As shown in FIG. 12, as the pinion 219 is further rotated from the state shown in FIG. 11 in the clockwise direction, the pinion 219 tries to further move the first delivery stacker 500 upward through the rack 227. Thus, the first delivery stacker 500 further inclines about the first projecting portion 501 so that the downstream end in the transport direction is further lifted. Then, the level of the lower end of the downstream end of the first delivery stacker 500 in the transport direction is higher than the level of the upper end of the upstream end of the second delivery stacker 600 in the transport direction.

At this time, the slider portion 550, as it is restricted by the second projecting portion 701 of the coupling arm portion 700, further moves to the downstream side in the transport direction within the slider guide groove against the urging force of the second spring 922. Then, the slider portion 550 stops at a position where the slider portion 550 does not contact the downstream end of the slider guide groove 540. At this time, because the second spring 922 is maximally expanded, the urging force of the second spring 922 becomes maximum. That is, the delivery frame portion 800 maximally receives the action of the second spring 922 through the coupling arm portion 700. In addition, as the downstream end of the first delivery stacker 500 is lifted, the first sensor contact portion 543 leaves the position sensor 230 to enter an OFF state. Then, counting of the number of steps of the first motor 901 is started.

Figure 13:
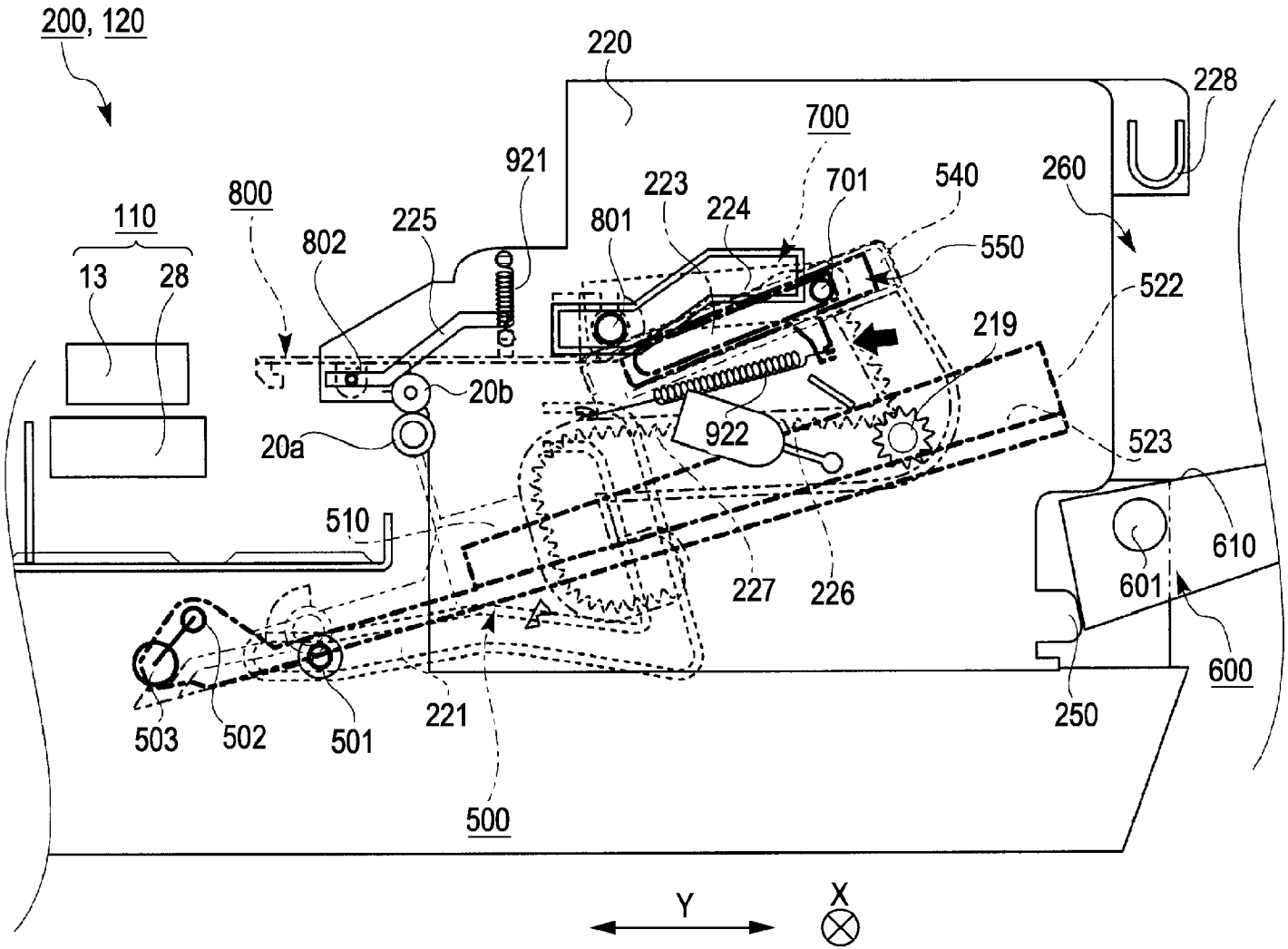
FIG. 13 is a side view, with partially cut away, that shows movement of the first delivery stacker according to the embodiment of the invention (moving toward downstream side).

As shown in FIG. 13, as the pinion 219 is further rotated from the state shown in FIG. 12 in the clockwise direction, the pinion 219 tries to move to the upstream side in the transport direction along the fifth groove 226. That is, the pinion 219 tries to move the first delivery stacker 500 to the downstream side in the transport direction through the rack 227. Thus, while the first delivery stacker 500 is guided by the engagement of the first projecting portion 501 and the first groove 221 and also guide by the engagement of the pinion 219 and the rack 227, the first delivery stacker 500 is moved to the downstream side in the transport direction. Then, because the inclination of the first delivery stacker 500, that is, the attitude of the first delivery stacker 500, is restricted by the engagement of the first projecting portion 501 and the first groove 221 and the engagement of the pinion 219 and the rack 227, the attitude that the downstream end is lifted remains as it is. Thus, the first delivery stacker 500 is able to be moved to the downstream side in the transport direction so that the level of the downstream end of the first delivery stacker 500 in the transport direction is higher than the level of the upstream end of the second delivery stacker 600. At this time, the slider portion 550, as it is supported by the urging force of the second spring 922, is moved to the upstream side in the transport direction within the slider guide groove. That is, the urging force of the second spring 922 helps the movement of the first delivery stacker 500 to the downstream side in the transport direction. Thus, it is possible to reduce a load on the first motor 901. Particularly, it is effective in lifting the first delivery stacker 500.

Figure 14:
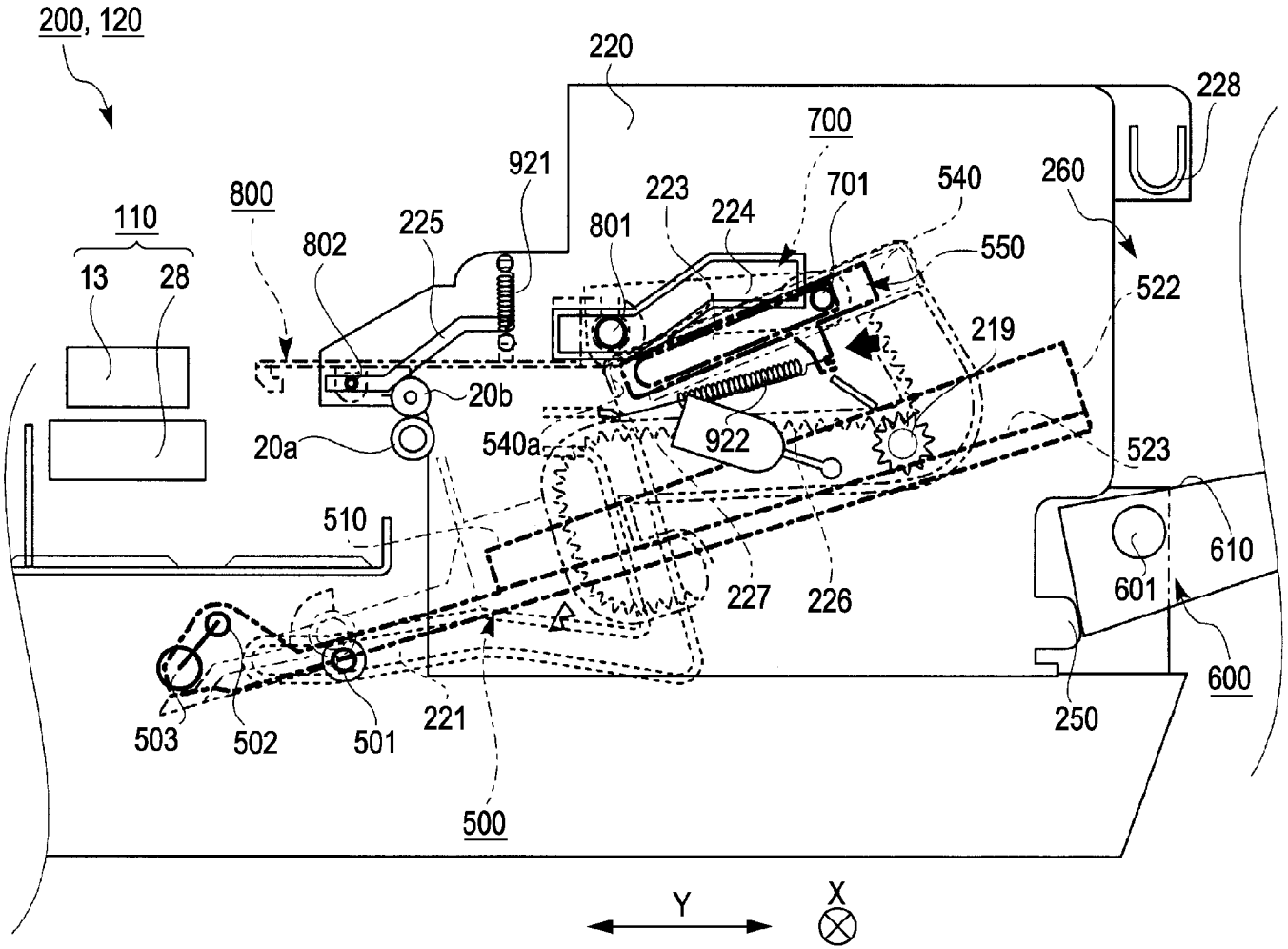
FIG. 14 is a side view, with partially cut away, that shows movement of the first delivery stacker according to the embodiment of the invention (moving toward downstream side).

As shown in FIG. 14, as the pinion 219 is further rotated from the state shown in FIG. 13 in the clockwise direction, the pinion 219 tries to further move the first delivery stacker 500 to the downstream side in the transport direction through the rack 227. Thus, while the first delivery stacker 500 is guided by the engagement of the first projecting portion 501 and the first groove 221 and also guide by the engagement of the pinion 219 and the rack 227, the first delivery stacker 500 is further moved to the downstream side in the transport direction. At this time, the slider portion 550, as it is supported by the urging force of the second spring 922, is moved to the upstream side in the transport direction within the slider guide groove. Then, because the second spring 922 gradually contracts, the urging force of the second spring 922 gradually reduces. That is, the action of the second spring 922 that the delivery frame portion 800 receives through the coupling arm portion 700 gradually reduces.

Figure 15:
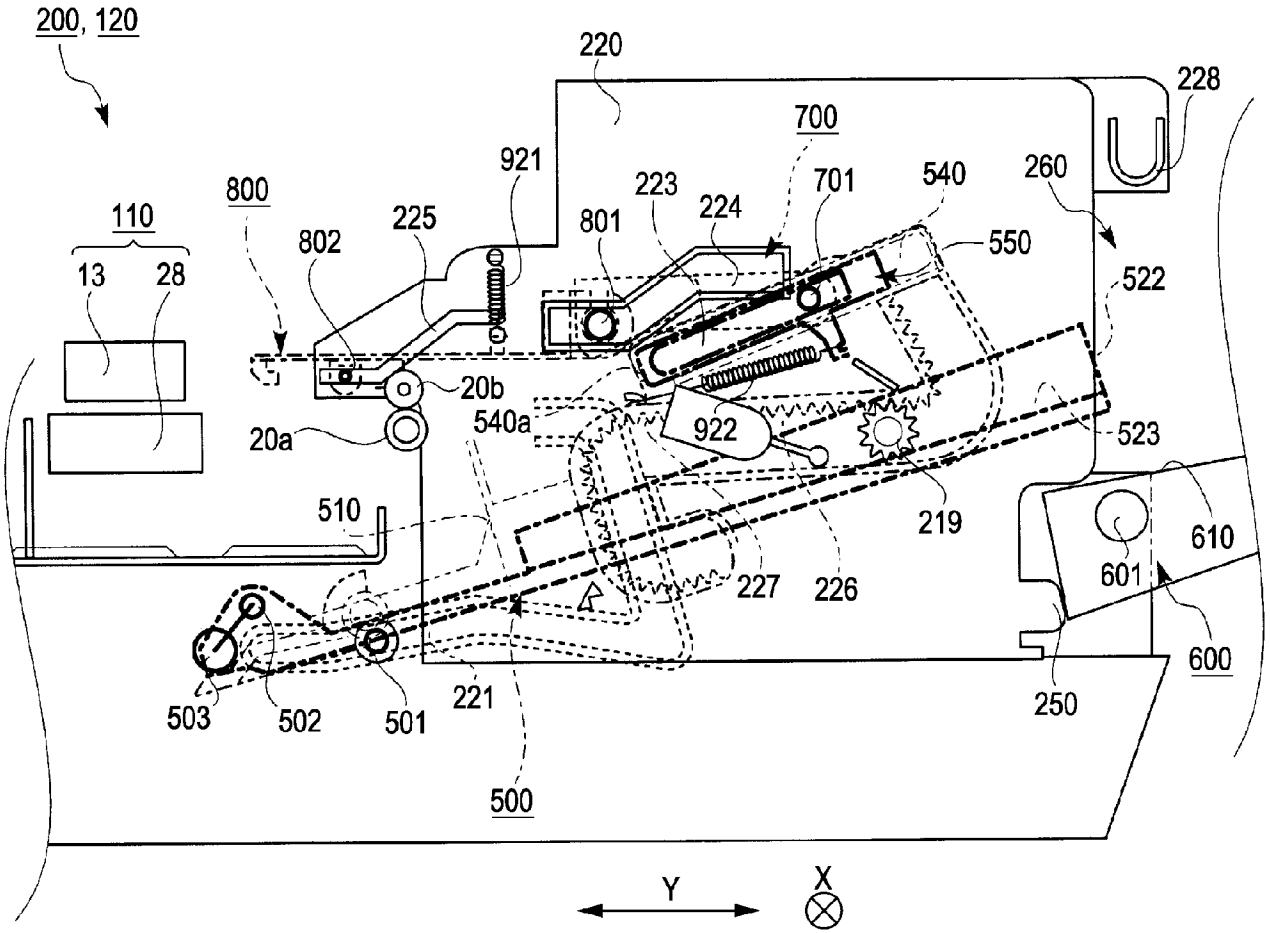
FIG. 15 is a side view, with partially cut away, that shows movement of the first delivery stacker according to the embodiment of the invention (moving toward downstream side).

As shown in FIG. 15, as the pinion 219 is further rotated from the state shown in FIG. 14 in the clockwise direction, the pinion 219 tries to further move the first delivery stacker 500 to the downstream side in the transport direction through the rack 227. Thus, while the first delivery stacker 500 is guided by the engagement of the first projecting portion 501 and the first groove 221 and also guide by the engagement of the pinion 219 and the rack 227, the first delivery stacker 500 is further moved to the downstream side in the transport direction.

At this time, the slider portion 550, as it is supported by the urging force of the second spring 922, is further moved to the upstream side in the transport direction within the slider guide groove and then contacts an upstream end 540*a* of the slider guide groove 540. After that, in accordance with the movement of the first delivery stacker 500 to the downstream side in the transport direction, the second projecting portion 701 of the coupling arm portion 700 leaves the downstream end of the second groove 223 of the slider portion 550 and gradually moves to the upstream side within the second groove 223. Thus, the delivery frame portion 800 is in a state where the delivery frame portion 800 is not affected by the second spring 922.

Figure 16:
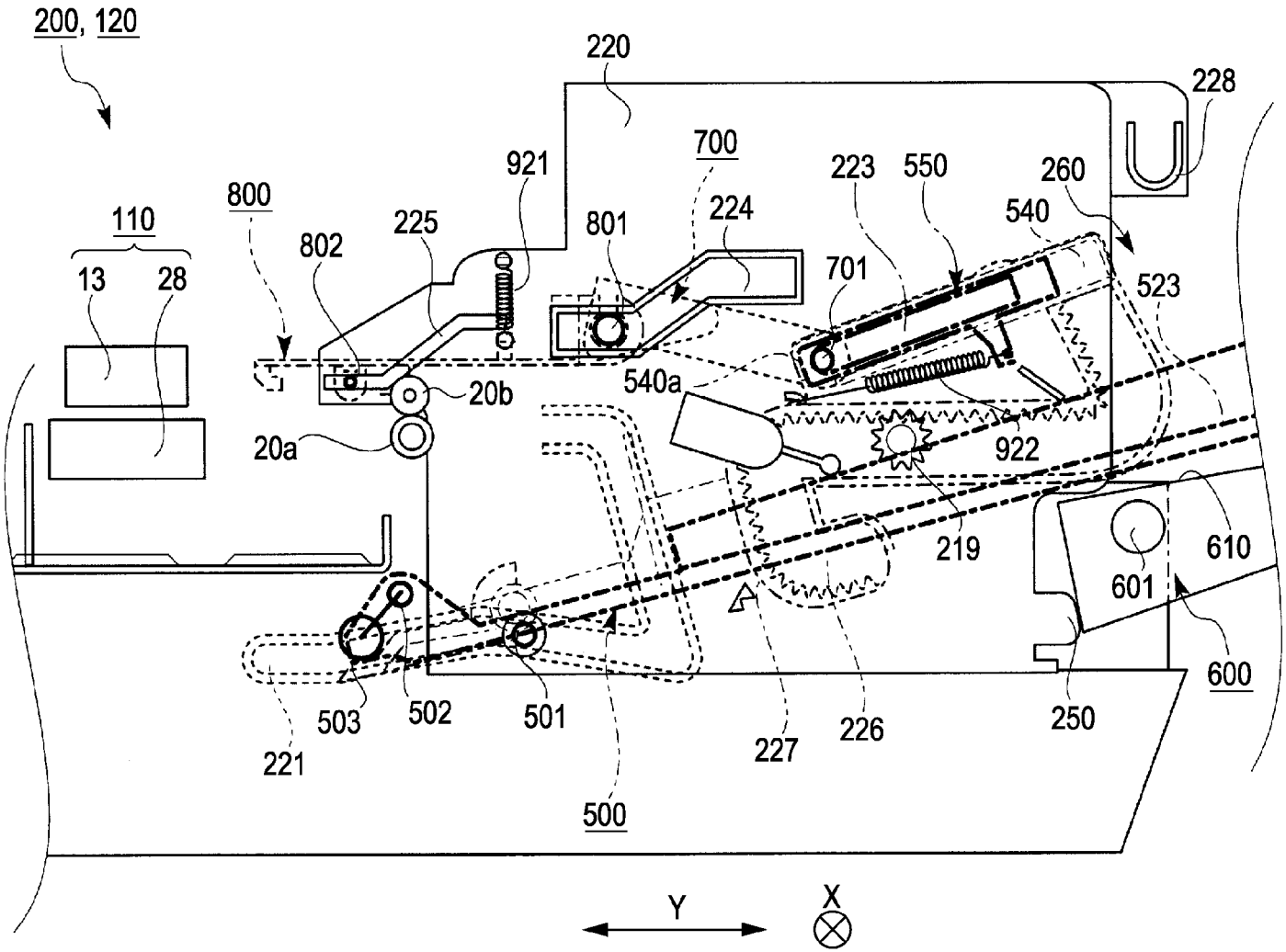
FIG. 16 is a side view, with partially cut away, that shows movement of the first delivery stacker according to the embodiment of the invention (moving toward downstream side).

As shown in FIG. 16, as the pinion 219 is further rotated from the state shown in FIG. 15 in the clockwise direction, the pinion 219 tries to further move the first delivery stacker 500 to the downstream side in the transport direction through the rack 227. Thus, while the first delivery stacker 500 is guided by the engagement of the first projecting portion 501 and the first groove 221 and also guide by the engagement of the pinion 219 and the rack 227, the first delivery stacker 500 is further moved to the downstream side in the transport direction. At this time, the second projecting portion 701 of the coupling arm portion 700 is moved to the upstream side in the transport direction within the second groove 223 of the first delivery stacker 500 and then abuts against the upstream end of the second groove 223.

Figure 17:
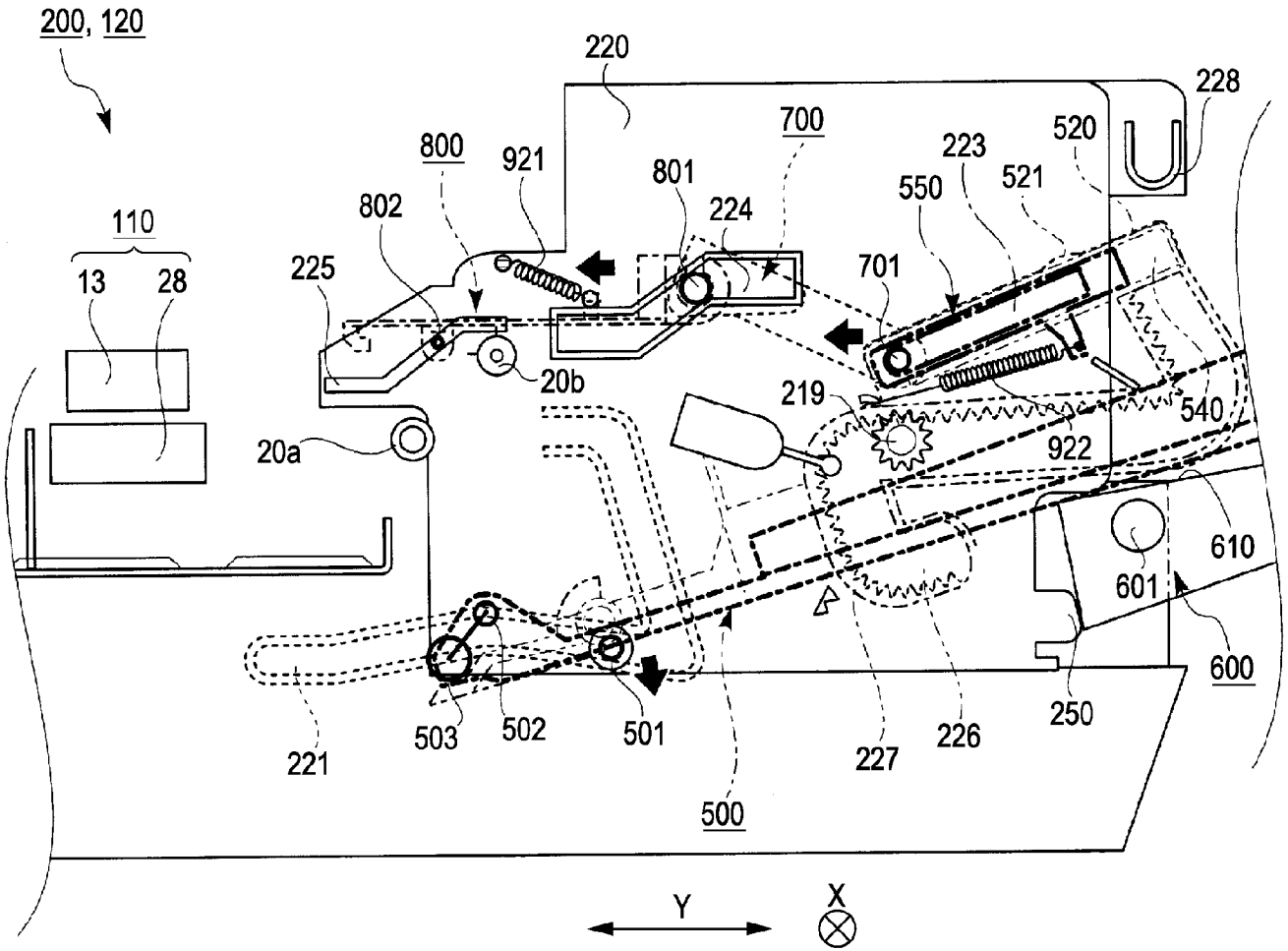
FIG. 17 is a side view, with partially cut away, that shows movement of the first delivery stacker according to the embodiment of the invention (moving toward downstream side).

As shown in FIG. 17, as the pinion 219 is further rotated from the state shown in FIG. 16 in the clockwise direction, the first delivery stacker 500 is further moved to the downstream side in the transport direction. Then, because the second projecting portion 701 of the coupling arm portion 700 abuts against the upstream end of the second groove 223 in the transport direction, the first delivery stacker 500 moves the delivery frame portion 800 to the downstream side in the transport direction against the urging force of the first spring 921 through the coupling arm portion 700.

Then, the delivery frame portion 800 is guided by the engagement of the third projecting portion 801 and the third groove 224 and the engagement of the fourth projecting portion 802 and the fourth groove 225 and then moved to the downstream side in the transport direction and upward. Then, in accordance with the movement of the delivery frame portion 800, the first delivery driven rollers 20*b* provided in the delivery frame portion 800 leave from the delivery drive roller 20*a*. Note that, in accordance with the movement of the delivery frame portion 800, the delivery support driven rollers 22 (see FIG. 3) are also moved in the same direction as the direction in which the first delivery driven rollers 20*b* move.

Furthermore, by the urging force of the first spring 921, force is applied so that the second projecting portion 701 of the coupling arm portion 700 pulls the upstream end of the second groove 223 of the first delivery stacker 500 to the upstream side. Thus, force is applied to the first delivery stacker 500 so as to pivot in the counterclockwise direction about a portion of the rack 227, at which the rack 227 is in mesh with the pinion 219. Then, by the force to pivot in the counterclockwise direction, the first projecting portion 501, which is located on the opposite side to the second projecting portion 701 with respect to the above pivotal fulcrum, is pressed against the lower face of the first groove 221. Thus, it further stabilizes the attitude of the first delivery stacker 500 while it is moving.

Figure 18:
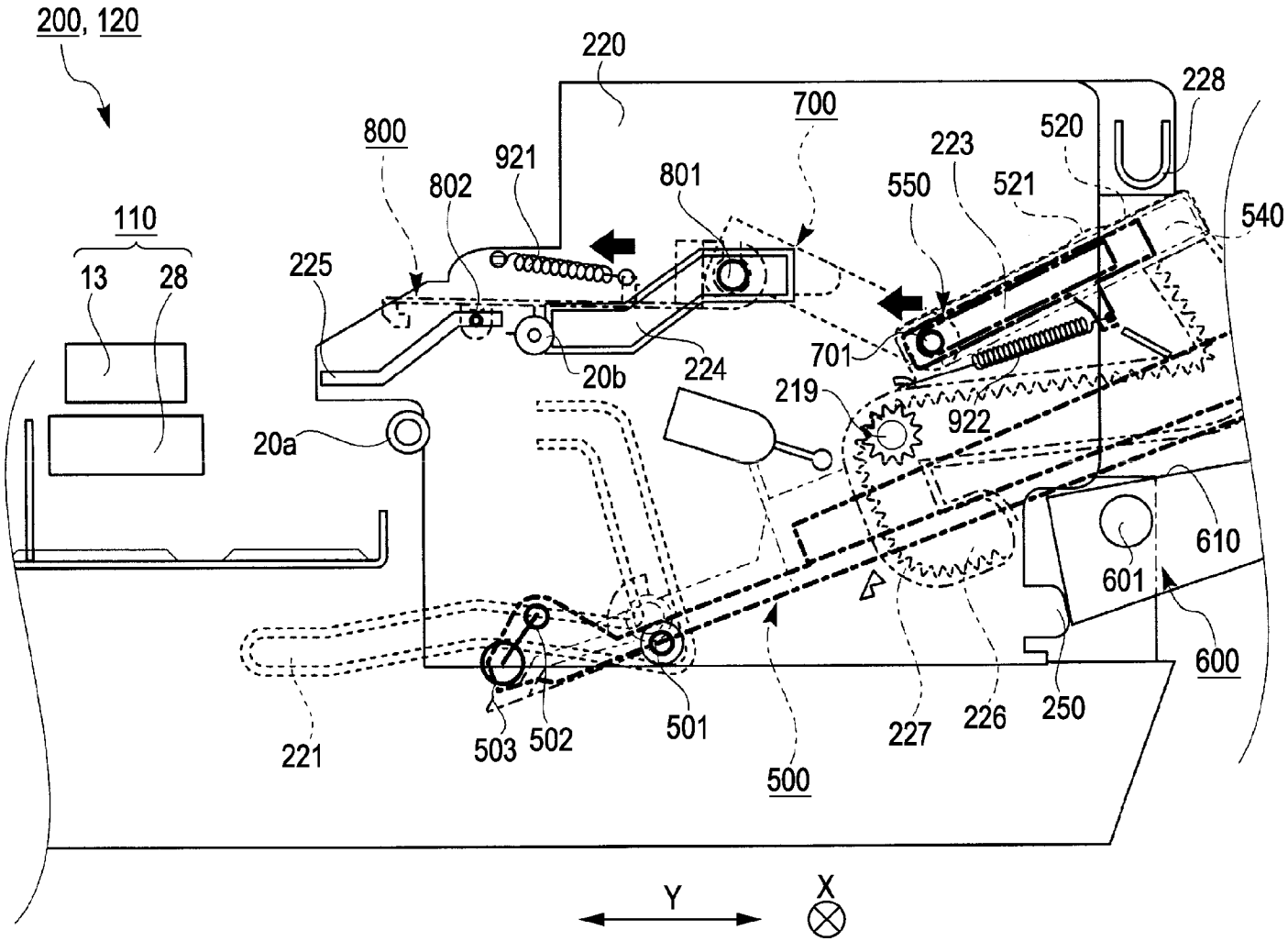
FIG. 18 is a side view, with partially cut away, that shows movement of the first delivery stacker according to the embodiment of the invention (moving toward downstream side).

As shown in FIG. 18, as the pinion 219 is further rotated from the state shown in FIG. 17 in the clockwise direction, the first delivery stacker 500 is further moved to the downstream side in the transport direction. Then, the first delivery stacker 500 is moved to the downstream side in the transport direction, while the first delivery stacker 500 further moves the delivery frame portion 800 to the downstream side in the transport direction through the coupling arm portion 700 against the urging force of the first spring 921.

Figure 19:
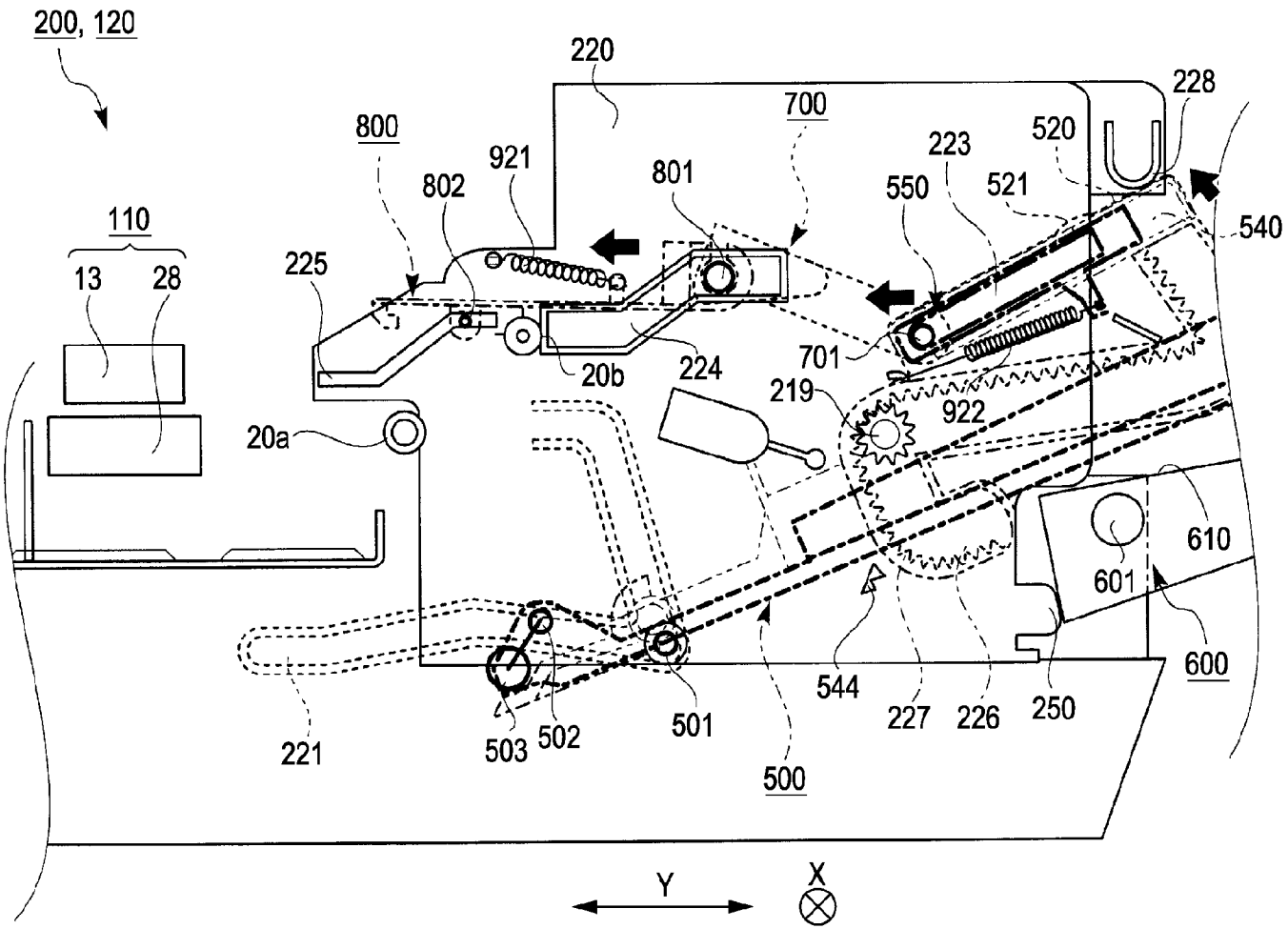
FIG. 19 is a side view, with partially cut away, that shows movement of the first delivery stacker according to the embodiment of the invention (lifting upstream end).

As shown in FIG. 19, as the pinion 219 is further rotated from the state shown in FIG. 18 in the clockwise direction, the pinion 219 tries to move downward along the fifth groove 226. That is, the pinion 219 tries to move the first delivery stacker 500 upward through the rack 227. At this time, by the urging force of the first spring 921, force is applied to the first delivery stacker 500 so as to pivot in the counterclockwise direction about a portion of the rack 227, at which the rack 227 is in mesh with the pinion 219. As the pinion 219 rotates in the clockwise direction, the first delivery stacker 500 inclines about the first projecting portion 501 so that the downstream end of the first delivery stacker 500 is further lifted. Then, the contact face 520, which is provided above the downstream end of the first delivery stacker 500 in the transport direction, contacts the attitude restricting portion 228 of the base portion 220.

When the contact face 520 is in contact with the attitude restricting portion 228, the portion at which the second projecting portion 701 contacts the second groove 223, that is, the portion to which the urging force of the first spring 921 is applied, is located between the portion of the rack 227, at which the rack 227 is in mesh with the pinion 219, and the portion of the contact face 520, at which the contact face 520 contacts the attitude restricting portion 228. Thus, the rotation of the first delivery stacker 500 in the counterclockwise direction about the portion of the rack 227, at which the rack 227 is in mesh with the pinion 219, by the urging force of the first spring 921 may be restricted in such a manner that the attitude restricting portion 228 contacts the contact face 520.

As the pinion 219 is further rotated in the clockwise direction, because the downstream side of the first delivery stacker 500 in the transport direction is restricted by the attitude restricting portion 228 from moving upward, the first delivery stacker 500 is moved about the downstream side in the transport direction so as to lift the upstream side upward. At this time, because the contact face 520 contacts the attitude restricting portion 228 and, at the same time, the first delivery stacker 500 is restricted from pivoting in the counterclockwise direction about the portion of the rack 227, at which the rack 227 is in mesh with the pinion 219, the first projecting portion 501 is released from a state where it is pressed against the lower face of the first groove 221. Thus, the pinion 219 is rotated in the clockwise direction, and the first projecting portion 501 is moved upward along the first groove 221. In addition, in accordance with the movement of the first delivery stacker 500, the delivery frame portion 800 is further moved to the downstream side in the transport direction.

Figure 20:
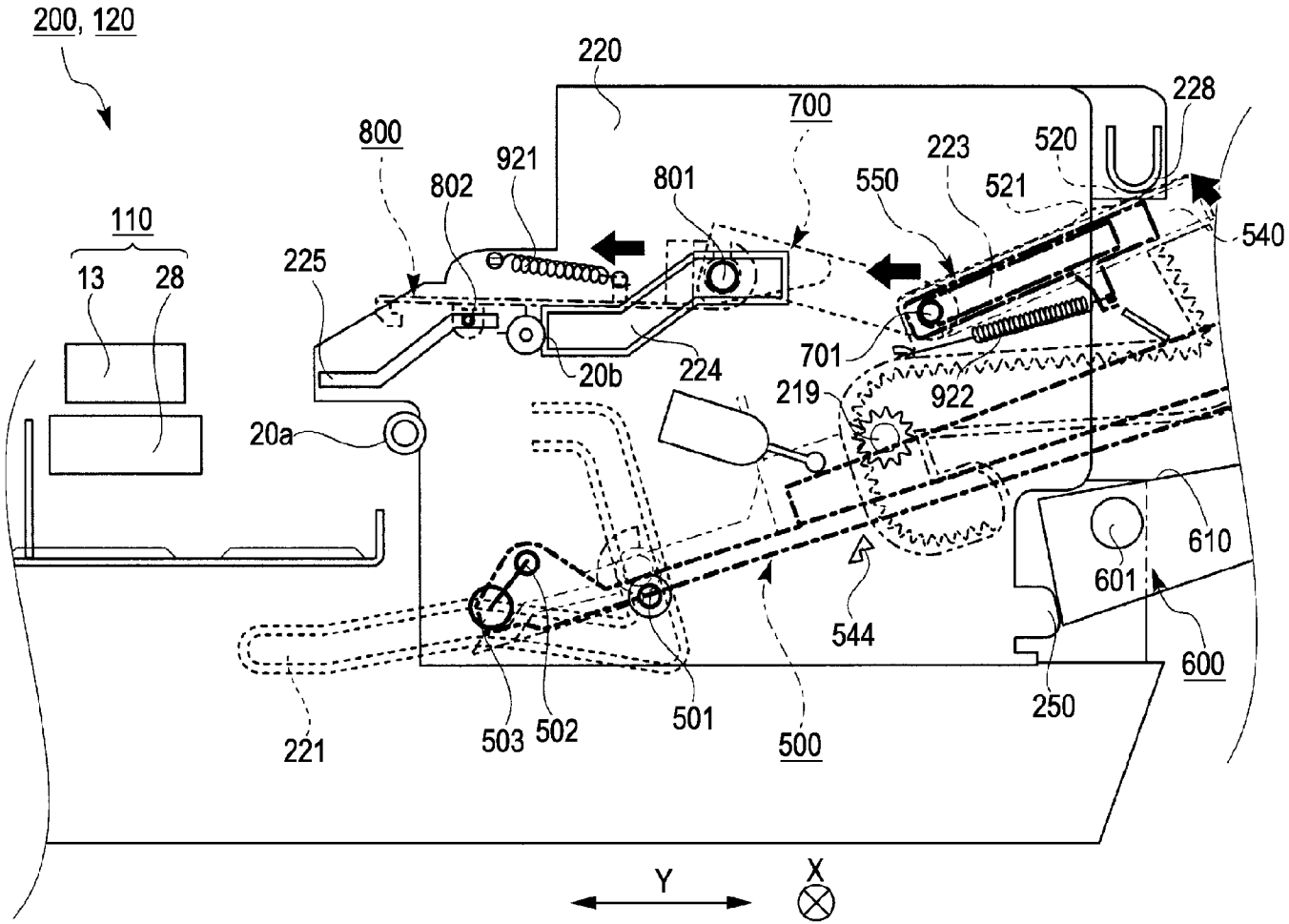
FIG. 20 is a side view, with partially cut away, that shows movement of the first delivery stacker according to the embodiment of the invention (lifting upstream end).

As shown in FIG. 20, as the pinion 219 is further rotated from the state shown in FIG. 19 in the clockwise direction, the pinion 219 tries to further move the first delivery stacker 500 upward through the rack 227. Thus, the first delivery stacker 500 moves about the downstream side in the transport direction so that the upstream end in the transport direction is further lifted. That is, the first delivery stacker 500 is moved so that the inclination of the CD-R tray guide face 523 of the first delivery stacker 500 relative to the transport direction (Y) is reduced. In addition, in accordance with the movement of the first delivery stacker 500, the delivery frame portion 800 is further moved to the downstream side in the transport direction.

Figure 21:
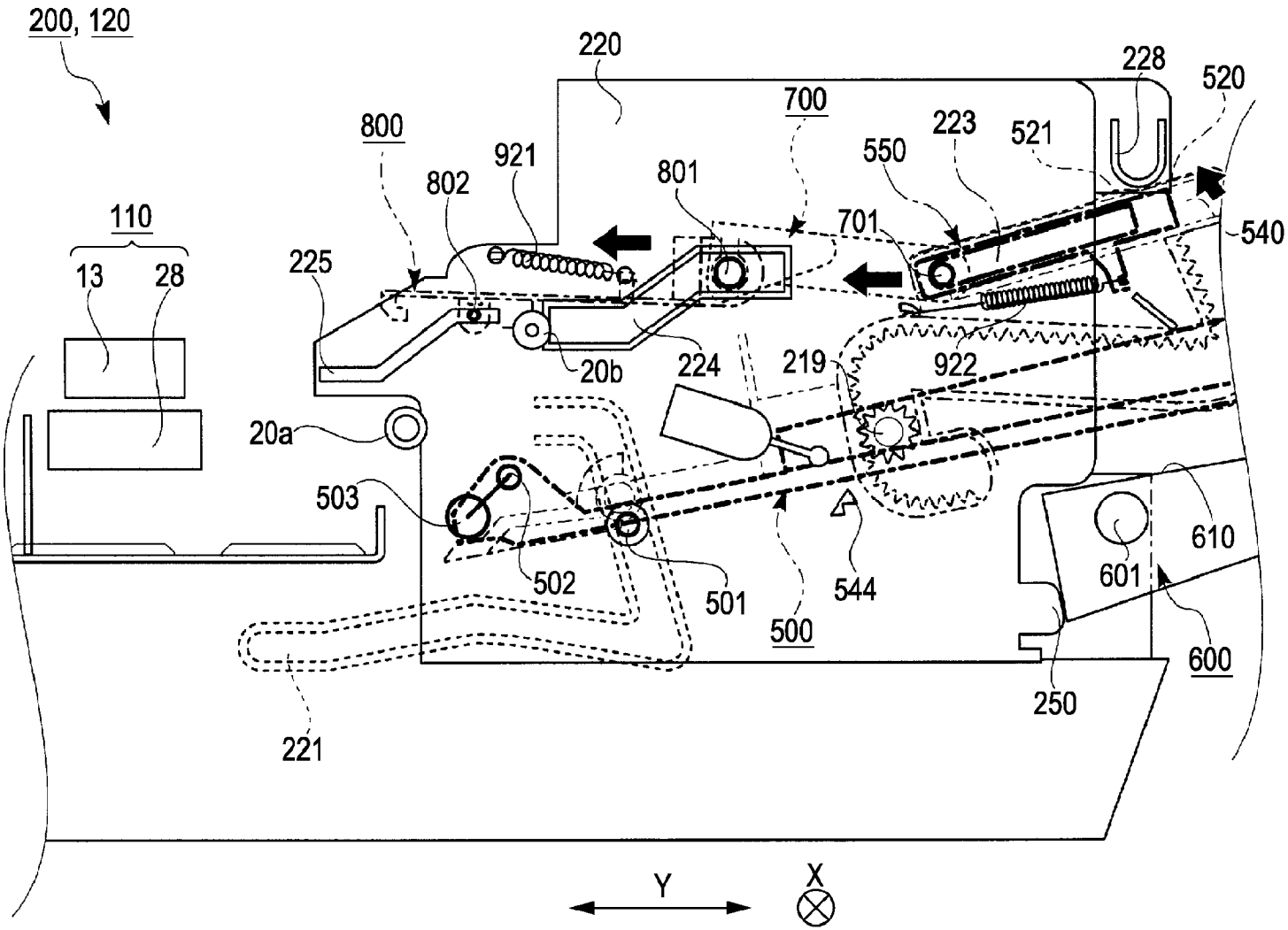
FIG. 21 is a side view, with partially cut away, that shows movement of the first delivery stacker according to the embodiment of the invention (lifting upstream end).

As shown in FIG. 21, as the pinion 219 is further rotated from the state shown in FIG. 20 in the clockwise direction, the first delivery stacker 500 is moved about the downstream side in the transport direction so that the upstream end in the transport direction is further lifted. At this time, the attitude restricting portion 228 of the base portion 220 contacts the contact projecting portion 521 that is provided on the contact face 520 of the first delivery stacker 500. The contact projecting portion 521 is configured so that, when the first delivery stacker 500 is moved and the attitude of the CD-R tray guide face 523 of the first delivery stacker 500 is made parallel to the transport direction (Y), the attitude restricting portion 228 is always ready to contact the first delivery stacker 500. In addition, in accordance with the movement of the first delivery stacker 500, the delivery frame portion 800 is further moved to the downstream side in the transport direction.

Figure 22:
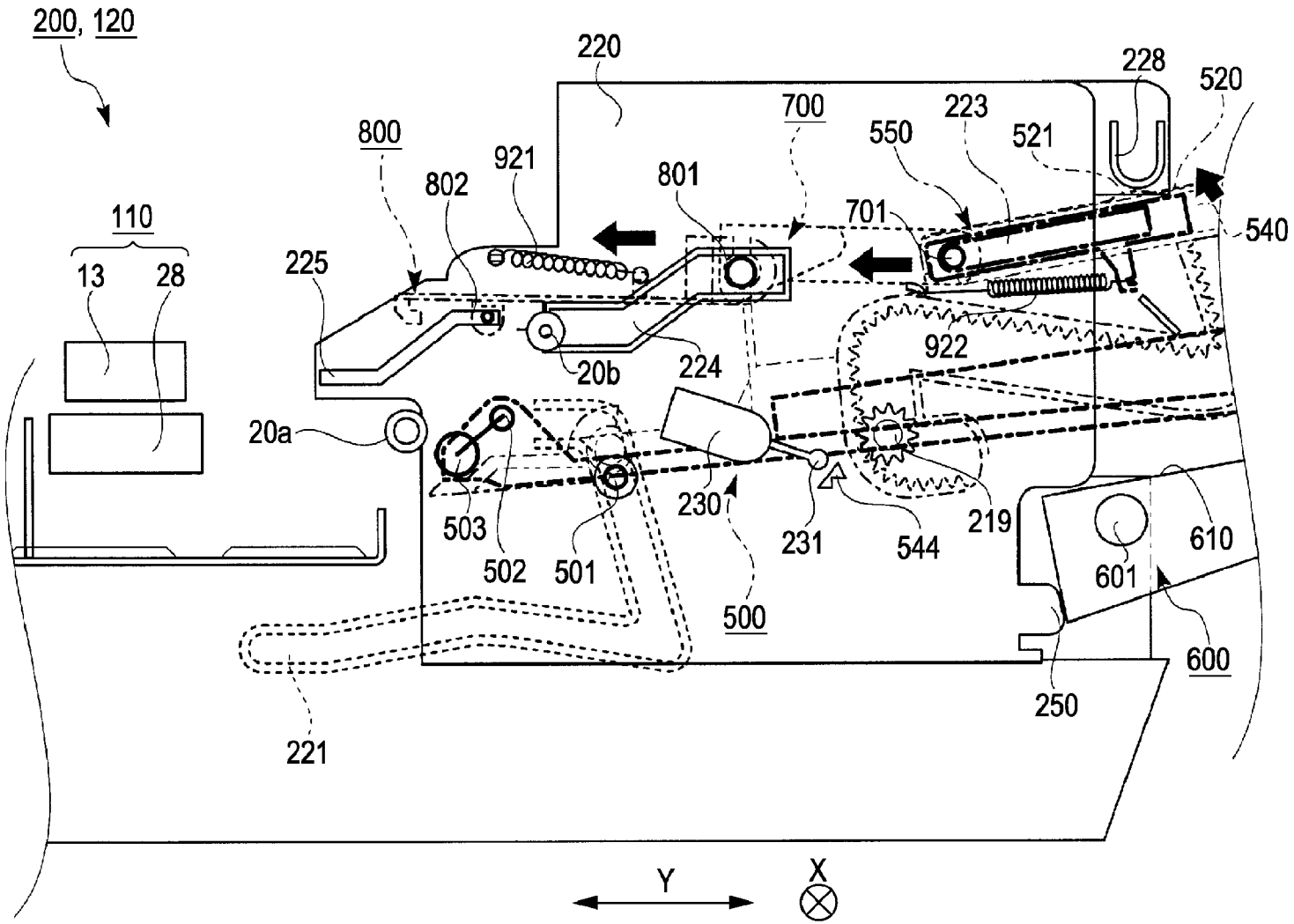
FIG. 22 is a side view, with partially cut away, that shows movement of the first delivery stacker according to the embodiment of the invention (lifting upstream end).

As shown in FIG. 22, as the pinion 219 is further rotated from the state shown in FIG. 21 in the clockwise direction, the first delivery stacker 500 is moved about the downstream side in the transport direction so that the upstream end in the transport direction is further lifted. At this time, the second delivery driven rollers 503 provided upstream of the first delivery stacker 500 in the transport direction are moved to a position in proximity to the downstream side of the base portion side delivery drive roller 20*a* in the transport direction. After that, the second sensor contact portion 544 that is provided in the first delivery stacker 500 contacts the protrusion 231 of the position sensor 230. In addition, in accordance with the movement of the first delivery stacker 500, the delivery frame portion 800 is further moved to the downstream side in the transport direction.

Figure 23:
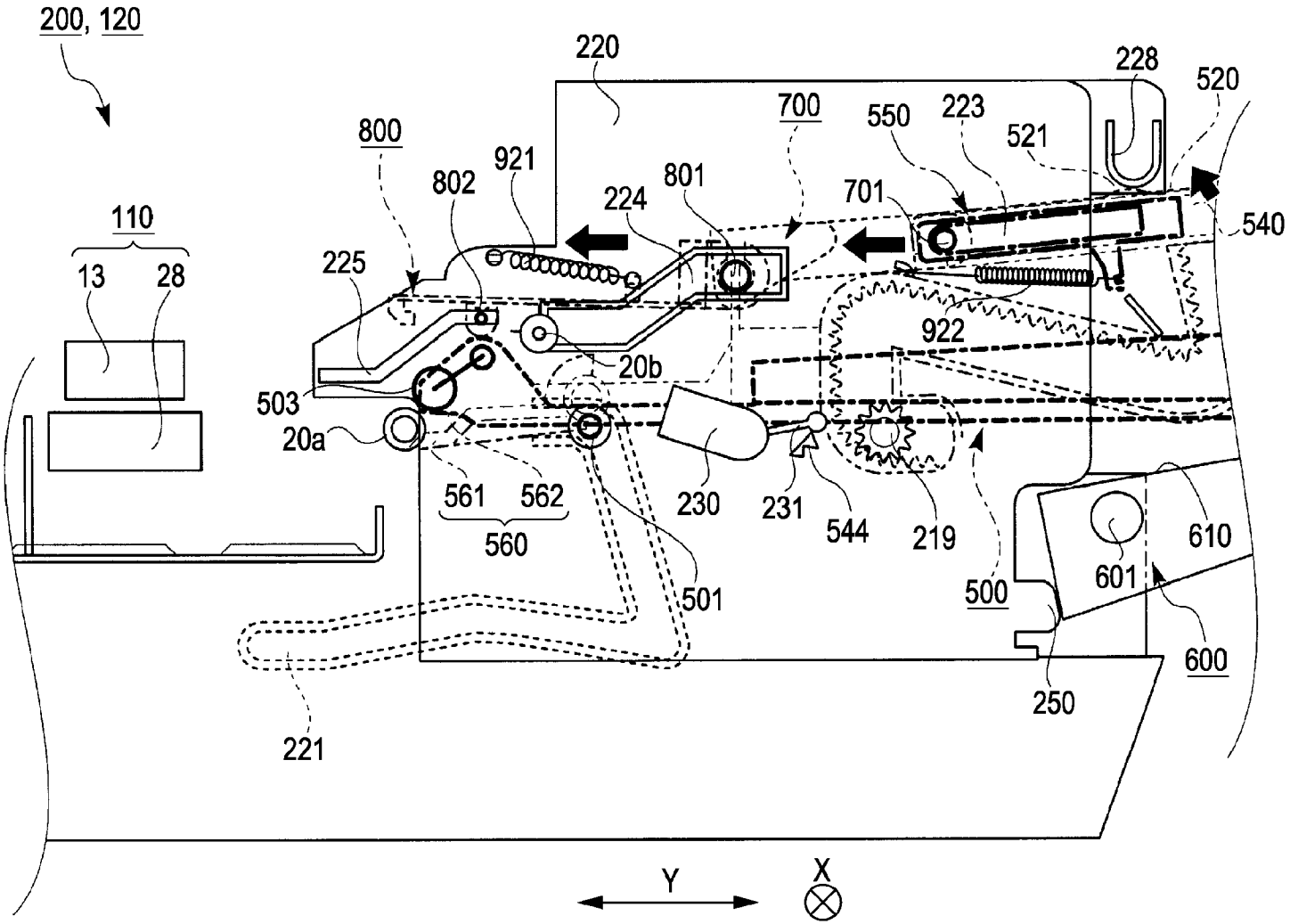
FIG. 23 is a side view, with partially cut away, that shows movement of the first delivery stacker according to the embodiment of the invention (moving toward upstream side).
Figure 24:
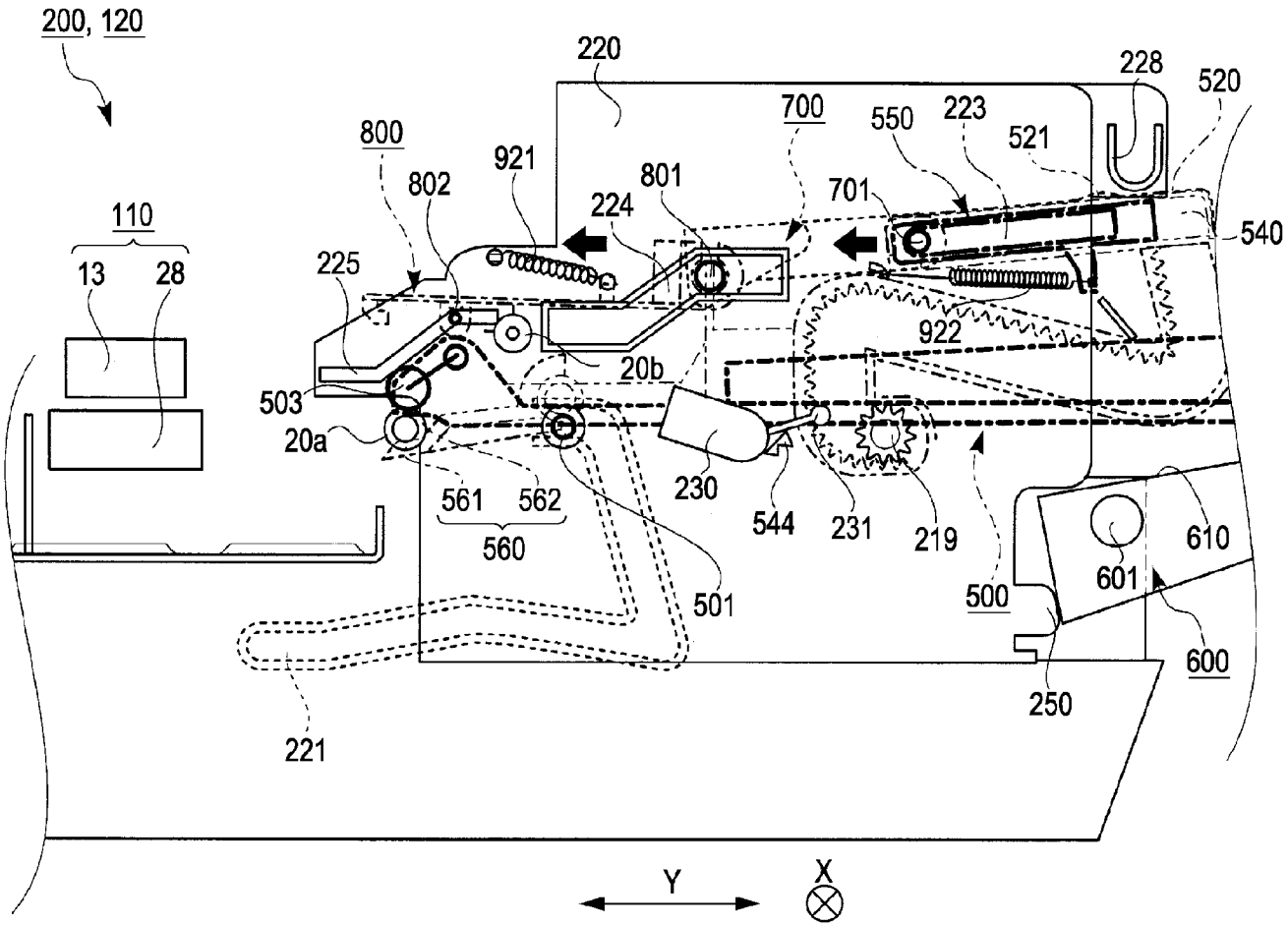
FIG. 24 is a side view, with partially cut away, that shows movement of the first delivery stacker according to the embodiment of the invention (second position).

As shown in FIG. 23, as the pinion 219 is further rotated from the state shown in FIG. 22 in the clockwise direction, the first delivery stacker 500 is moved about the downstream side in the transport direction so that the upstream end in the transport direction is further lifted. At this time, the second delivery driven rollers 503 provided upstream of the first delivery stacker 500 in the transport direction are moved to a position such that the level of the position is higher than the level of the base portion side delivery drive roller 20*a* and the lower portions of the second delivery driven rollers 503 are substantially flush with the upper portion of the delivery drive roller 20*a*. At this time, the second sensor contact portion 544 pushes the protrusion 231 of the position sensor 230 from the lower side to the upper side to make it enter an ON state.

In addition, the first delivery stacker 500 is provided with a two-way position restricting device 560 that determines the position of the first delivery stacker 500 at the second position. The position restricting device 560 includes a position restricting base portion 562 that is fixed to the first delivery stacker 500 and a position restricting lever 561 that is rotatable and urged to close the two-way portion by an urging device (not shown). Then, as shown in FIG. 23, the position restricting lever 561 contacts the shaft of the delivery drive roller 20*a* and then the position restricting lever 561 is pivoted to open the two-way portion against the urging force. Then, the inclination of the first delivery stacker 500, that is, the attitude of the first delivery stacker 500, is such that the CD-R tray guide face 523 of the first delivery stacker 500 is parallel to the transport direction (Y).

Here, "parallel" includes a state substantially parallel to the horizontal scanning direction X and the transport direction (Y) to such a degree that the CD-R tray Q may be guided to the recording unit 110 and the CD-R tray Q that has completed recording may be received. In addition, in accordance with the movement of the first delivery stacker 500, the delivery frame portion 800 is moved to the upstream side in the transport direction by receiving the urging force of the first spring 921.

As shown in FIG. 24, as the pinion 219 is further rotated from the state shown in FIG. 23 in the clockwise direction, the pinion 219 tries to move to the downstream side in the transport direction along the fifth groove 226. That is, the pinion 219 tries to move the first delivery stacker 500 to the upstream side in the transport direction through the rack 227 in cooperation with the urging force of the first spring 921. Thus, while the first delivery stacker 500 is guided by the engagement of the first projecting portion 501 and the first groove 221, the first delivery stacker 500 is moved to the upstream side in the transport direction. That is, the attitude of the first delivery stacker 500 is restricted by the engagement of the first projecting portion 501 and the first groove 221 and the engagement of the pinion 219 and the rack 227. Thus, the first delivery stacker 500 is moved to the upstream side in the transport direction while the CD-R tray guide face 523 is parallel to the transport direction (Y).

Then, the shaft of the delivery drive roller 20*a* is held by the position restricting base portion 562 of the position restricting device 560 and the position restricting lever 561 of the position restricting device 560. That is, the position and attitude of the first delivery stacker 500 are determined with high accuracy by the contact of the position restricting base portion 562 and the shaft of the delivery drive roller 20*a*. In addition, the second sensor contact portion 544 approaches the pivotal fulcrum of the protrusion 231 while the second sensor contact portion 544 is in contact with the lower side of the protrusion 231 of the position sensor 230. Thus, it is possible to reliably push the protrusion 231 upward to make it enter an ON state.

Moreover, in accordance with the movement of the first delivery stacker 500, the delivery frame portion 800 is further moved to the upstream side in the transport direction by receiving the urging force of the first spring 921.

Here, because the desired attitude of the first delivery stacker 500 is already obtained, the contact projecting portion 521 of the first delivery stacker 500 leaves the attitude restricting portion 228 of the base portion 220. That is, when the first delivery stacker 500 is moved in parallel, the attitude restricting portion 228 does not affect the first delivery stacker 500. Thus, there is no possibility that the attitude of the first delivery stacker 500 becomes unstable due to generation of frictional resistance between the first delivery stacker 500 and the attitude restricting portion 228.

In addition, by the urging force of the first spring 921, force is applied to the first delivery stacker 500 so as to pivot in the counterclockwise direction about a portion of the rack 227, at which the rack 227 is in mesh with the pinion 219. However, because the first projecting portion 501 of the first delivery stacker 500 is pressed against the lower portion of the first groove 221 of the base portion 220, the attitude of the first delivery stacker 500 may be held with high accuracy.

Then, the first delivery stacker 500 abuts against part of the base portion at the position where the lower portions of the second delivery driven rollers 503 of the first delivery stacker 500 contact the upper portion of the base portion side delivery drive roller 20*a*, and the first motor 901 stops driving the pinion 219. The stop position of the first delivery stacker 500 shown in FIG. 24 is the second position at which the first delivery stacker 500 is located in the CD-R recording mode. At this time, the second delivery driven rollers 503 is swingably urged toward the delivery drive roller by the urging force of a spring (not shown). Thus, in the CD-R recording mode, the second delivery driven rollers 503 may pinch the CD-R tray Q in cooperation with the delivery drive roller 20*a* and move the CD-R tray Q upstream and downstream in the transport direction.

In addition, the first motor 901 is controlled to be driven at a low speed when the position sensor 230 is in an ON state and to be driven at a high speed when the position sensor 230 is in an OFF state. That is, the first motor 901 is configured to be driven at a low speed near the first position and the second position and to be driven at a high speed at an intermediate position. Thus, when the first delivery stacker 500 reaches the second position from the first position, the first motor 901 is driven at a low speed, so that it is possible to set the stop position of the first delivery stacker 500 with high accuracy.

Accordingly, the delivery stacker elevating unit 200, without contacting the second delivery stacker 600, is able to move the downstream side of the first delivery stacker 500 upward and to the downstream side of the delivery stacker elevating unit 200 and then to move the upstream side of the first delivery stacker 500 so as to be lifted upward of the delivery stacker elevating unit 200. That is, the delivery stacker elevating unit 200, when the first delivery stacker 500 is moved from the first position to the second position, is able to move the first delivery stacker 500 even when the upper space of the first mount portion 510 of the first delivery stacker 500 and the upper space of the second mount portion 610 of the second delivery stacker 600 are, for example, limited by the bar guide 431, or the like.

Movement of First Delivery Stacker from Second Position to First Position

When the recording mode is switched from the CD-R recording mode to the sheet recording mode, power transmission state is switched from a state where power transmission is interrupted by the power transmission switching unit 400 as shown in FIG. 7 to a state where power transmission is connected as shown in FIG. 9 as described above. At this time, the delivery drive roller 20*a* is driven in forward rotation, that is, the sun gear 426 rotates in the clockwise direction. Then, power of the sun gear 426 is transmitted to the pinion 219 by the power transmitting device 210. Thus, the pinion 219 is rotated in the counterclockwise direction.

As the pinion 219 is rotated from the state shown in FIG. 24 in the counterclockwise direction, the pinion 219 tries to move to the upstream side in the transport direction along the fifth groove 226. That is, the pinion 219 tries to move the first delivery stacker 500 to the downstream side in the transport direction through the rack 227 against the urging force of the first spring 921. Thus, while the first delivery stacker 500 is guided by the engagement of the first projecting portion 501 and the first groove 221 and also guide by the engagement of the pinion 219 and the rack 227, the first delivery stacker 500 is moved to the downstream side in the transport direction. Then, the first delivery stacker 500 is moved to the downstream side in the transport direction while the first delivery stacker 500 maintains the attitude such that the CD-R tray guide face 523 of the first delivery stacker 500 is parallel to the transport direction (Y). Thus, the shaft of the delivery drive roller 20*a* is released from the holding state by the position restricting base portion 562 of the position restricting device 560 and the position restricting lever 561 of the position restricting device 560. That is, the first delivery stacker 500 is released from the restrictions on the attitude and position by the position restricting device 560. In addition, in accordance with the movement of the first delivery stacker 500, the delivery frame portion 800 is moved to the downstream side in the transport direction.

As shown in FIG. 23, as the pinion 219 is further rotated from the state shown in FIG. 24 in the counterclockwise direction, the first delivery stacker 500 is moved to the downstream side in the transport direction against the urging force of the first spring 921. At this time, the second delivery driven rollers 503 of the first delivery stacker 500 leaves the base portion side delivery drive roller 20*a*. In addition, the contact projecting portion 521 of the first delivery stacker 500 contacts the attitude restricting portion 228 of the base portion 220, which was spaced apart from the contact projecting portion 521. Then, the first projecting portion 501 of the first delivery stacker 500 leaves the lower face of the first groove 221 because of the shape of the first groove 221. Thus, by the urging force of the first spring 921, force is applied to the first delivery stacker 500 so as to pivot in the counterclockwise direction about a portion of the rack 227, at which the rack 227 is in mesh with the pinion 219. At this time, the attitude of the first delivery stacker 500 is restricted in such a manner that the attitude restricting portion 228 contacts the contact projecting portion 521. In addition, the position restricting lever 561 of the position restricting device 560 is pivoted so as to close the two-way portion while the position restricting lever 561 is being restricted by the shaft of the delivery drive roller 20*a*.

As shown in FIG. 22, as the pinion 219 is further rotated from the state shown in FIG. 23 in the counterclockwise direction, the first delivery stacker 500 is moved about the downstream side in the transport direction so that the upstream end in the transport direction is lowered. At this time, the second delivery driven rollers 503 provided upstream of the first delivery stacker 500 in the transport direction are moved to a position in proximity to the downstream side of the base portion side delivery drive roller 20*a* in the transport direction.

At this time, the second sensor contact portion 544 is spaced apart from the lower side of the protrusion 231 of the position sensor 230. Thus, the protrusion 231 may return to the intermediate state, and the position sensor 230 enters an OFF state. In addition, in accordance with the movement of the first delivery stacker 500, the delivery frame portion 800 is moved to the upstream side in the transport direction.

As shown in FIG. 21, as the pinion 219 is further rotated from the state shown in FIG. 22 in the counterclockwise direction, the first delivery stacker 500 is moved about the downstream side in the transport direction so that the upstream end in the transport direction is further lowered. At this time, the levels of the second delivery driven rollers 503 of the first delivery stacker 500 are lower than the level of the base portion side delivery drive roller 20*a*. In addition, in accordance with the movement of the first delivery stacker 500, the delivery frame portion 800 is further moved to the upstream side in the transport direction.

As shown in FIG. 20, as the pinion 219 is further rotated from the state shown in FIG. 21 in the counterclockwise direction, the first delivery stacker 500 is moved about the downstream side in the transport direction so that the upstream end in the transport direction is further lowered. At this time, the attitude restricting portion 228 of the base portion 220 leaves the contact projecting portion 521 of the first delivery stacker 500 and then contacts the contact face 520, so that the attitude restricting portion 228 restricts the attitude of the first delivery stacker 500. In addition, in accordance with the movement of the first delivery stacker 500, the delivery frame portion 800 is further moved to the upstream side in the transport direction.

As shown in FIG. 19, as the pinion 219 is further rotated from the state shown in FIG. 20 in the counterclockwise direction, the first delivery stacker 500 is moved about the downstream side in the transport direction so that the upstream end in the transport direction is further lowered. In addition, in accordance with the movement of the first delivery stacker 500, the delivery frame portion 800 is further moved to the upstream side in the transport direction.

As shown in FIG. 18, as the pinion 219 is further rotated from the state shown in FIG. 19 in the counterclockwise direction, the first delivery stacker 500 is moved about the downstream side in the transport direction so that the upstream end in the transport direction is further lowered. At this time, the first projecting portion 501 of the first delivery stacker 500, which is provided upstream in the transport direction of the first delivery stacker 500, abuts against the lower face of the first groove 221 of the base portion 220. Then, in accordance with the rotation of the pinion 219, against the force by which the first delivery stacker 500 is pivoted in the counterclockwise direction due to the urging force of the first spring 921, the first delivery stacker 500 is pivoted about a portion, at which the first projecting portion 501 contacts the first groove 221, in the clockwise direction and is moved so that the downstream side of the first delivery stacker 500 in the transport direction is lowered. Thus, the contact face 520 of the first delivery stacker 500 leaves from the attitude restricting portion 228 of the base portion 220. At this time, the attitude of the first delivery stacker 500 is restricted so that the first projecting portion 501 abuts against the lower face of the first groove 221 of the base portion 220 by the force by which the first delivery stacker 500 is pivoted in the counterclockwise direction as described above. In addition, in accordance with the movement of the first delivery stacker 500, the delivery frame portion 800 is further moved to the upstream side in the transport direction.

As shown in FIG. 17, as the pinion 219 is further rotated from the state shown in FIG. 18 in the counterclockwise direction, the pinion 219 tries to move to the downstream side in the transport direction along the fifth groove 226. That is, the pinion 219 tries to move the first delivery stacker 500 to the upstream side in the transport direction through the rack 227 in cooperation with the urging force of the first spring 921. Thus, while the first delivery stacker 500 is guided by the engagement of the first projecting portion 501 and the first groove 221 and also guide by the engagement of the pinion 219 and the rack 227, the first delivery stacker 500 is moved to the upstream side in the transport direction. That is, the attitude of the first delivery stacker 500 is restricted by the engagement of the first projecting portion 501 and the first groove 221 and the engagement of the pinion 219 and the rack 227. That is, the first delivery stacker 500 is moved to the upstream side while the attitude of the first delivery stacker 500 is maintained such that the upstream side of the first delivery stacker 500 in the transport direction is lowered and the downstream side thereof is lifted. In addition, in accordance with the movement of the first delivery stacker 500, the delivery frame portion 800 is guided by the engagement of the third projecting portion 801 and the third groove 224 and the engagement of the fourth projecting portion 802 and the fourth groove 225 and then moved to the upstream side in the transport direction and downward.

As shown in FIG. 16, as the pinion 219 is further rotated from the state shown in FIG. 17 in the counterclockwise direction, the first delivery stacker 500 is moved to the upstream side while the attitude of the first delivery stacker 500 is maintained such that the upstream side of the first delivery stacker 500 in the transport direction is lowered and the downstream side thereof is lifted, and while the first delivery stacker 500 is being guided by the engagement of the first projecting portion 501 and the first groove 221 and the engagement of the pinion 219 and the rack 227. In addition, in accordance with the movement of the first delivery stacker 500, the delivery frame portion 800 is moved and the lower portions of the first delivery driven rollers 20*b* of the delivery frame portion 800 contact the upper portion of the base portion side delivery drive roller 20*a*. At this time, the third projecting portion 801 and fourth projecting portion 802 of the delivery frame portion 800 respectively abut against the upstream ends of the third groove 224 and fourth groove 225 of the base portion 220 in the transport direction, so that the delivery frame portion 800 stops. Furthermore, because the position of the delivery frame portion 800 is a position that is taken by the delivery frame portion 800 when the first delivery stacker 500 is located at the first position, the urging force of the first spring 921 is not applied to the delivery frame portion 800. Thus, the urging force of the first spring 921 is also not applied to the first delivery stacker 500.

As shown in FIG. 15, as the pinion 219 is further rotated from the state shown in FIG. 16 in the counterclockwise direction, the first delivery stacker 500 is moved to the upstream side in the transport direction. At this time, the second projecting portion 701 of the coupling arm portion 700 leaves the upstream end of the second groove 223 of the first delivery stacker 500 in the transport direction. Here, the first delivery stacker 500 is configured so that the first delivery stacker 500 is moved to the upstream side in the transport direction to a position at which the downstream end of the first delivery stacker 500 in the transport direction is located upstream than the upstream end of the second delivery stacker 600.

As shown in FIG. 14, as the pinion 219 is further rotated from the state shown in FIG. 15 in the counterclockwise direction, the first delivery stacker 500 is moved to the upstream side in the transport direction. At this time, the second projecting portion 701 of the coupling arm portion 700 is moved to the downstream side of the second groove 223 of the first delivery stacker 500 in the transport direction and then contacts the downstream end of the second groove 223. After that, when the first delivery stacker 500 is further moved to the upstream side in the transport direction, the slider portion 550 is then restricted by the second projecting portion 701. Thus, with respect to the first delivery stacker 500, the slider portion 550 leaves the upstream end 540*a* of the slider guide groove 540 in the transport direction and gradually moves to the downstream side in the transport direction within the slider guide groove 540.

At this time, because the length of the second spring 922 is gradually expanded, the urging force of the second spring 922 gradually increases. Then, the increased urging force of the second spring 922 is applied through the coupling arm portion 700 to the delivery frame portion 800 toward the upstream side.

As shown in FIG. 13, as the pinion 219 is further rotated from the state shown in FIG. 14 in the counterclockwise direction, the first delivery stacker 500 is further moved to the upstream side in the transport direction. At this time, because the slider portion 550 is restricted by the second projecting portion 701, the slider portion 550 is further moved within the slider guide groove 540 to the downstream side in the transport direction with respect to the first delivery stacker 500. Thus, the urging force of the second spring 922 applied to the delivery frame portion 800 further increases.

As shown in FIG. 12, as the pinion 219 is further rotated from the state shown in FIG. 13 in the clockwise direction, the pinion 219 tries to move upward along the fifth groove 226. That is, the pinion 219 tries to move the first delivery stacker 500 downward through the rack 227. Thus, the first delivery stacker 500 is pivoted in the clockwise direction about the first projecting portion 501 so that the downstream end of the first delivery stacker 500 in the transport direction is lowered to decrease a difference in level between the upstream end and the downstream end. At this time, the slider portion 550 is located maximally adjacent to the downstream end of the slider guide groove 540. That is, the expansion of the second spring 922 becomes maximum. Thus, the urging force of the second spring 922, which is applied to the delivery frame portion 800, becomes maximum. As a result, when the position is moved from the second position to the first position, it is possible to reliably move the delivery frame portion 800 to the position where it should be.

As shown in FIG. 11, as the pinion 219 is further rotated from the state shown in FIG. 12 in the counterclockwise direction, the first delivery stacker 500 is pivoted about the first projecting portion 501 in the clockwise direction so that the downstream end of the first delivery stacker 500 in the transport direction is lowered to decrease a difference in level between the upstream end and the downstream end. At this time, the slider portion 550 is gradually moved to the upstream side of the slider guide groove 540 in the transport direction. Thus, the urging force of the second spring 922, which is applied to the delivery frame portion 800, gradually reduces. In addition, the first sensor contact portion 543 contacts the upper side of the protrusion 231 of the position sensor 230 and then pivots the protrusion 231 downward. Thus, the position sensor 230 enters an ON state.

As shown in FIG. 10, as the pinion 219 is further rotated from the state shown in FIG. 11 in the counterclockwise direction, the first delivery stacker 500 is pivoted about the first projecting portion 501 in the clockwise direction so that the downstream end of the first delivery stacker 500 in the transport direction is lowered to decrease a difference in level between the upstream end and the downstream end. At this time, the first delivery stacker 500 abuts against part of the base portion 220, so that driving of the first motor 901 is stopped to stop the rotation of the pinion 219. Thus, the first delivery stacker 500 is located at the first position with high accuracy.

In addition, the first sensor contact portion 543 further pivots the protrusion 231 of the position sensor 230 downward, and then reliably makes the position sensor 230 enter an ON state. At this time, because the first motor 901 is switched from the high-speed driving to the low-speed driving, it is possible to determine the stop position of the first delivery stacker 500 with high accuracy.

Accordingly, the delivery stacker elevating unit 200, without contacting the second delivery stacker 600, is able to move the upstream side of the first delivery stacker 500 downward and to the upstream side of the delivery stacker elevating unit 200 and then to move the downstream side of the first delivery stacker 500 so as to be pushed downward of the delivery stacker elevating unit 200. That is, the delivery stacker elevating unit 200, when the first delivery stacker 500 is moved from the second position to the first position, is able to move the first delivery stacker 500 even when the upper space of the first mount portion 510 of the first delivery stacker 500 and the upper space of the second mount portion 610 of the second delivery stacker 600 are, for example, limited by the bar guide 431, or the like.

In addition, when the first delivery stacker 500 is moved from the second position to the first position, the delivery drive roller **20*a* is driven in forward rotation. The driving in forward rotation means a rotation in the clockwise direction in FIG. 10 to FIG. 24. Thus, even when the CD-R tray Q is pinched by the delivery drive roller 20*a* and the second delivery driven rollers 503, that is, even when the CD-R tray Q is not normally delivered after recording, the delivery drive roller 20*a* and the second delivery driven rollers 503 are able to cooperate to move the CD-R tray Q to the downstream side in the transport direction. Then, the CD-R tray Q is placed in a state where it is not nipped by the delivery drive roller 20*a* and the second delivery driven rollers 503. As a result, because the first delivery stacker 500 is moved to the first position in a state where the CD-R tray Q is not nipped by the delivery drive roller 20*a* and the second delivery driven rollers 503, there is no possibility that breakage of the CD-R tray Q occurs. Furthermore, when the first delivery stacker 500 is moved from the second position to the first position, there is no possibility that the delivery drive roller 20*a* and the second delivery driven rollers 503 erroneously catch the CD-R tray Q therebetween. It is effective when a user has left the CD-R tray Q in the CD-R tray guide opening portion of the first delivery stacker 500**.

Moreover, because not all the delivery stacker 50 but only the first delivery stacker 500 is moved, the total weight of members to be moved is small as compared to the case where all the delivery stacker 50 is moved. Thus, it is possible to reduce the size of a power source by that much.

Open/Close of Second Delivery Stacker

Figure 25:
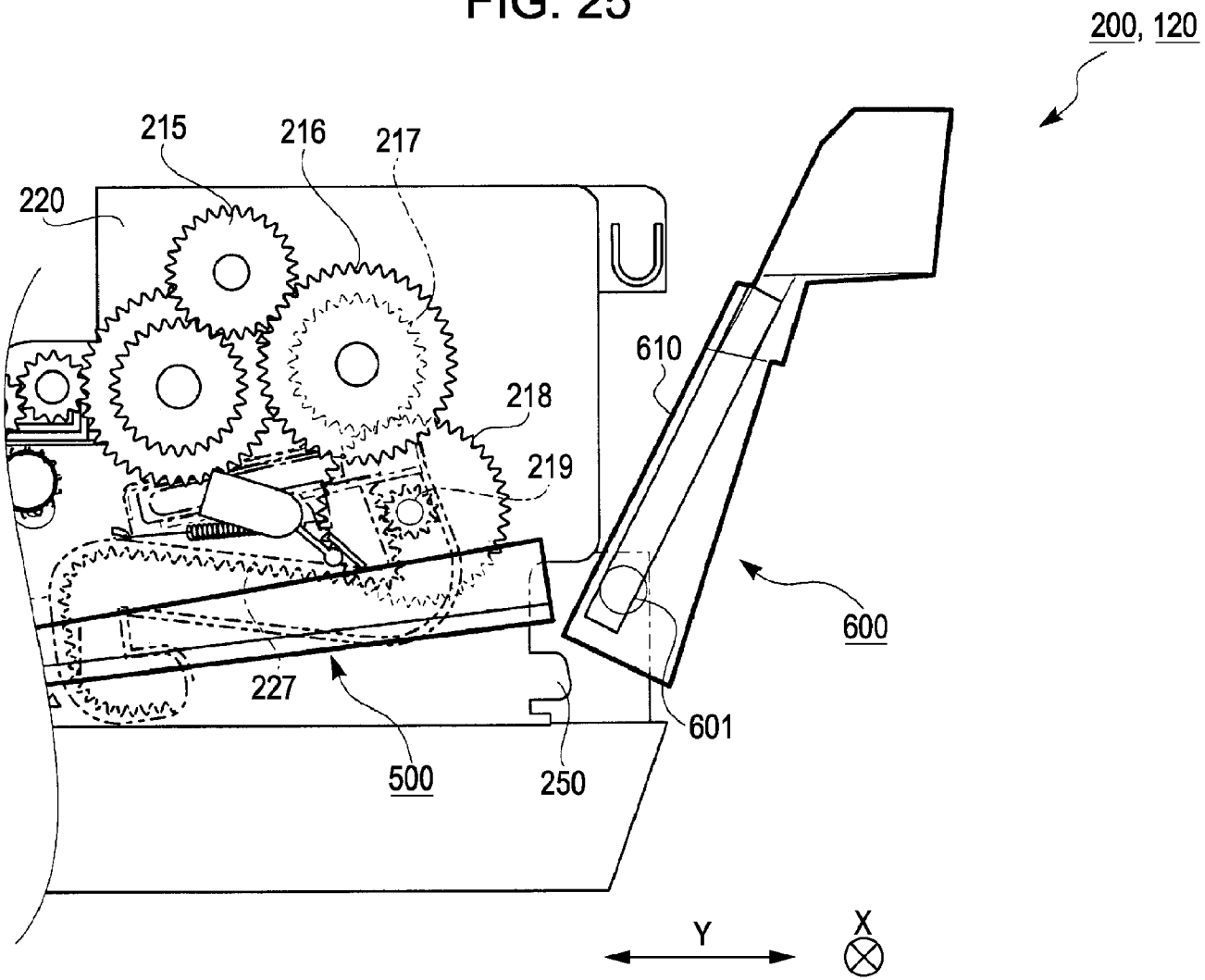
FIG. 25 is a side view, with partially cut away, that shows open/close of a second delivery stacker according to the embodiment of the invention (closed state).
Figure 26:
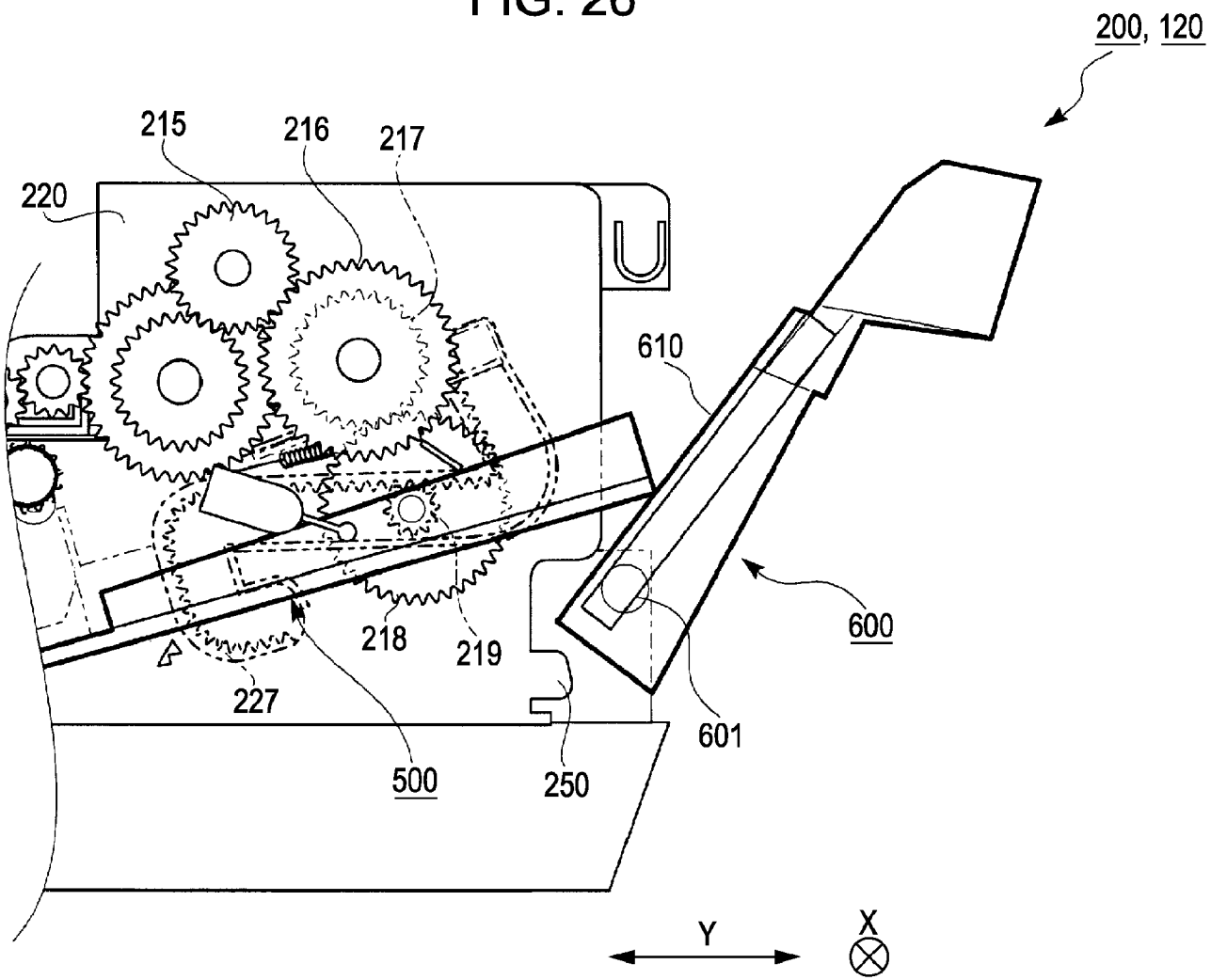
FIG. 26 is a side view, with partially cut away, that shows open/close of the second delivery stacker according to the embodiment of the invention.
Figure 27:
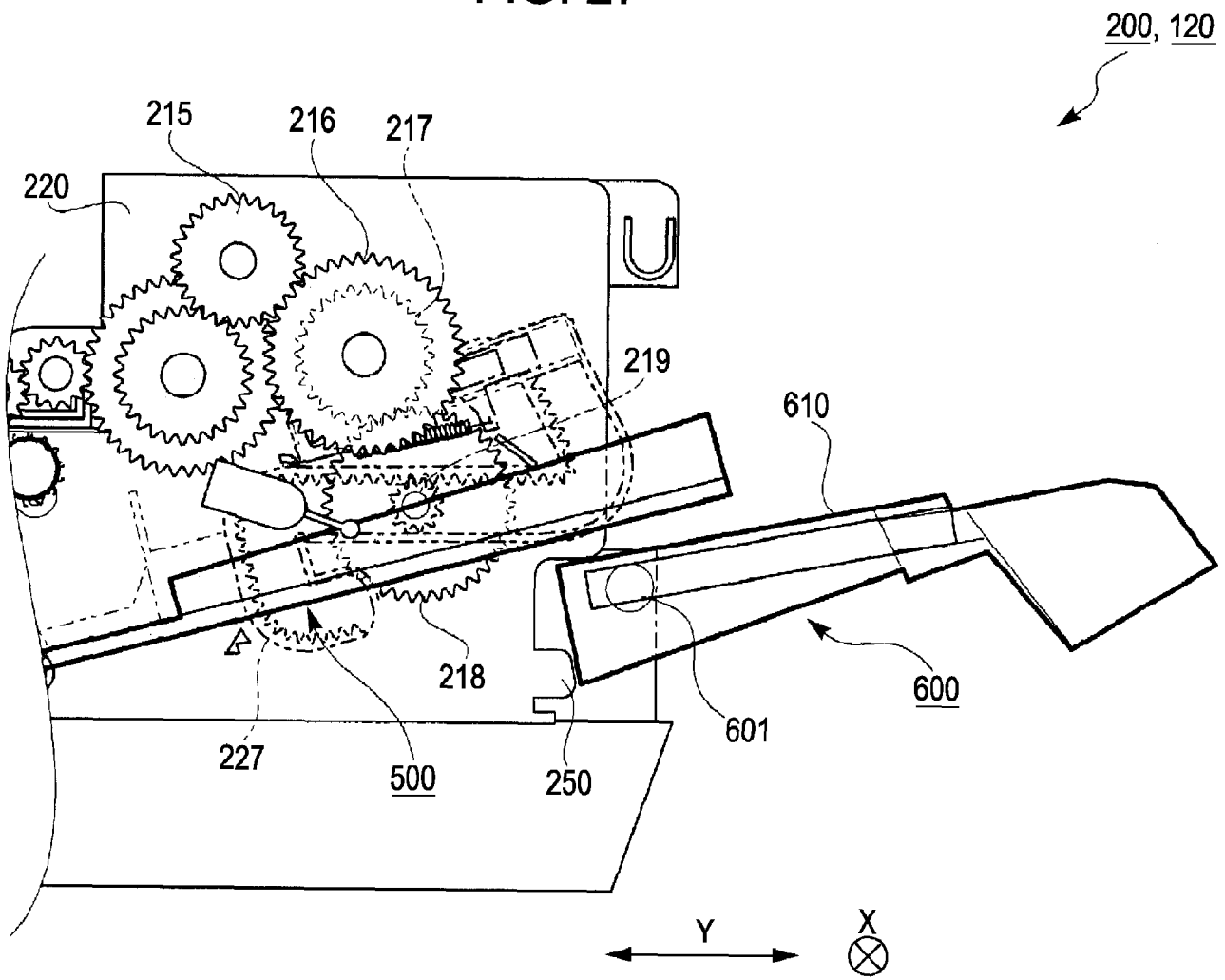
FIG. 27 is a side view, with partially cut away, that shows open/close of the second delivery stacker according to the embodiment of the invention (opened state).

FIG. 25 to FIG. 27 are side views that show open/close of the second delivery stacker according to the embodiment of the invention. FIG. 25 is a view that shows a state where the second delivery stacker is closed. FIG. 26 is a view that shows a state where the second delivery stacker is opening. FIG. 27 is a view that shows a state where the second delivery stacker is opened.

As shown in FIG. 25, when the power is off, the first delivery stacker 500 is located in the first position, and the second delivery stacker 600 is in a state where the mount opening portion 260 is closed. The second delivery stacker 600 is configured to be able to hold a closed state by a lock lever (not shown) being urged by a spring force. Then, as the power is turned on and then the CD-R recording mode is selected, the first delivery stacker 500 is moved from the first position to the second position, as described above.

As shown in FIG. 26, when the first delivery stacker 500 is moved from the first position to the second position, the first delivery stacker 500 is moved upward and then moved to the downstream direction in the transport direction. At this time, the downstream end of the first delivery stacker 500 in the transport direction contacts and presses a portion of the second mount portion 610 adjacent to the distal end than the cover shaft 601 of the second delivery stacker 600. Thus, the second delivery stacker 600 is pivoted about the cover shaft 601 in the clockwise direction in the drawing.

As shown in FIG. 27, as the second delivery stacker 600 is pressed by the first delivery stacker 500 to pivot in the clockwise direction to a certain extent, the second delivery stacker 600 continues to slowly pivot by its own weight and a damper (not shown) against the own weight. Then, the second delivery stacker 600 contacts the cover restricting portion 250 of the base portion 220 to stop. That is, when the CD-R recording mode is selected, the second delivery stacker 600, even when in a closed state, automatically opens. Accordingly, when the CD-R recording mode is selected, it is not necessary for a user to manually open the closed second delivery stacker 600 in order to set the CD-R tray Q on the CD-R tray guide opening portion 522 of the first delivery stacker 500. Note that, needless to say, a user may open/close the second delivery stacker manually.

CD-R Recording Mode

Figure 28:
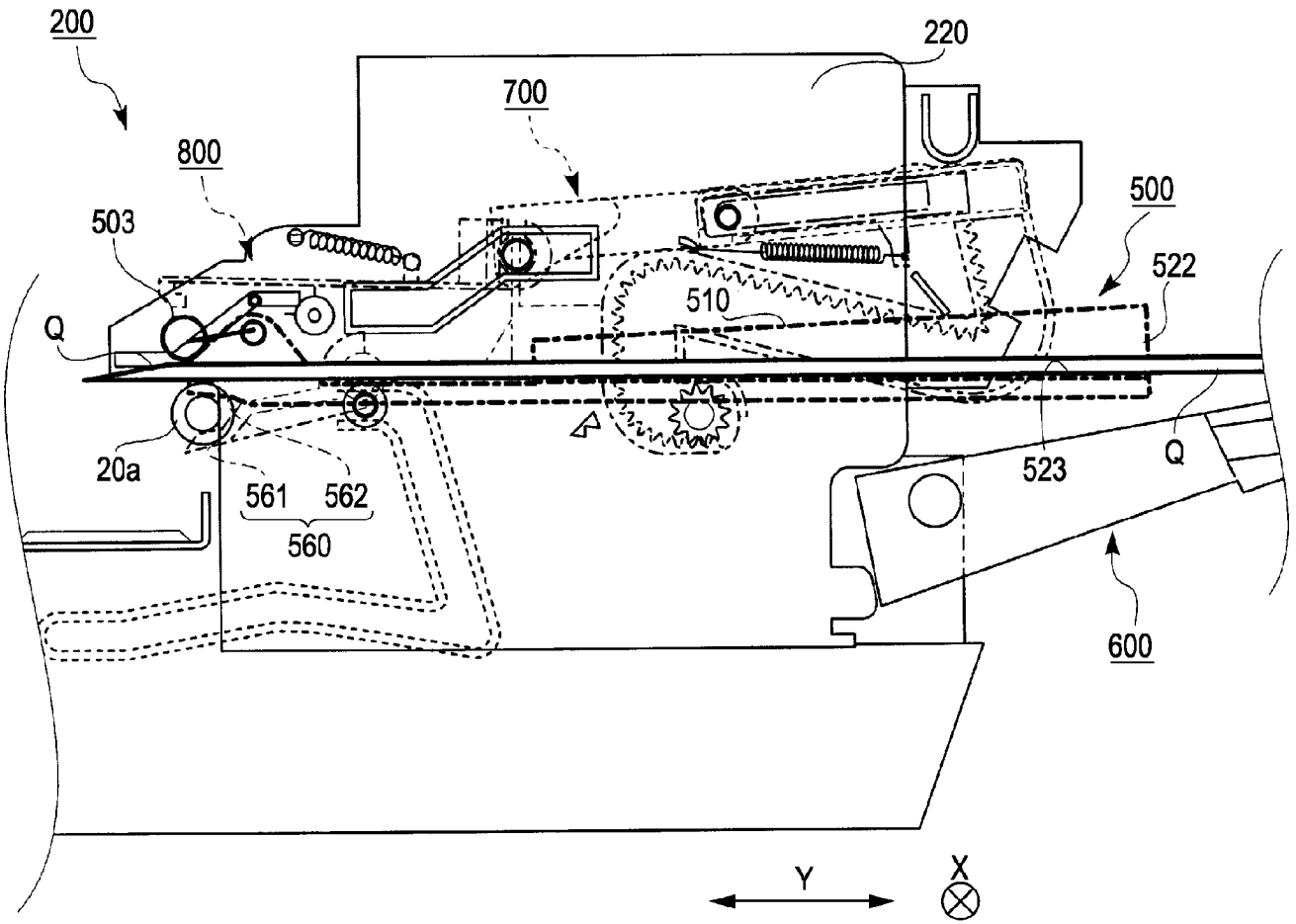
FIG. 28 is a side view, with partially cut away, that shows the second position of the first delivery stacker according to the embodiment of the invention.

FIG. 28 is a schematic side view that shows the second position of the first delivery stacker according to the embodiment of the invention. In addition, FIG. 28 is also a schematic side view of the state shown in FIG. 6. As shown in FIG. 28, when the first delivery stacker 500 is located at the second position, the CD-R tray Q is inserted through the CD-R tray guide opening portion 522 along the CD-R tray guide face 523. Then, when the CD-R tray Q is set at the set position shown in FIG. 6, as shown in FIG. 28, the upstream end of the CD-R tray Q in the transport direction is pinched by the delivery drive roller 20*a* and the second delivery driven rollers 503.

At this time, the position and attitude of the first delivery stacker 500 are determined by the position restricting device 560 with high accuracy. Thus, the CD-R tray Q is reliably held by the delivery drive roller 20*a* and the second delivery driven rollers 503.

After that, by driving the delivery drive roller 20*a* in reverse rotation, the CD-R tray Q is sent to the upstream side in the transport direction. Then, the downstream end of the transport direction of the CD-R attached to the CD-R tray Q stops at a position opposed to the recording head 13, that is, a so-called recording start position. After that, the recording head 13 scans in the horizontal scanning direction X while the CD-R tray Q is moved to the downstream side in the transport direction by driving the delivery drive roller 20*a* in forward rotation, thus performing recording on the label of the CD-R. Then, as the recording is completed, the delivery drive roller 20*a* and the second delivery driven rollers 503 cooperate to deliver the CD-R tray Q to the downstream side in the transport direction.

At this time, because the upstream end of the CD-R tray Q in the transport direction is released from the nipping by the delivery drive roller 20*a* and the second delivery driven rollers 503, the CD-R tray Q, as shown in FIG. 6, stops at a position which is further projected from the position, shown in FIG. 6, where part of the CD-R tray Q is projected from the CD-R tray guide opening portion 522. Note that, instead of the CD-R tray, a sheet of paper may also be manually set on the CD-R tray guide opening portion of the first delivery stacker.

Control of First Delivery Stacker

Figure 29:
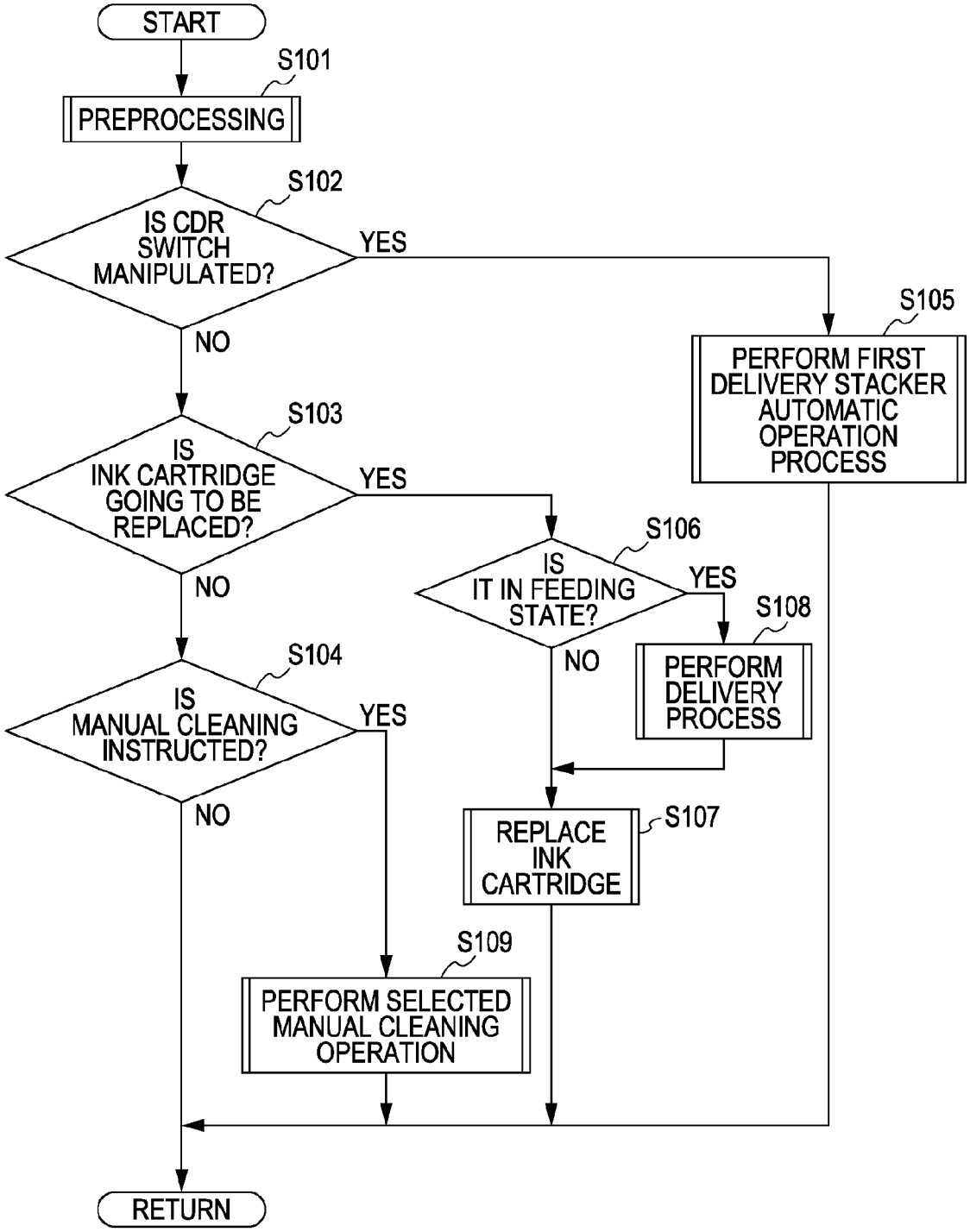
FIG. 29 is a flowchart that shows the control of the first delivery stacker according to the embodiment of the invention.
Figure 30:
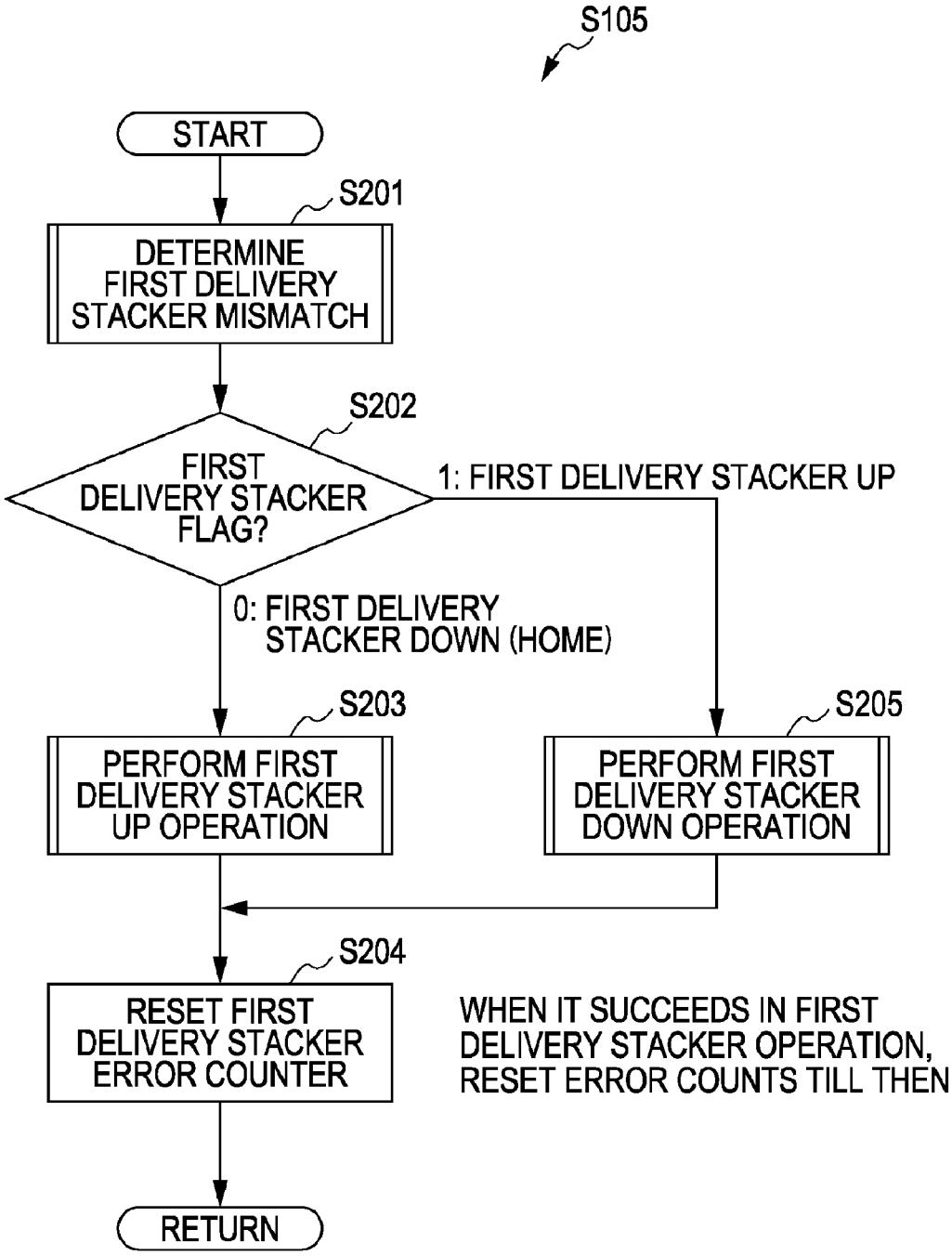
FIG. 30 is a flowchart that shows a first delivery stacker automatic operation process according to the embodiment of the invention.
Figure 31:
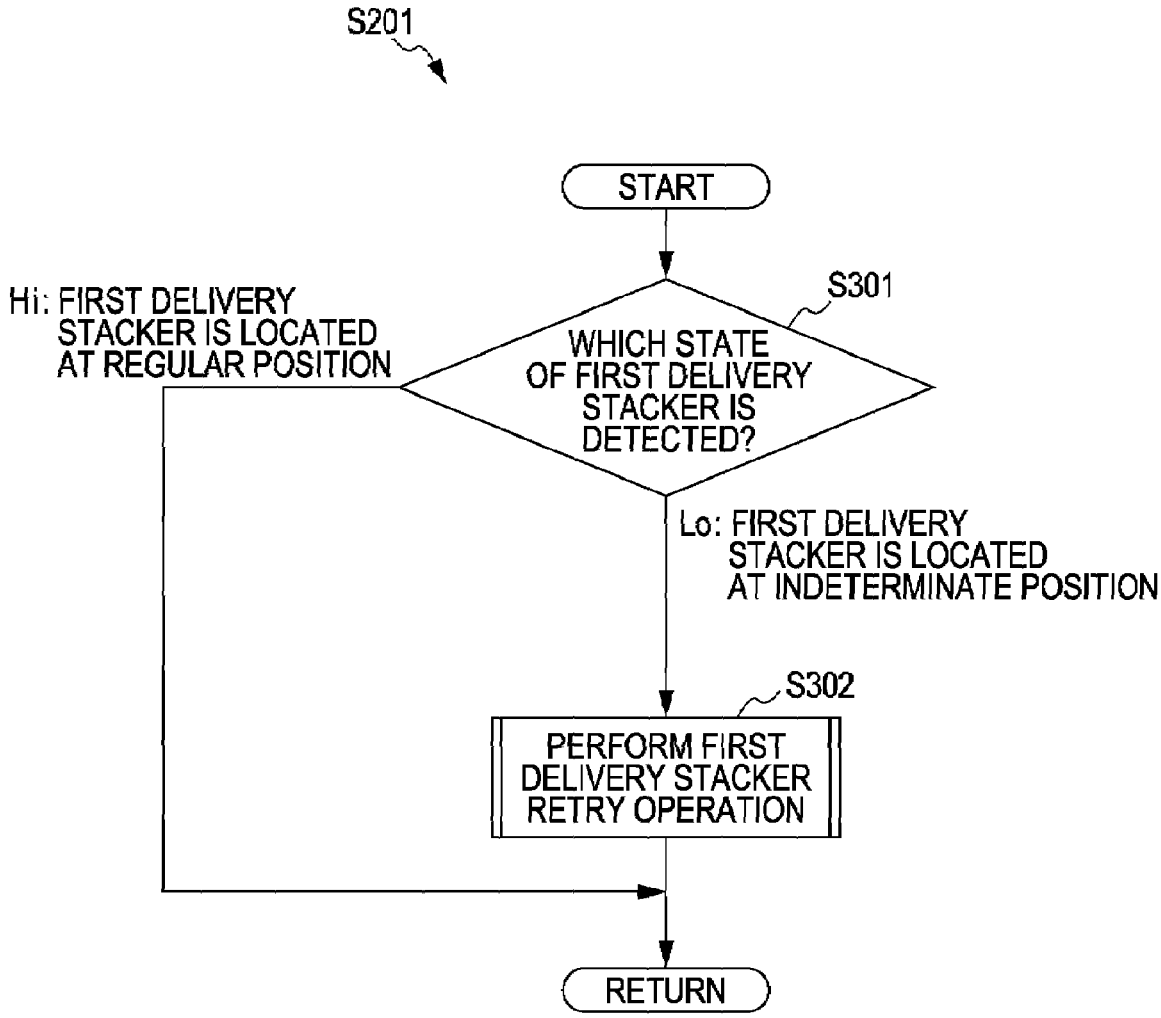
FIG. 31 is a flowchart that shows a method of determining mismatch according to the embodiment of the invention.
Figures 32, 32A:
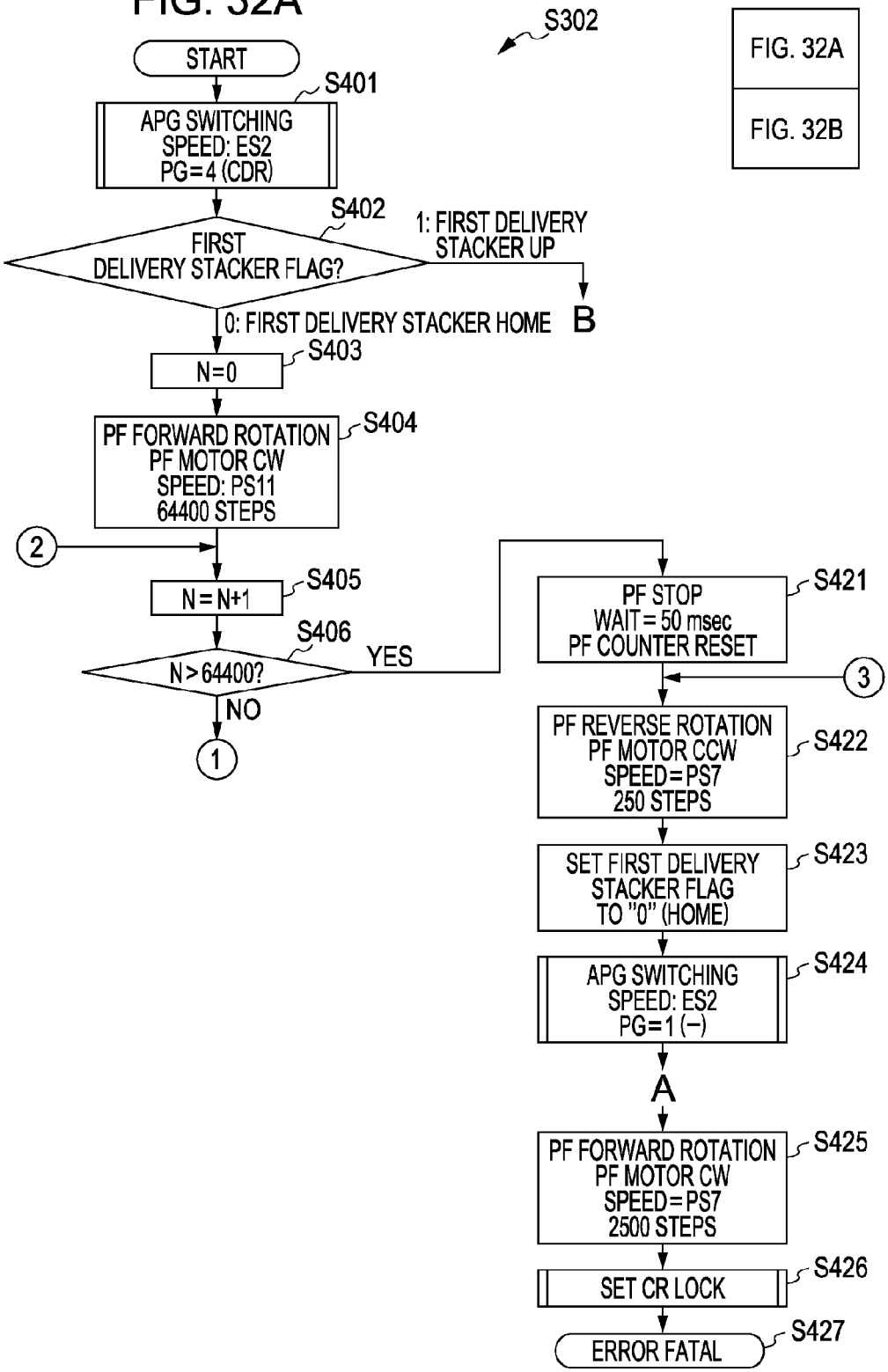
FIG. 32 is a flowchart that shows a first delivery stacker retry operation (DOWN) according to the embodiment of the invention.
Figure 32B:
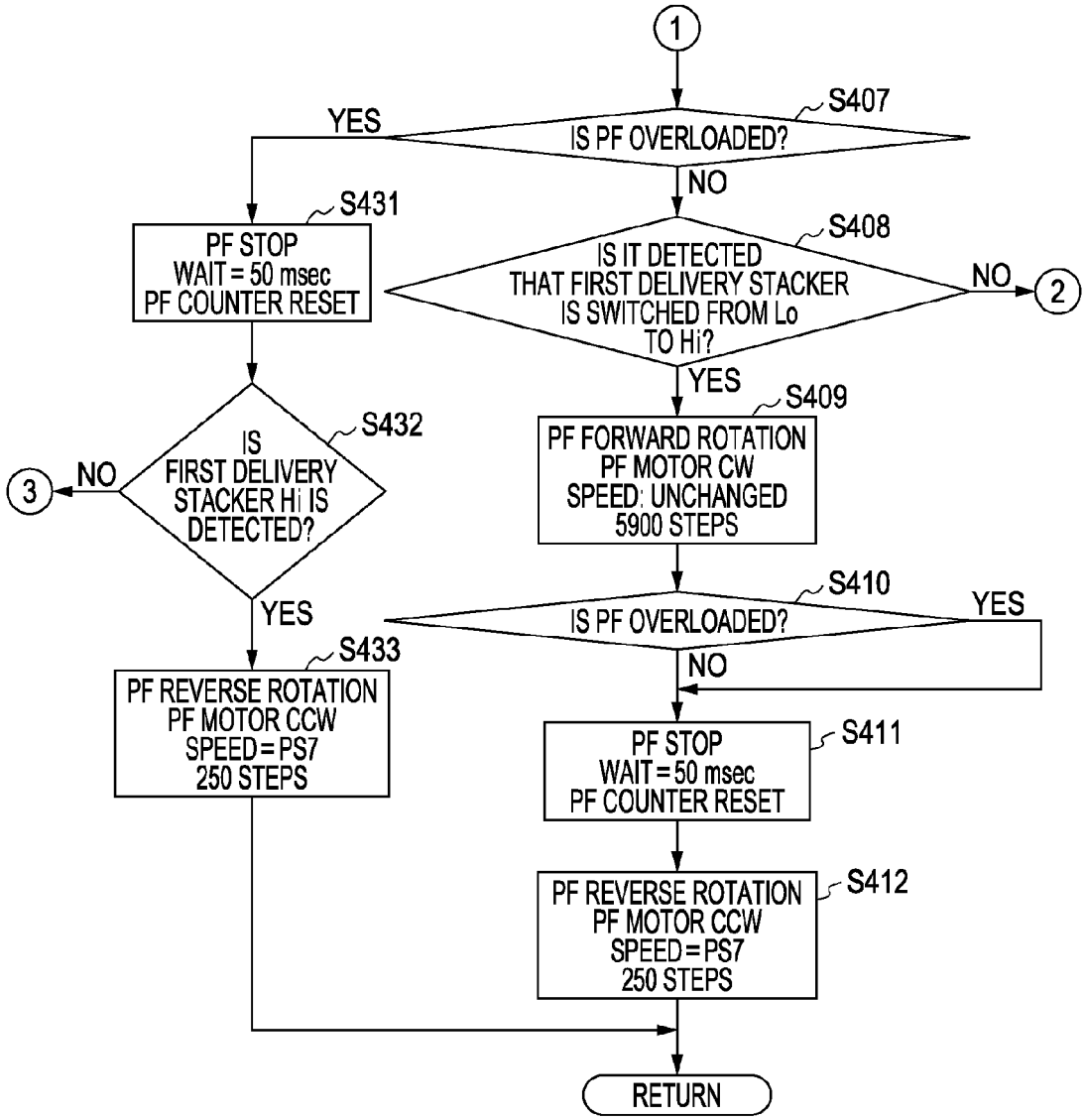
Figure 33:
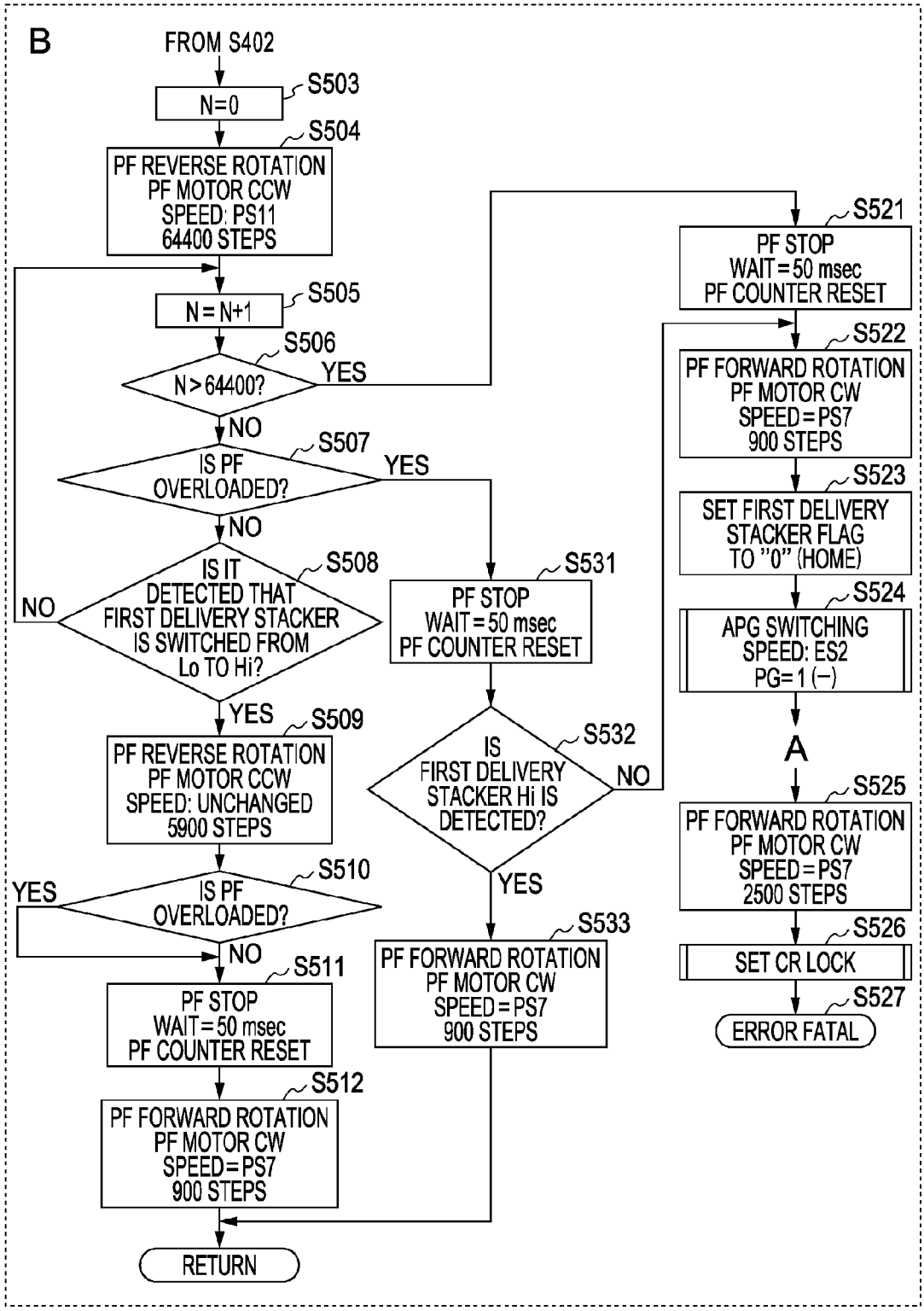
FIG. 33 is a flowchart that shows a first delivery stacker retry operation (UP) according to the embodiment of the invention.
Figure 34:
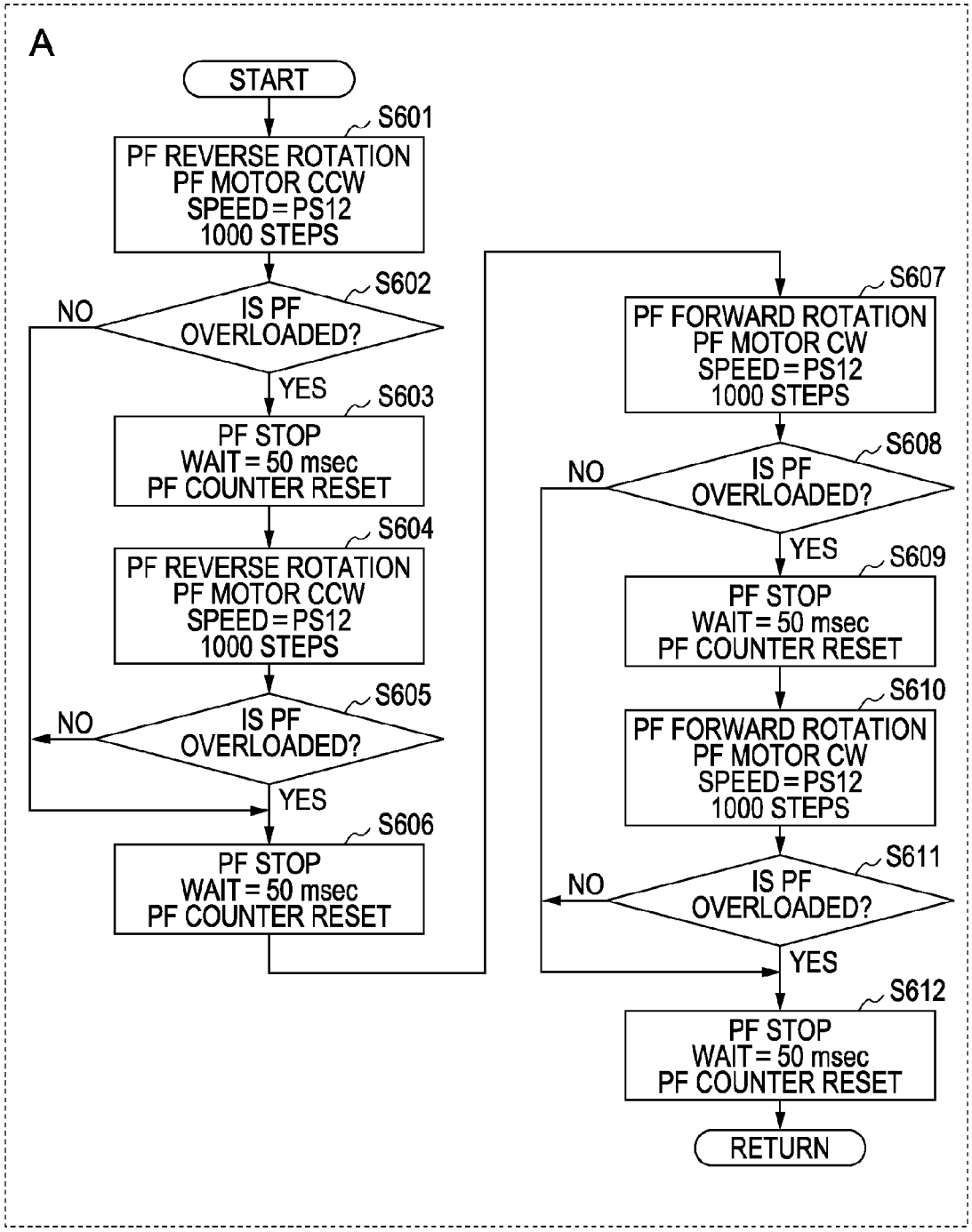
FIG. 34 is a flowchart that shows a common operation when power transmission of a power transmitting unit is interrupted.
Figure 35A:
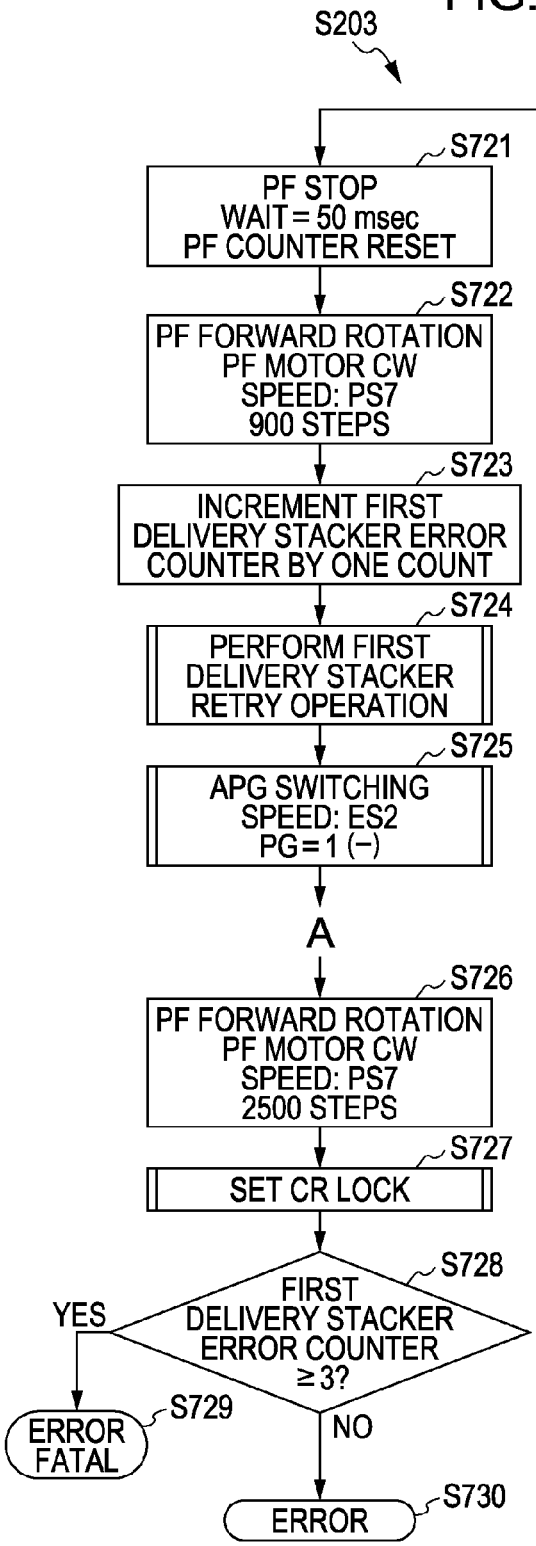
FIG. 35 is a flowchart that shows a first delivery stacker UP operation according to the embodiment of the invention.
Figure 35:
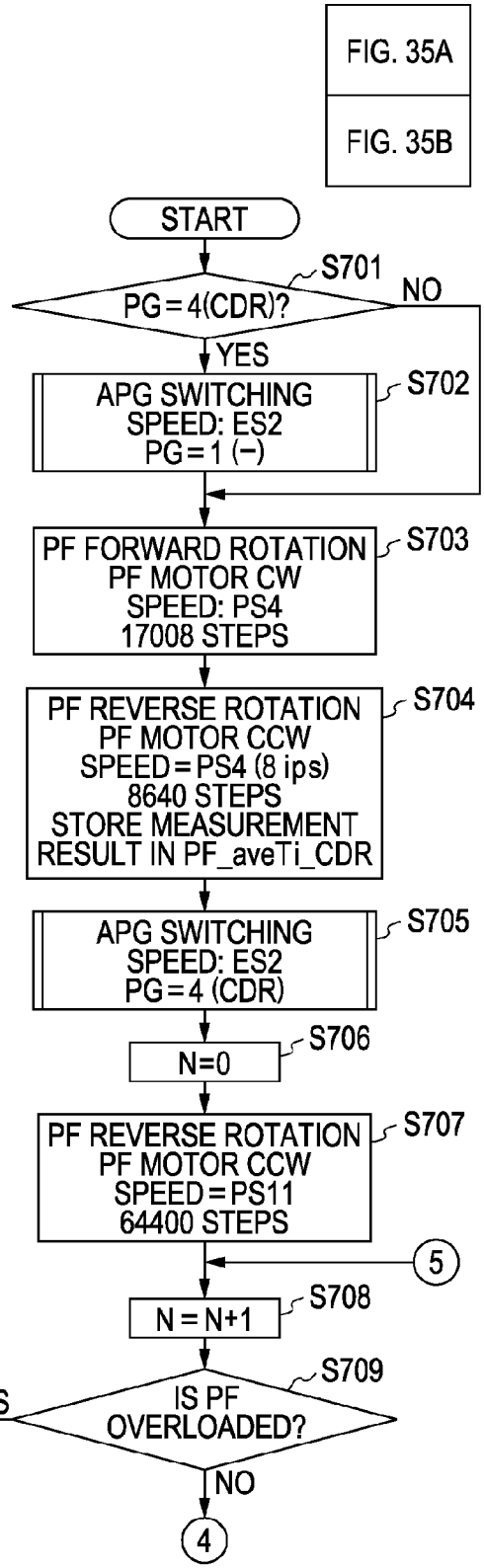
Figure 35B:
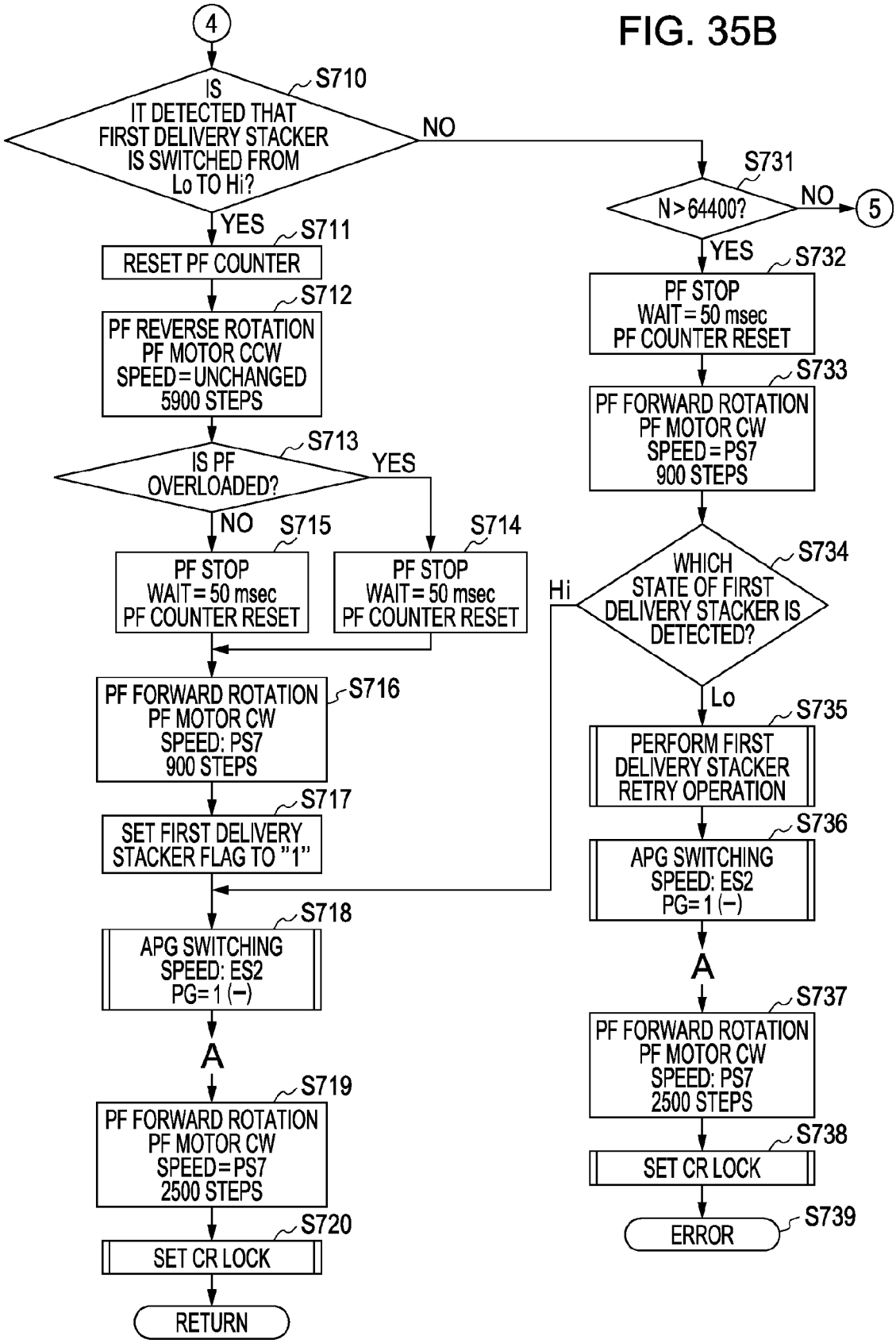
Figure 36A:
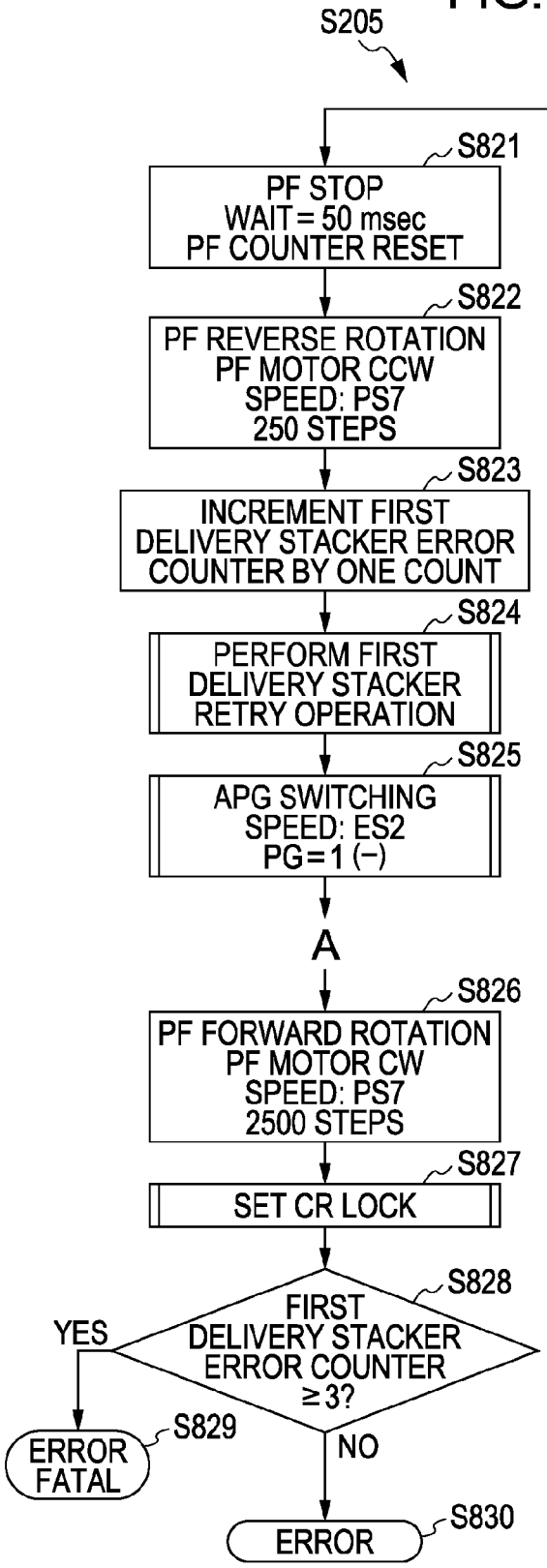
FIG. 36 is a flowchart that shows a first delivery stacker DOWN operation according to the embodiment of the invention.
Figure 36:
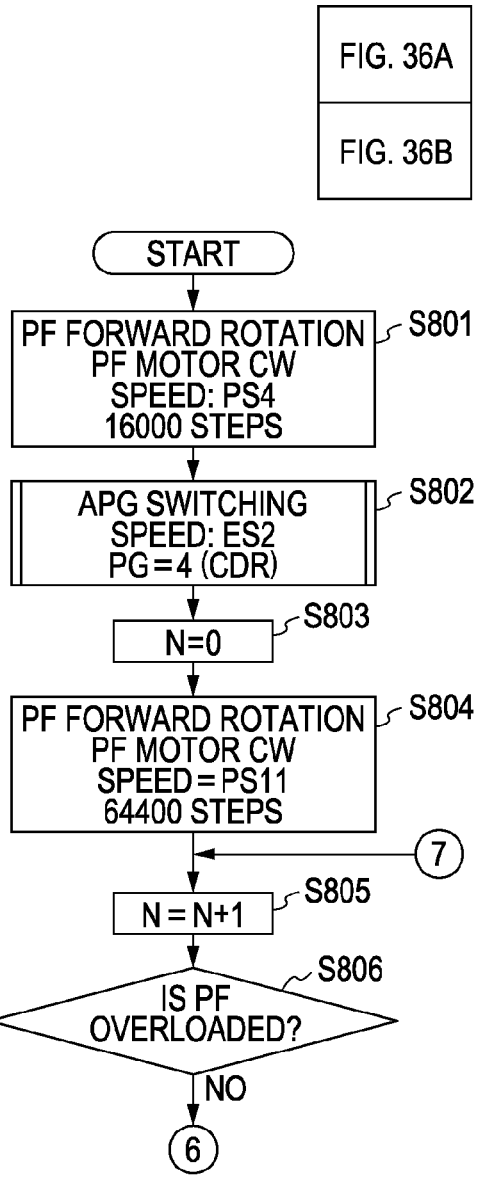
Figure 36B:
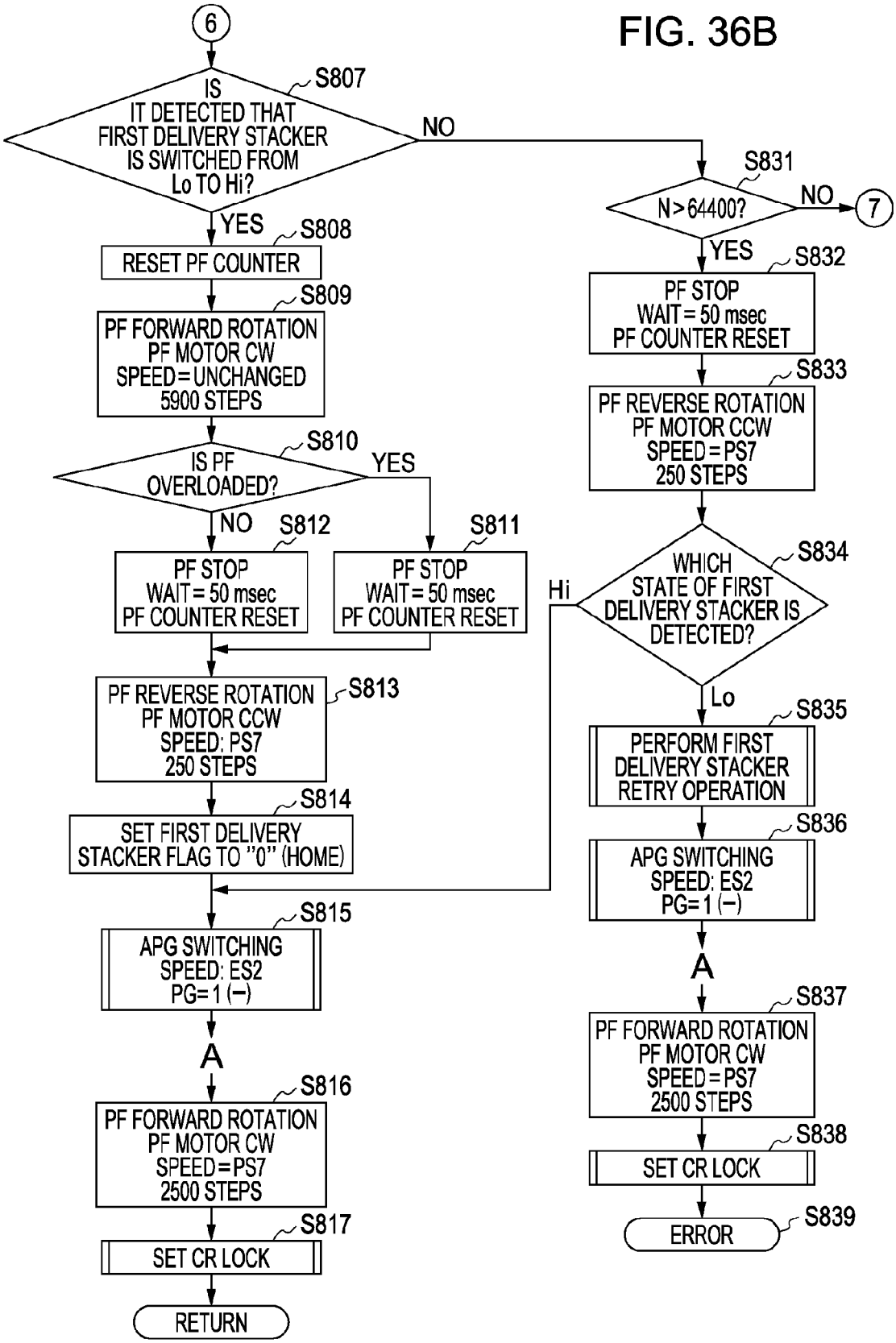

FIG. 29 is a flowchart that shows the control of the first delivery stacker according to the embodiment of the invention. FIG. 30 is a flowchart that shows a first delivery stacker automatic operation process according to the embodiment of the invention. FIG. 31 is a flowchart that shows a method of determining mismatch according to the embodiment of the invention. FIG. 32 and FIG. 33 are flowcharts that show a first delivery stacker retry operation according to the embodiment of the invention. Of these drawings, FIG. 32 is a flowchart that shows the movement from the second position side to the first position side. On the other hand, FIG. 33 is a flowchart that shows the movement from the first position side to the second position side. In addition, FIG. 34 is a flowchart that shows a common operation when power transmission of the power transmitting unit is interrupted. Moreover, FIG. 35 and FIG. 36 are flowcharts that show the movement of the first delivery stacker according to the embodiment of the invention. FIG. 35 relates to the movement from the first position to the second position, while, on the other hand, FIG. 36 relates to the movement from the second position to the first position.

Note that the details of step (hereinafter, simply referred to as "S") 105 shown in FIG. 29 are shown in FIG. 30. In addition, the details of S201 shown in FIG. 30 are shown in FIG. 31. Similarly, the details of S203 are shown in FIG. 35 and the details of S205 are shown in FIG. 36. Furthermore, the details of S302 shown in FIG. 31 are shown in FIG. 32 and FIG. 33. Moreover, the details of "A" shown in FIG. 32, FIG. 33, FIG. 35 and FIG. 36 are shown in FIG. 34.

User Operation Process

Firstly, a user operation process will be described. As shown in FIG. 29, in S101, a preprocessing is executed. Specifically, when a predetermined condition is satisfied on the basis of information input to the control unit 900, locking of the carriage 10 is released. Then, the process proceeds to the next step. In S102, it is determined whether the CDR switch is manipulated or not. Specifically, the control unit 900 determines whether a user has manipulated a command button for moving the first delivery stacker 500 among the operation buttons 8 on the front face panel 6. When it is determined that the manipulation has been made, the process proceeds to S105. On the other hand, when it is determined that the manipulation is not made, the process proceeds to S103.

In S103, it is determined whether the ink cartridge C is going to be replaced. When the control unit 900 determines that the ink cartridge C is going to be replaced, the process proceeds to S106. On the other hand, when it is determined that the ink cartridge C is not going to be replaced, the process proceeds to S104. In S104, it is determined whether execution of manual cleaning is instructed or not. When the control unit 900 determines that the above instruction is issued, the process proceeds to S109. On the other hand, when the above instruction is not issued, the operation process ends.

In S105, the first delivery stacker automatic operation process is performed. Specific description will be made later with reference to FIG. 30. Then, after the above process has been performed, the operation process ends. In S106, it is determined whether feeding is performed or not. Specifically, the control unit 900 determines whether the recording apparatus 100 is in a feeding state at that moment. When it is determined that the recording apparatus 100 is in a feeding state, the process proceeds to S108. On the other hand, when it is determined that the recording apparatus 100 is not in a feeding state, the process proceeds to S107. Here, "feeding state" indicates a state where a feeding process is successfully completed but a delivery process is not completed. Note that "feeding state" also includes a state where a recording process is being performed.

In S107, replacement of the cartridge is performed. Specifically, a used ink cartridge C is removed, and a new ink cartridge C is loaded in the recording apparatus 100. Then, the operation process ends. In S108, a delivery process is performed. Specifically, a sheet of paper, or the like, is delivered by driving the delivery drive roller 20*a*. Then, the process proceeds to S107.

Here, "delivery process" does not mean data ejection. In addition, when two-sided recording is performed, it is defined in the delivery process that no next page, and DUP: rear face. Taking the opportunity of this routine, in DUP, when the rear face of that page is passed through without reading and replacement of ink is normally completed, recording starts from the front face of the next page. In S109, selected manual cleaning operation is performed. Specifically, depending on the situation, a cleaning operation selected by a user among predetermined operations that are prepared in advance is performed. Then, the operation process ends.

First Delivery Stacker Automatic Operation Process

Next, the first delivery stacker automatic operation process will be described. As shown in FIG. 30, in S201, first delivery stacker mismatch determination is executed. As is described simply, the control unit 900 determines whether the position of the first delivery stacker 500, which is recognized by the control unit 900 using a first delivery stacker flag (a memory (register) in the control unit) (hereinafter, simply referred to as "flag") is accordant with the actual position of the first delivery stacker 500, which is sensed by the position sensor 230. A description will be made more specifically later with reference to FIG. 31. Then, the process proceeds to S202.

In S202, a state of the flag is determined. Specifically, when the flag is "1", it is determined that the first delivery stacker is in "UP", that is, the first delivery stacker 500 is located at the second position, and then the process proceeds to S205. On the other hand, when the flag is "0", it is determined that the first delivery stacker is in "HOME (DOWN)", that is, the first delivery stacker 500 is located at the first position, and then the process proceeds to S203. In S203, the first delivery stacker UP operation is performed. Specifically, the control unit 900 drives the first motor 901 to move the first delivery stacker 500 from the first position to the second position. A description will be made more specifically with reference to FIG. 35. Then, the process proceeds to S204.

In S204, a first delivery stacker error counter, which serves as a memory in the control unit, is reset. Specifically, when the operation of the first delivery stacker 500 (S203 and S205, which will be described later) is successfully completed, an error count till then is reset. Then, the first delivery stacker automatic operation process ends. In S205, the first delivery stacker DOWN operation is performed. Specifically, the control unit 900 drives the first motor 901 to move the first delivery stacker 500 from the second position to the first position. A description will be made more specifically later with reference to FIG. 36. Then, the process proceeds to S204.

First Delivery Stacker Mismatch Determination Process

Further, the first delivery stacker mismatch determination process will be described. As shown in FIG. 31, in S301, it is determined whether the first delivery stacker 500 is sensed or not. Specifically, when the protrusion 231 of the position sensor 230 contacts the first sensor contact portion 543 or the second sensor contact portion 544, each of which is provided in the first delivery stacker 500, the position sensor 230 enters an ON (Hi) state, and then it is determined whether the ON state is detected by the control unit 900 or not. When the position sensor 230 is in an ON (Hi) state, the first delivery stacker 500 is located at a regular position, that is, the first position or the second position. Then, the first delivery stacker mismatch determination process ends. On the other hand, when the position sensor 230 is in an OFF (Lo) state, the first delivery stacker 500 is located at an intermediate position between the first position and the second position. Then, the process proceeds to S302.

In S302, the first delivery stacker retry operation is performed. Specifically, the position of the first delivery stacker 500, which is recognized through the flag by the control unit 900, is made accordant with the actual position of the first delivery stacker 500 in such a manner that the first delivery stacker 500 is moved to the position of the first delivery stacker 500, at which the control unit 900 recognizes through determination by the flag. More specific description will be made later. Then, the first delivery stacker mismatch determination process ends.

First Delivery Stacker Retry Operation Process

Next, the first delivery stacker retry operation process will be described. The first delivery stacker retry operation is directed to determining the position of the first delivery stacker 500 through matching between the flag and the position sensor 230. Then, when mismatch is detected, the first delivery stacker 500 is moved to the regular position to correct the positional deviation. That is, the flag (a memory (register) in the control unit) is made accordant with the position sensor 230.

As shown in FIG. 32 and FIG. 33, in S401, APG Switching, Speed: ES2, and PG=4 (CDR) are executed. Specifically, the second motor 902 is driven at a speed of ES2 to pivot the PG adjustment cam portion 301 of the recording unit gap adjustment unit 300, and the power transmission state of the power transmission switching unit 400 is switched to a connected state. Then, the process proceeds to S402. In S402, a state of the flag is determined. Specifically, the control unit 900 recognizes, through a state of the flag, a position where the first delivery stacker 500 is located. When the flag is "0", it is determined that the first delivery stacker DOWN (HOME) that is, the first delivery stacker 500 should be located at the first position, and the process proceeds to S403. On the other hand, when the flag is "1", it is determined that the first delivery stacker UP, that is, the first delivery stacker 500 should be located at the second position, and the process proceeds to S503 (see FIG. 33).

In S403, it is set that N=0. That is, the counter that contains the number of steps of the first motor 901, which is a stepper motor, is reset. Then, the process proceeds to S404. In S404, PF forward rotation, PF motor CW, Speed: PS11, and 64400 steps are executed. Specifically, the control unit 900 sends instructions to the first motor 901 to be driven in forward rotation at a speed of PS11, that is, at a high speed, by 64400 steps. Then, the process proceeds to S405. Here, 64400 steps are steps required for moving the first delivery stacker 500 from the first position to the second position. In addition, as the numerical value increases, the driving speed of the motor also increases. In the present embodiment, PS11 and PS12 correspond to high speeds, and PS7 corresponds to a low speed.

In S405, N=N+1 is executed. That is, the number of steps is counted by means of the counter provided in the control unit 900. Then, the process proceeds to S406. In S406, it is determined whether N>64400 steps. That is, the control unit 900 determines whether the number of steps counted exceeds a predetermined number of steps (64400 steps). When it is determined that the number of steps counted exceeds 64400 steps, the process proceeds to S421. On the other hand, when it is determined that the number of steps counted does not exceed 64400 steps, the process proceeds to S407.

In S407, it is determined whether PF is overloaded or not. Specifically, the control unit 900 determines whether a load on the first motor 901 exceeds a predetermined value. When it is determined that a load on the first motor 901 exceeds a predetermined value, the process proceeds to S431. On the other hand, when it is determined that a load on the first motor 901 does not exceed a predetermined value, the process proceeds to S408. Here, when it is determined that the load exceeds a predetermined value, it is conceivable, for example, that, because the first delivery stacker 500 abuts against a base portion side member at a stable position, which may be the first position or the second position, a load on the first motor 901 exceeds a predetermined value. In addition, it is conceivable that, in an intermediate position between the first position and the second position, the first delivery stacker 500 abuts against an obstacle.

In S408, it is determined whether the position sensor 230 senses the first delivery stacker 500 and is then switched from an OFF (Lo) state to an ON (Hi) state. Then, when the control unit 900 determines that the position sensor 230 is not switched to an ON state, the process proceeds to S405. On the other hand, when it is determined that the position sensor 230 is switched to an ON state, the process proceeds to S409. In S409, PF forward rotation, PF motor CW, Speed: unchanged, and 5900 steps are executed. Specifically, the control unit 900 sends instructions to the first motor 901 to be driven in forward rotation by 5900 steps while maintaining the speed. Then, the process proceeds to S410.

In S410, it is determined whether PF is overloaded or not. When the control unit 900 determines that a load on the first motor 901 exceeds a predetermined value, the process proceeds to S411. On the other hand, when it is determined that a load on the first motor 901 does not exceed a predetermined value as well, the process proceeds to S411. In S411, PF stop, wait=50 msec, and PF counter reset are executed. Specifically, the control unit 900 stops the first motor 901 for 50 milliseconds, and resets the counter which has counted the number of steps of the first motor 901. Then, the process proceeds to S412. Here, the first motor 901 is desirably configured to stop by overloading in S410 or by driving a predetermined number of steps in S409.

In S412, PF reverse rotation, PF motor CCW, Speed: PS7, and 250 steps are executed. Specifically, the control unit 900 sends instructions to the first motor 901 to be driven in reverse rotation at a speed of PS7, that is, at a low speed by 250 steps. Then, the first delivery stacker retry operation process ends. In S421, PF stop, wait=50 msec, and PF counter reset are executed. Specifically, the control unit 900 stops the first motor 901 for 50 milliseconds, and resets the counter which has counted the number of steps of the first motor 901. Then, the process proceeds to S422.

In S422, PF reverse rotation, PF motor CCW, Speed: PS7, and 250 steps are executed. Specifically, the control unit 900 sends instructions to the first motor 901 to be driven in reverse rotation at a speed of PS7, that is, at a low speed by 250 steps. Then, the process proceeds to S423. In S423, setting the flag to "0" (HOME) is executed. Specifically, the control unit 900 updates the state of the flag to "0", that is, to the first position (HOME). In other words, the control unit 900 recognizes that the first delivery stacker 500 is located at the first position. Then, the process proceeds to S424.

In S424, APG Switching, Speed: ES2, and PG=1 (−) are executed. Specifically, the second motor 902 is driven at a speed of ES2 to pivot the PG adjustment cam portion 301 of the recording unit gap adjustment unit 300 and thereby to switch the power transmission state of the power transmission switching unit 400 to a disconnected state, and PG is switched to "−", that is, to the PG mode in which a relatively thin sheet of paper is recorded. Then, the process proceeds to the common operation process A (see FIG. 34). The common operation process A executes releasing contact pressure in order to reliably perform locking operation that restricts the attitude of the planetary gear holder portion 420 of the power transmission switching unit 400. The specific common operation process A will be described in detail later. Then, after the common operation process A, the process proceeds to S425.

In S425, PF forward rotation, PF motor CW, Speed: PS7, and 2500 steps are executed. Specifically, the control unit 900 sends instructions to the first motor 901 to be driven in forward rotation at a speed of PS7, that is, at a low speed by 2500 steps. Then, the process proceeds to S426. In S426, the carriage 10 is locked. When the first delivery stacker 500 is being moved, a carriage lock lever (not shown) that locks the carriage 10 by the operation of forward rotation/reverse rotation of the first motor 901 is configured to move in and out. Thus, when the movement of the first delivery stacker 500 is completed, the position of the carriage lock lever becomes indeterminate. Then, in S425, the first motor 901 is driven by the number of steps (2500 steps) that can release the locking of the carriage 10 to release the locking of the carriage 10. After that, in the same S426, the carriage 10 is locked, thus making it possible to regulate the position of the carriage lock lever. This is because, during so-called idling, locking the carriage 10 is a basic operation. Then, the process proceeds to S427.

In S427, the control unit 900 determines that it is abnormal and displays an error indication on the liquid crystal monitor screen 7 of the front face panel 6. For example, when the process proceeds to S427 after it is determined that the counter exceeds 64400 steps in S406, it is conceivable that power transmission of the power transmission switching unit 400 is not a normal state for some reasons. In S431, PF stop, wait=50 msec, and PF counter reset are executed. Specifically, the control unit 900 stops the first motor 901 for 50 milliseconds, and resets the counter which has counted the number of steps of the first motor 901. Then, the process proceeds to S432.

In S432, it is determined whether the position sensor 230 is in an ON (Hi) state where the position sensor 230 is sensing the first delivery stacker 500. That is, it is determined whether the first delivery stacker 500 is located at any one of the stable positions, that is, the first position and the second position or the first delivery stacker 500 is located at an intermediate position between the first position and the second position. Then, when the control unit 900 determines that the position sensor 230 is in an ON state, the process proceeds to S433. On the other hand, when it is determined that the position sensor 230 is not in an ON state, the process proceeds to S422.

In S433, PF reverse rotation, PF motor CCW, Speed: PS7, and 250 steps are executed. Specifically, the control unit 900 sends instructions to the first motor 901 to be driven in reverse rotation at a speed of PS7, that is, at a low speed by 250 steps. Then, the first delivery stacker retry operation process ends. Here, 250 steps are the number of steps by which, when the first delivery stacker 500 stops at the first position, the first delivery stacker 500 abuts against a base portion side member to stop and then moves from the stopped position to the original proper first position, which is a desired position.

As shown in FIG. 33, in S503, it is set that N=0. That is, the counter that contains the number of steps of the first motor 901, which is a stepper motor, is reset. Then, the process proceeds to S504. In S504, PF reverse rotation, PF motor CCW, Speed: PS11, and 64400 steps are executed. Specifically, the control unit 900 sends instructions to the first motor 901 to be driven in reverse rotation at a speed of PS11, that is, at a high speed, by 64400 steps. Then, the process proceeds to S505.

In S505, N=N+1 is executed. That is, the number of steps is counted by means of the counter provided in the control unit 900. Then, the process proceeds to S506. In S506, it is determined whether N>64400 steps. That is, the control unit 900 determines whether the number of steps counted exceeds a predetermined number of steps (64400 steps). When it is determined that the number of steps counted exceeds 64400 steps, the process proceeds to S521. On the other hand, when it is determined that the number of steps counted does not exceed 64400 steps, the process proceeds to S507.

In S507, it is determined whether PF is overloaded or not. Specifically, the control unit 900 determines whether a load on the first motor 901 exceeds a predetermined value. When it is determined that a load on the first motor 901 exceeds a predetermined value, the process proceeds to S531. On the other hand, when it is determined that a load on the first motor 901 does not exceed a predetermined value, the process proceeds to S508. In S508, it is determined whether the position sensor 230 has sensed the first delivery stacker 500 and then switched from an OFF (Lo) state to an ON (Hi) state. Then, when the control unit 900 determines that the position sensor 230 is not switched to an ON state, the process proceeds to S505. On the other hand, when it is determined that the position sensor 230 is switched to an ON state, the process proceeds to S509.

In S509, PF reverse rotation, PF motor CCW, Speed: unchanged, and 5900 steps are executed. Specifically, the control unit 900 sends instructions to the first motor 901 to be driven in reverse rotation by 5900 steps while maintaining the speed. Then, the process proceeds to S510. In S510, it is determined whether PF is overloaded or not. When the control unit 900 determines that a load on the first motor 901 exceeds a predetermined value, the process proceeds to S511. On the other hand, when it is determined that a load on the first motor 901 does not exceed a predetermined value as well, the process also proceeds to S511.

In S511, PF stop, wait=50 msec, and PF counter reset are executed. Specifically, the control unit 900 stops the first motor 901 for 50 milliseconds, and resets the counter which has counted the number of steps of the first motor 901. Then, the process proceeds to S512. Here, the first motor 901 is desirably configured to stop by overloading in S510 or by driving a predetermined number of steps in S509.

In S512, PF forward rotation, PF motor CW, Speed: PS7, and 250 steps are executed. Specifically, the control unit 900 sends instructions to the first motor 901 to be driven in forward rotation at a speed of PS7, that is, at a low speed by 250 steps. Then, the first delivery stacker retry operation process ends. In S521, PF stop, wait=50 msec, and PF counter reset are executed. Specifically, the control unit 900 stops the first motor 901 for 50 milliseconds, and resets the counter which has counted the number of steps of the first motor 901. Then, the process proceeds to S522.

In S522, PF forward rotation, PF motor CW, Speed: PS7, and 250 steps are executed. Specifically, the control unit 900 sends instructions to the first motor 901 to be driven in forward rotation at a speed of PS7, that is, at a low speed by 250 steps. Then, the process proceeds to S523. In S523, setting the flag to "0" (HOME) is executed. Specifically, the control unit 900 updates the state of the flag to "0", that is, to the first position (HOME). In other words, the control unit 900 recognizes that the first delivery stacker 500 is located at the first position. Then, the process proceeds to S524.

In S524, APG Switching, Speed: ES2, and PG=1 (−) are executed. Specifically, the second motor 902 is driven at a speed of ES2 to pivot the PG adjustment cam portion 301 of the recording unit gap adjustment unit 300 and thereby to switch the power transmission state of the power transmission switching unit 400 to a disconnected state, and PG is switched to "−", that is, to the PG mode in which a relatively thin sheet of paper is recorded. Then, the process proceeds to the common operation process A (see FIG. 34). Then, after the common operation process A, the process proceeds to S525.

In S525, PF forward rotation, PF motor CW, Speed: PS7, and 2500 steps are executed. Specifically, the control unit 900 sends instructions to the first motor 901 to be driven in forward rotation at a speed of PS7, that is, at a low speed by 2500 steps. Then, the process proceeds to S526. In S526, the carriage 10 is locked, as in the case of the above described S426. Then, the process proceeds to S527. In S527, the control unit 900 determines that it is abnormal and displays an error indication on the liquid crystal monitor screen 7 of the front face panel 6, as in the case of the above described S427.

In S431, PF stop, wait=50 msec, and PF counter reset are executed. Specifically, the control unit 900 stops the first motor 901 for 50 milliseconds, and resets the counter which has counted the number of steps of the first motor 901. Then, the process proceeds to S532. In S532, it is determined whether the position sensor 230 is in an ON (Hi) state where the position sensor 230 is sensing the first delivery stacker 500. That is, it is determined whether the first delivery stacker 500 is located at any one of the stable positions, that is, the first position and the second position or the first delivery stacker 500 is located at an intermediate position between the first position and the second position. Then, when the control unit 900 determines that the position sensor 230 is in an ON state, the process proceeds to S533. On the other hand, when it is determined that the position sensor 230 is not in an ON state, the process proceeds to S522.

In S533, PF forward rotation, PF motor CW, Speed: PS7, and 900 steps are executed. Specifically, the control unit 900 sends instructions to the first motor 901 to be driven in forward rotation at a speed of PS7, that is, at a low speed by 900 steps. Then, the first delivery stacker retry operation process ends. Here, 900 steps are the number of steps by which, when the first delivery stacker 500 stops at the second position, the first delivery stacker 500 abuts against a base portion side member to stop and then moves from the stopped position to the original proper second position, which is a desired position. Note that, in the present embodiment, the speed is set unchanged in S409 and in S509; however, it may be switched from a high speed to a low speed. In such a case, when the first delivery stacker 500 abuts at a stable position, that is, the first position or the second position, (in S410 or in S510), collision may be moderated, so that it is possible to improve the positional accuracy when the first delivery stacker 500 is located at the original first position or at the second position.

Common Operation Process A

As described above, the common operation process A executes releasing contact pressure in order to reliably perform locking operation that restricts the attitude of the planetary gear holder portion 420 of the power transmission switching unit 400. Hereinafter, a description will be made specifically. As shown in FIG. 34, in S601, PF reverse rotation, PF motor CCW, Speed: PS12, and 1000 steps are executed. Specifically, the control unit 900 sends instructions to the first motor 901 to be driven in reverse rotation at a speed of PS12, that is, at a high speed, by 1000 steps. Then, the process proceeds to S602.

In S602, it is determined whether PF is overloaded or not. Specifically, the control unit 900 determines whether a load on the first motor 901 exceeds a predetermined value. When it is determined that a load on the first motor 901 exceeds a predetermined value, the process proceeds to S603. On the other hand, when it is determined that a load on the first motor 901 does not exceed a predetermined value, the process proceeds to S606. In S603, PF stop, wait=50 msec, and PF counter reset are executed. Specifically, the control unit 900 stops the first motor 901 for 50 milliseconds, and resets the counter which has counted the number of steps of the first motor 901. Then, the process proceeds to S604.

In S604, PF reverse rotation, PF motor CCW, Speed: PS12, and 1000 steps are executed. Specifically, the control unit 900 sends instructions to the first motor 901 to be driven in reverse rotation at a speed of PS12, that is, at a high speed, by 1000 steps. Then, the process proceeds to S605. In S605, it is determined whether PF is overloaded or not. Specifically, the control unit 900 determines whether a load on the first motor 901 exceeds a predetermined value. When it is determined that a load on the first motor 901 exceeds a predetermined value, the process proceeds to S606. On the other hand, when it is determined that a load on the first motor 901 does not exceed a predetermined value as well, the process also proceeds to S606.

In S606, PF stop, wait=50 msec, and PF counter reset are executed. Specifically, the control unit 900 stops the first motor 901 for 50 milliseconds, and resets the counter which has counted the number of steps of the first motor 901. Then, the process proceeds to S607. In S607, PF forward rotation, PF motor CW, Speed: PS12, and 1000 steps are executed. Specifically, the control unit 900 sends instructions to the first motor 901 to be driven in forward rotation at a speed of PS12, that is, at a high speed, by 1000 steps. Then, the process proceeds to S608.

In S608, it is determined whether PF is overloaded or not. Specifically, the control unit 900 determines whether a load on the first motor 901 exceeds a predetermined value. When it is determined that a load on the first motor 901 exceeds a predetermined value, the process proceeds to S609. On the other hand, when it is determined that a load on the first motor 901 does not exceed a predetermined value, the process proceeds to S612. In S609, PF stop, wait=50 msec, and PF counter reset are executed. Specifically, the control unit 900 stops the first motor 901 for 50 milliseconds, and resets the counter which has counted the number of steps of the first motor 901. Then, the process proceeds to S610.

In S610, PF forward rotation, PF motor CW, Speed: PS12, and 1000 steps are executed. Specifically, the control unit 900 sends instructions to the first motor 901 to be driven in forward rotation at a speed of PS12, that is, at a high speed, by 1000 steps. Then, the process proceeds to S611. In S611, it is determined whether PF is overloaded or not. Specifically, the control unit 900 determines whether a load on the first motor 901 exceeds a predetermined value. When it is determined that a load on the first motor 901 exceeds a predetermined value, the process proceeds to S612. On the other hand, when it is determined that a load on the first motor 901 does not exceed a predetermined value as well, the process also proceeds to S612.

In S612, PF stop, wait=50 msec, and PF counter reset are executed. Specifically, the control unit 900 stops the first motor 901 for 50 milliseconds, and resets the counter which has counted the number of steps of the first motor 901. Then, the common operation process A ends.

First Delivery Stacker UP Operation Process

Next, the first delivery stacker UP operation process will be described. As shown in FIG. 35, in S701, it is determined whether PG=4 (CDR) or not. Specifically, the control unit 900 determines whether the state of the recording unit gap adjustment unit 300 is PG=4, that is, the power transmission state of the power transmission switching unit 400 is in a connected state. When it is determined that PG=4, the process proceeds to S702. On the other hand, when it is determined that it is not PG=4, the process proceeds to S703.

In S702, APG Switching, Speed: ES2, and PG=1 (–) are executed. Specifically, the second motor 902 is driven at a speed of ES2 to pivot the PG adjustment cam portion 301 of the recording unit gap adjustment unit 300 and thereby to switch the power transmission state of the power transmission switching unit 400 to a disconnected state, and PG is switched to "–", that is, to the PG mode in which a relatively thin sheet of paper is recorded. Then, the process proceeds to S703.

In S703, PF forward rotation, PF motor CW, Speed: PS4, and 17008 steps are executed. Specifically, the control unit 900 sends instructions to the first motor 901 to be driven in forward rotation at a speed of PS4, that is, at an extremely low speed by 17008 steps. Then, the process proceeds to S704. Here, the first motor 901 is driven by 17008 steps because the delivery drive roller 20*a* is rotated to perform delivery operation a distance of 150 mm.

In S504, PF reverse rotation, PF motor CCW, Speed: PS4, and 8640 steps are executed. Specifically, the control unit 900 sends instructions to the first motor 901 to be driven in reverse rotation at a speed of PS4, that is, at an extremely low speed by 8640 steps. This operation is executed to determine a threshold value of load detection, that is, so-called measurement. In consideration of variation among members, a fixed threshold value should be set higher. When the threshold value is increased, there is a possibility that a user may get injured if his or her hand is erroneously caught therein. For the above reason, the threshold value is desirably set as low as possible and the first motor 901 is stopped with a low load. Then, the above, measurement is performed. The average value of loads during the above operation is stored in the memory of the control unit 900. Then, the process proceeds to S705.

In S705, APG Switching, Speed: ES2, and PG=4 (CDR) are executed. Specifically, the second motor 902 is driven at a speed of ES2 to pivot the PG adjustment cam portion 301 of the recording unit gap adjustment unit 300, and the power transmission state of the power transmission switching unit 400 is switched to a connected state. PG at this moment is the PG in the CD-R recording mode. Then, the process proceeds to S706.

In S706, it is set that N=0. That is, the counter that contains the number of steps of the first motor 901, which is a stepper motor, is reset. Then, the process proceeds to S707. In S707, PF reverse rotation, PF motor CCW, Speed: PS11, and 64400 steps are executed. Specifically, the control unit 900 sends instructions to the first motor 901 to be driven in reverse rotation at a speed of PS11, that is, at a high speed, by 64400 steps. Then, the process proceeds to S708.

In S708, N=N+1 is executed. That is, the number of steps is counted by means of the counter provided in the control unit 900. Then, the process proceeds to S709. In S709, it is determined whether PF is overloaded or not. Specifically, the control unit 900 determines whether a load on the first motor 901 exceeds a predetermined value. When it is determined that a load on the first motor 901 exceeds a predetermined value, the process proceeds to S721. On the other hand, when it is determined that a load on the first motor 901 does not exceed a predetermined value, the process proceeds to S710. Here, when it is determined that the load exceeds a predetermined value, it is conceivable, for example, that, because the first delivery stacker 500 abuts against a base portion side member at a stable position, which may be the first position or the second position, a load on the first motor 901 exceeds a predetermined value. In addition, it is conceivable that, at an intermediate position between the first position and the second position, the first delivery stacker 500 abuts against an obstacle.

In S710, it is determined whether the position sensor 230 has sensed the first delivery stacker 500 and then switched from an OFF (Lo) state to an ON (Hi) state. Then, when the control unit 900 determines that the position sensor 230 is not switched to an ON state, the process proceeds to S731. On the other hand, when it is determined that the position sensor 230 is switched to an ON state, the process proceeds to S711. In S711, PF counter reset is executed. Specifically, the control unit 900 resets the counter which has counted the number of steps of the first motor 901. Then, the process proceeds to S712.

In S712, PF reverse rotation, PF motor CCW, Speed: unchanged, and 5900 steps are executed. Specifically, the control unit 900 sends instructions to the first motor 901 to be driven in reverse rotation by 5900 steps while maintaining the speed. Then, the process proceeds to S713. In S713, it is determined whether PF is overloaded or not. Specifically, the control unit 900 determines whether a load on the first motor 901 exceeds a predetermined value. When it is determined that a load on the first motor 901 exceeds a predetermined value, the process proceeds to S714. On the other hand, when it is determined that a load on the first motor 901 does not exceed a predetermined value, the process proceeds to S715.

In S714, PF stop, wait=50 msec, and PF counter reset are executed. Specifically, the control unit 900 stops the first motor 901 for 50 milliseconds, and resets the counter which has counted the number of steps of the first motor 901. Then, the process proceeds to S716. In S715, PF stop, wait=50 msec, and PF counter reset are executed. Specifically, the control unit 900 stops the first motor 901 for 50 milliseconds, and resets the counter which has counted the number of steps of the first motor 901. Then, the process proceeds to S716.

In S716, PF forward rotation, PF motor CW, Speed: PS7, and 900 steps are executed. Specifically, the control unit 900 sends instructions to the first motor 901 to be driven in forward rotation at a speed of PS7, that is, at a low speed by 900 steps. Then, the process proceeds to S717. Here, the first motor 901 is driven by 900 steps in order to release the contact pressure on the first planetary gear 423 and the contact pressure on the second planetary gear 424.

In S717, setting the flag to "1" is executed. Specifically, the control unit 900 updates the state of the flag to "1", that is, to the second position. In other words, the control unit 900 recognizes that the first delivery stacker 500 is located at the second position. Then, the process proceeds to S718. In S718, APG Switching, Speed: ES2, and PG=1 (–) are executed. Specifically, the second motor 902 is driven at a speed of ES2 to pivot the PG adjustment cam portion 301 of the recording unit gap adjustment unit 300 and thereby to switch the power transmission state of the power transmission switching unit 400 to a disconnected state, and PG is switched to "–", that is, to the PG mode in which a relatively thin sheet of paper is recorded. Then, the process proceeds to the common operation process A (see FIG. 34). The common operation process A executes releasing contact pressure in order to reliably perform locking operation that restricts the attitude of the planetary gear holder portion 420 of the power transmission switching unit 400. The specific common operation process A is described above. Then, after the common operation process A, the process proceeds to S719.

In S719, PF forward rotation, PF motor CW, Speed: PS7, and 2500 steps are executed. Specifically, the control unit 900 sends instructions to the first motor 901 to be driven in forward rotation at a speed of PS7, that is, at a low speed by 2500 steps. Then, the process proceeds to S720. In S720, the carriage 10 is locked. When the first delivery stacker 500 is being moved, the carriage lock lever (not shown) that locks the carriage 10 by the operation of forward rotation/reverse rotation of the first motor 901 is configured to move in and out. Thus, when the movement of the first delivery stacker 500 is completed, the position of the carriage lock lever becomes indeterminate. Then, in S719, the first motor 901 is driven by the number of steps (2500 steps) that can release the locking of the carriage 10 to release the locking of the carriage 10. After that, in the same S720, the carriage 10 is locked, thus making it possible to regulate the position of the carriage lock lever. This is because, during so-called idling, locking the carriage 10 is a basic operation. Then, the first delivery stacker UP operation process ends.

In S721, PF stop, wait=50 msec, and PF counter reset are executed. Specifically, the control unit 900 stops the first motor 901 for 50 milliseconds, and resets the counter which has counted the number of steps of the first motor 901. Then, the process proceeds to S722. In S722, PF forward rotation, PF motor CW, Speed: PS7, and 900 steps are executed. Specifically, the control unit 900 sends instructions to the first motor 901 to be driven in forward rotation at a speed of PS7, that is, at a low speed by 900 steps. Then, the process proceeds to S723. Here, the first motor 901 is driven by 900 steps in order to release the contact pressure on the first planetary gear 423 and the contact pressure on the second planetary gear 424.

In S723, the first delivery stacker error counter is incremented by one count. Specifically, the control unit 900 adds one count to the first delivery stacker error counter. Then, the process proceeds to S724. In S724, the first delivery stacker retry operation as described above (see FIG. 32 and FIG. 33) is performed. Then, the process proceeds to S725.

In S725, APG Switching, Speed: ES2, and PG=1 (–) are executed. Specifically, the second motor 902 is driven at a speed of ES2 to pivot the PG adjustment cam portion 301 of the recording unit gap adjustment unit 300 and thereby to switch the power transmission state of the power transmission switching unit 400 to a disconnected state, and PG is switched to "–", that is, to the PG mode in which a relatively thin sheet of paper is recorded. Then, the process proceeds to the above described common operation process A (see FIG. 34). Then, after the common operation process A, the process proceeds to S726.

In S726, PF forward rotation, PF motor CW, Speed: PS7, and 2500 steps are executed. Specifically, the control unit 900 sends instructions to the first motor 901 to be driven in forward rotation at a speed of PS7, that is, at a low speed by 2500 steps. Then, the process proceeds to S727. In S727, the carriage 10 is locked (as in the case of S720). Then, the process proceeds to S728.

In S728, it is determined whether the first delivery stacker error counter is equal to or above three. When it is determined that the first delivery stacker error counter is equal to or above three, the process proceeds to S729. On the other hand, when it is determined that the first delivery stacker error counter is below three, the process proceeds to S730. In S729, the control unit 900 determines that it is abnormal and displays an error indication on the liquid crystal monitor screen 7 of the front face panel 6. At this time, because no execution is normally completed despite repeating several times, there is an obstacle on or in front of the first delivery stacker. Therefore, it is conceivable that the first delivery stacker 500 is not able to move. Thus, the above indication is displayed accordingly.

In S730, the control unit 900 determines that it is abnormal and displays an error indication on the liquid crystal monitor screen 7 of the front face panel 6. In S731, it is determined whether N>64400 steps. That is, the control unit 900 determines whether the number of steps counted exceeds a predetermined number of steps (64400 steps). When it is determined that the number of steps counted exceeds 64400 steps, the process proceeds to S732. On the other hand, it is determined that the number of steps counted does not exceed 64400 steps, the process proceeds to S708. Here, 64400 steps are the number of steps required for moving the first delivery stacker 500 from the first position to the second position.

In S732, PF stop, wait=50 msec, and PF counter reset are executed. Specifically, the control unit 900 stops the first motor 901 for 50 milliseconds, and resets the counter which has counted the number of steps of the first motor 901. Then, the process proceeds to S733. In S733, PF forward rotation, PF motor CW, Speed: PS7, and 900 steps are executed. Specifically, the control unit 900 sends instructions to the first motor 901 to be driven in forward rotation at a speed of PS7, that is, at a low speed by 900 steps. Then, the process proceeds to S734. Here, the first motor 901 is driven by 900 steps in order to release the contact pressure on the first planetary gear 423 and the contact pressure on the second planetary gear 424.

In S734, it is determined whether the position sensor 230 is in an ON (Hi) state where the position sensor 230 is sensing the first delivery stacker 500, or the position sensor 230 is in an OFF (Lo) state. That is, it is determined whether the first delivery stacker 500 is located at any one of the stable positions, that is, the first position and the second position or the first delivery stacker 500 is located at an intermediate position between the first position and the second position. Then, when the control unit 900 determines that the position sensor 230 is in an ON (Hi) state, the process proceeds to S433. On the other hand, when it is determined that the position sensor 230 is in an OFF (Lo) state, the process proceeds to S735.

In S735, the first delivery stacker retry operation as described above (see FIG. 32 and FIG. 33) is performed. Then, the process proceeds to S736. In S736, APG Switching, Speed: ES2, and PG=1 (–) are executed. Specifically, the second motor 902 is driven at a speed of ES2 to pivot the PG adjustment cam portion 301 of the recording unit gap adjustment unit 300 and thereby to switch the power transmission state of the power transmission switching unit 400 to a disconnected state, and PG is switched to "–", that is, to the PG mode in which a relatively thin sheet of paper is recorded. Then, the process proceeds to the above described common operation process A (see FIG. 34). Then, after the common operation process A, the process proceeds to S737.

In S737, PF forward rotation, PF motor CW, Speed: PS7, and 2500 steps are executed. Specifically, the control unit 900 sends instructions to the first motor 901 to be driven in forward rotation at a speed of PS7, that is, at a low speed by 2500 steps. Then, the process proceeds to S738. In S738, the carriage 10 is locked (as in the case of S720). Then, the process proceeds to S739.

In S739, the control unit 900 determines that it is abnormal and displays an error indication on the liquid crystal monitor screen 7 of the front face panel 6. Note that, in the present embodiment, the speed is set unchanged in S712; however, it may be switched from a high speed to a low speed. In such a case, when the first delivery stacker 500 abuts at a stable position, that is, the second position, (in S713), collision may be moderated, so that it is possible to improve the positional accuracy when the first delivery stacker 500 is located at the original second position.

First Delivery Stacker DOWN Operation Process

Next, the first delivery stacker DOWN operation process will be described. As shown in FIG. 36, in S801, PF forward rotation, PF motor CW, Speed: PS4, and 16000 steps are executed. Specifically, the control unit 900 sends instructions to the first motor 901 to be driven in forward rotation at a speed of PS4, that is, at extremely low speed by 16000 steps. Then, the process proceeds to S802. Here, the first motor 901 is driven by 16000 steps because the number of steps is set to 16000 steps (141 mm) which is substantially equal to the sum of the distance from start of recording to delivery 10386 steps (91.6 mm), slip 20% and margin 30%.

In S802, APG Switching, Speed: ES2, and PG=4 (CDR) are executed. Specifically, the second motor 902 is driven at a speed of ES2 to pivot the PG adjustment cam portion 301 of the recording unit gap adjustment unit 300, and the power transmission state of the power transmission switching unit 400 is switched to a connected state. PG at this moment is the PG in the CD-R recording mode. Then, the process proceeds to S803.

In S803, it is set that N=0. That is, the counter that contains the number of steps of the first motor 901, which is a stepper motor, is reset. Then, the process proceeds to S804. In S804, PF forward rotation, PF motor CW, Speed: PS11, and 64400 steps are executed. Specifically, the control unit 900 sends instructions to the first motor 901 to be driven in forward rotation at a speed of PS11, that is, at a high speed, by 64400 steps. Then, the process proceeds to S805.

In S805, N=N+1 is executed. That is, the number of steps is counted by means of the counter provided in the control unit 900. Then, the process proceeds to S806. In S806, it is determined whether PF is overloaded or not. Specifically, the control unit 900 determines whether a load on the first motor 901 exceeds a predetermined value. When it is determined that a load on the first motor 901 exceeds a predetermined value, the process proceeds to S821. On the other hand, when it is determined that a load on the first motor 901 does not exceed a predetermined value, the process proceeds to S807. Here, when it is determined that the load exceeds a predetermined value, it is conceivable, for example, that, because the first delivery stacker 500 abuts against a base portion side member at a stable position, which may be the first position or the second position, a load on the first motor 901 exceeds a predetermined value. In addition, it is conceivable that, at an intermediate position between the first position and the second position, the first delivery stacker 500 abuts against an obstacle.

In S807, it is determined whether the position sensor 230 has sensed the first delivery stacker 500 and then switched from an OFF (Lo) state to an ON (Hi) state. Then, when the control unit 900 determines that the position sensor 230 is not switched to an ON state, the process proceeds to S831. On the other hand, when it is determined that the position sensor 230 is switched to an ON state, the process proceeds to S808. In S808, PF counter reset is executed. Specifically, the control unit 900 resets the counter which has counted the number of steps of the first motor 901. Then, the process proceeds to S809.

In S809, PF forward rotation, PF motor CW, Speed: unchanged, and 5900 steps are executed. Specifically, the control unit 900 sends instructions to the first motor 901 to be driven in forward rotation by 5900 steps while maintaining the speed. Then, the process proceeds to S810. In S810, it is determined whether PF is overloaded or not. Specifically, the control unit 900 determines whether a load on the first motor 901 exceeds a predetermined value. When it is determined that a load on the first motor 901 exceeds a predetermined value, the process proceeds to S811. On the other hand, when it is determined that a load on the first motor 901 does not exceed a predetermined value, the process proceeds to S812.

In S811, PF stop, wait=50 msec, and PF counter reset are executed. Specifically, the control unit 900 stops the first motor 901 for 50 milliseconds, and resets the counter which has counted the number of steps of the first motor 901. Then, the process proceeds to S813. In S812, PF stop, wait=50 msec, and PF counter reset are executed. Specifically, the control unit 900 stops the first motor 901 for 50 milliseconds, and resets the counter which has counted the number of steps of the first motor 901. Then, the process proceeds to S813.

In S813, PF reverse rotation, PF motor CCW, Speed: PS7, and 250 steps are executed. Specifically, the control unit 900 sends instructions to the first motor 901 to be driven in reverse rotation at a speed of PS7, that is, at a low speed by 250 steps. Then, the process proceeds to S814. Here, the first motor 901 is driven by 250 steps in order to release the contact pressure on the first planetary gear 423 and the contact pressure on the second planetary gear 424.

In S814, setting the flag to "0" is executed. Specifically, the control unit 900 updates the state of the flag to "0", that is, to the first position. In other words, the control unit 900 recognizes that the first delivery stacker 500 is located at the first position. Then, the process proceeds to S815. In S815, APG Switching, Speed: ES2, and PG=1 (−) are executed. Specifically, the second motor 902 is driven at a speed of ES2 to pivot the PG adjustment cam portion 301 of the recording unit gap adjustment unit 300 and thereby to switch the power transmission state of the power transmission switching unit 400 to a disconnected state, and PG is switched to "−", that is, to the PG mode in which a relatively thin sheet of paper is recorded. Then, the process proceeds to the common operation process A (see FIG. 34). Then, after the common operation process A, the process proceeds to S816.

In S816, PF forward rotation, PF motor CW, Speed: PS7, and 2500 steps are executed. Specifically, the control unit 900 sends instructions to the first motor 901 to be driven in forward rotation at a speed of PS7, that is, at a low speed by 2500 steps. Then, the process proceeds to S817. In S817, the carriage 10 is locked (as in the case of S720). Then, the first delivery stacker DOWN operation process ends.

In S821, PF stop, wait=50 msec, and PF counter reset are executed. Specifically, the control unit 900 stops the first motor 901 for 50 milliseconds, and resets the counter which has counted the number of steps of the first motor 901. Then, the process proceeds to S822. In S822, PF reverse rotation, PF motor CCW, Speed: PS7, and 250 steps are executed. Specifically, the control unit 900 sends instructions to the first motor 901 to be driven in reverse rotation at a speed of PS7, that is, at a low speed by 250 steps. Then, the process proceeds to S823. Here, the first motor 901 is driven by 250 steps in order to release the contact pressure on the first planetary gear 423 and the contact pressure on the second planetary gear 424.

In S823, the first delivery stacker error counter is incremented by one count. Specifically, the control unit 900 adds one count to the first delivery stacker error counter. Then, the process proceeds to S824. In S824, the first delivery stacker retry operation as described above (see FIG. 32 and FIG. 33) is performed. That is, the first delivery stacker 500 is returned to the second position. Then, the process proceeds to S825. Note that this S824 includes a so-called home return operation process, as in the case of the above described S724.

In S825, APG Switching, Speed: ES2, and PG=1 (−) are executed. Specifically, the second motor 902 is driven at a speed of ES2 to pivot the PG adjustment cam portion 301 of the recording unit gap adjustment unit 300 and thereby to switch the power transmission state of the power transmission switching unit 400 to a disconnected state, and PG is switched to "−", that is, to the PG mode in which a relatively thin sheet of paper is recorded. Then, the process proceeds to the above described common operation process A (see FIG. 34). Then, after the common operation process A, the process proceeds to S826.

In S826, PF forward rotation, PF motor CW, Speed: PS7, and 2500 steps are executed. Specifically, the control unit 900 sends instructions to the first motor 901 to be driven in forward rotation at a speed of PS7, that is, at a low speed by 2500 steps. Then, the process proceeds to S827. In S827, the carriage 10 is locked (as in the case of S720). Then, the process proceeds to S828.

In S828, it is determined whether the first delivery stacker error counter is equal to or above 3. When it is determined that the first delivery stacker error counter is equal to or above 3, the process proceeds to S829. On the other hand, when it is determined that the first delivery stacker error counter is below 3, the process proceeds to S830. In S829, the control unit 900 determines that it is abnormal and displays an error indication on the liquid crystal monitor screen 7 of the front face panel 6. At this time, because no execution is normally completed despite repeating several times, there is an obstacle on or in front of the first delivery stacker. Therefore, it is conceivable that the first delivery stacker 500 is not able to move. Thus, the above context is displayed accordingly.

In S830, the control unit 900 determines that it is abnormal and displays an error indication on the liquid crystal monitor screen 7 of the front face panel 6. In S831, it is determined whether N>64400 steps. That is, the control unit 900 determines whether the number of steps counted exceeds a predetermined number of steps (64400 steps). When it is determined that the number of steps counted exceeds 64400 steps, the process proceeds to S832. On the other hand, it is determined that the number of steps counted does not exceed 64400 steps, the process proceeds to S805. Here, 64400 steps are the number of steps required for moving the first delivery stacker 500 from the first position to the second position.

In S832, PF stop, wait=50 msec, and PF counter reset are executed. Specifically, the control unit 900 stops the first motor 901 for 50 milliseconds, and resets the counter which has counted the number of steps of the first motor 901. Then, the process proceeds to S833. In S833, PF reverse rotation, PF motor CCW, Speed: PS7, and 250 steps are executed. Specifically, the control unit 900 sends instructions to the first motor 901 to be driven in reverse rotation at a speed of PS7, that is, at a low speed by 250 steps. Then, the process proceeds to S834. Here, the first motor 901 is driven by 250 steps in order to release the contact pressure on the first planetary gear 423 and the contact pressure on the second planetary gear 424.

In S834, it is determined whether the position sensor 230 is in an ON (Hi) state where the position sensor 230 is sensing the first delivery stacker 500, or the position sensor 230 is in an OFF (Lo) state. That is, it is determined whether the first delivery stacker 500 is located at any one of the stable positions, that is, the first position and the second position or the first delivery stacker 500 is located at an intermediate position between the first position and the second position. Then, when the control unit 900 determines that the position sensor 230 is in an ON (Hi) state, the process proceeds to S815. On the other hand, when it is determined that the position sensor 230 is in an OFF (Lo) state, the process proceeds to S835.

In S835, the first delivery stacker retry operation as described above (see FIG. 32 and FIG. 33) is performed. Then, the process proceeds to S836. In S836, APG Switching, Speed: ES2, and PG=1 (−) are executed. Specifically, the second motor 902 is driven at a speed of ES2 to pivot the PG adjustment cam portion 301 of the recording unit gap adjustment unit 300 and thereby to switch the power transmission state of the power transmission switching unit 400 to a disconnected state, and PG is switched to "–", that is, to the PG mode in which a relatively thin sheet of paper is recorded. Then, the process proceeds to the above described common operation process A (see FIG. 34). Then, after the common operation process A, the process proceeds to S837.

In S837, PF forward rotation, PF motor CW, Speed: PS7, and 2500 steps are executed. Specifically, the control unit 900 sends instructions to the first motor 901 to be driven in forward rotation at a speed of PS7, that is, at a low speed by 2500 steps. Then, the process proceeds to S838. In S838, the carriage 10 is locked (as in the case of S720). Then, the process proceeds to S839.

In S839, the control unit 900 determines that it is abnormal and displays an error indication on the liquid crystal monitor screen 7 of the front face panel 6. Note that, in the present embodiment, the speed is set unchanged in S809; however, it may be switched from a high speed to a low speed. In such a case, when the first delivery stacker 500 abuts at a stable position, that is, the second position, (in S810), collision may be moderated, so that it is possible to improve the positional accuracy when the first delivery stacker 500 is located at the original first position.

The delivery stacker elevating unit 200, which serves as a medium guide elevating device according to the present embodiment, includes the first delivery stacker 500, which serves as a medium guide unit, that is moved to the first position or to the second position by power supplied from the first motor 901, which serves as a motor, being driven in forward rotation or in reverse rotation, in the recording apparatus 100 in which ink is discharged from the recording head 13 provided in the recording unit 110 to perform recording onto the sheet of paper P, or a first medium, or onto the CD-R tray Q that holds the CD-R, or a second medium. The delivery stacker elevating unit 200 includes the position detecting device 940 that detects the position of the first delivery stacker 500. The position detecting device 940 includes the position sensor 230, the control unit 900, the first sensor contact portion 543, and the second sensor contact portion 544. The position sensor 230, which serves as a sensor, is switchable between an ON state and an OFF state. The control unit 900 is able to detect an ON/OFF state of the position sensor 230 and to control driving of the first motor 901. The first sensor contact portion 543, which serves as a first engaging portion, at the first position, engages the position sensor 230 and switches the position sensor 230 to an ON state. The second sensor contact portion 544, which serves as a second engaging portion, at the second position, engages the position sensor 230 and switches the position sensor 230 to an ON state. The control unit 900 detects whether the position sensor 230 has switched from the OFF state to the ON state (S710, S807), and determines the position of the first delivery stacker 500 (S717, S814) by determining a rotational direction of the first motor 901 (S707, S712, S804, S809) when the ON/OFF state of the position sensor 230 is detected.

In addition, in the delivery stacker elevating unit 200 according to the present embodiment, the first delivery stacker 500 is configured to abut against part of the base portion side of the delivery stacker elevating unit 200 at the first position and at the second position. The control unit 900 of the position detecting device 940 is configured to, in addition to the above detection and determination of the rotational direction of the first motor 901, determine the position of the first delivery stacker 500 by detecting the abutment of the first delivery stacker 500 on the basis of variation in load on the first motor 901 (S713, S810).

Furthermore, in the delivery stacker elevating unit 200 according to the present embodiment, when the first delivery stacker 500 is moved between the first position and the second position, the first motor 901, when the position sensor 230 is in an OFF state, is driven at a high speed, and the first motor 901, when the position sensor 230 is in an ON state, is driven at a speed that is lower than the speed when the position sensor 230 in an OFF state.

In addition, in the delivery stacker elevating unit 200 according to the embodiment, the delivery stacker elevating unit 200 further includes an actual position correction device 950, and, when there is a difference between a position of the first delivery stacker 500, which is recognized by the control unit 900 of the position detecting device 940, and an actual position of the first delivery stacker 500, the difference is corrected by the actual position correction device 950. Moreover, in the delivery stacker elevating unit 200 according to the embodiment, when the control unit 900 has recognized the position of the first delivery stacker 500 at the first position or at the second position, when the position sensor 230 is in an OFF state, the actual position correction device 950 moves the first delivery stacker 500 to the position that is recognized by the control unit 900 (S302, S401 to S527).

In addition, in the delivery stacker elevating unit 200 according to the embodiment, when the control unit 900 has recognized the position of the first delivery stacker 500 at the first position or at the second position, and the position sensor 230 is in an ON state, and when instructions to move the first delivery stacker 500 is issued, the actual position correction device 950 is configured to drive the first motor 901 by the instructions to move the first delivery stacker 500 (S102), to detect variation in load on the first motor 901 by the abutment of the first delivery stacker 500 while the position sensor 230 is in the ON state (S709, S806), and to move the first delivery stacker 500 to the position that is recognized by the control unit 900 by driving the first motor 901 in a reverse direction (S722, S822).

The recording apparatus 100 according to the embodiment includes the recording unit 110 and the delivery unit 120. The recording unit 110 performs recording on the sheet of paper P or CD-R tray Q, which serves as a recording medium, using the recording head 13. The delivery unit 120 delivers the sheet of paper P or CD-R tray Q from the recording unit 110 to the downstream side in the transport direction. The delivery unit 120 includes the above delivery stacker elevating unit 200.

The present embodiment provides a method of detecting the position of a first delivery stacker, which serves as a medium guide unit. In the recording apparatus 100 in which ink is discharged from the recording head 13 provided in the recording unit 110 to perform recording on the sheet of paper P or on the CD-R tray Q, the delivery stacker elevating unit 200 includes the first delivery stacker 500, the position sensor 230, the control unit 900, the first sensor contact portion 543, and the second sensor contact portion 544. The first delivery stacker 500 is moved to the first position or to the second position by power supplied from the first motor 901 being driven in forward rotation or in reverse rotation. The position sensor 230 is switchable between an ON state and an OFF state. The control unit 900 is able to detect an ON/OFF state of the position sensor 230 and to control driving of the first motor 901. The first sensor contact portion 543, at the first position, engages the position sensor 230 and switches the position sensor 230 to the ON state. The second sensor contact portion 544, at the second position, engages the position sensor 230 and switches the position sensor 230 to the ON state. The method of detecting the position of the first delivery stacker 500 includes a first detecting process (S710, S807) in which the control unit 900 detects that the position sensor 230 is switched from the OFF state to the ON state, a rotational direction determination process (S707, S712, S804, S809) in which the control unit 900 determines the rotational direction of the first motor 901 when the ON/OFF state of the position sensor 230 is detected, and a position determination process (S717, S814) in which the control unit 900 determines the position of the first delivery stacker 500 on the basis of the result of the first detecting process and the rotational direction determination process.

In addition, in the present embodiment, the first delivery stacker 500 is configured to abut against part of the base portion side of the delivery stacker elevating unit 200 at the first position and at the second position. The method of detecting the position of the first delivery stacker 500 includes, after the first detecting process (S710, S807), a second detecting process (S713, S810) in which the control unit 900 detects abutment of the first delivery stacker 500 on the basis of variation in load on the first motor 901. The position determination process determines the position of the first delivery stacker 500 (S717, S814) on the basis of result of the first detecting process, the rotational direction determination process, and the second detecting process.

Moreover, the method of detecting the position of the first delivery stacker according to the present embodiment includes, when the control unit 900 has recognized the position of the first delivery stacker 500 at the first position or at the second position, a first correction movement process (S302, S401 to S527) in which, when the position sensor 230 is in an OFF state, moving the first delivery stacker 500 to the position that is recognized by the control unit 900.

In addition, the method of detecting the position of the first delivery stacker according to the present embodiment, when the control unit 900 has recognized the position of the first delivery stacker 500 at the first position or at the second position, and the position sensor 230 is in an ON state, includes a third detecting process (S709, S806) in which, when instructions to move the first delivery stacker 500 is issued, detecting variation in load on the first motor 901 by the abutment of the first delivery stacker 500 in such a manner that the control unit 900 drives the first motor 901 on the basis of the instructions to move the first delivery stacker 500 (S102) while the position sensor 230 is in the ON state (S709, S806), and a second correction movement process (S724, S824) in which, after the third detecting process, moving the first delivery stacker 500 to the position that is recognized by the control unit 900 in such a manner that the control unit 900 drives the first motor 901 in a reverse direction.

Note that, in the present embodiment, the position sensor is provided on the base portion side delivery stacker elevating unit, and the first sensor contact portion and the second sensor contact portion are provided on the first delivery stacker side; however, of course, the above configuration may be replaced with each other.

In addition, the invention is not limited to the embodiments described above, but it may be modified into various alternative embodiments within the scope of the invention as set forth in the appended claims. Needless to say, the invention also encompasses those alternative embodiments.

What is claimed is:

1. A medium guide elevating device comprising:

a rotor that is capable of being driven in forward rotation and in reverse rotation;

a medium guide unit is moved to a first position when the rotor is driven in forward rotation, and is moved to a second position when the rotor is driven in reverse rotation;

a sensor that has a selector switch that switches between an on state and an off state, wherein the sensor is switched to the off state when the medium guide unit is located between the first position and the second position;

a first engaging portion that engages the selector switch to switch the sensor to the on state when the medium guide unit is moved to the first position;

a second engaging portion that engages the selector switch to switch the sensor to the on state when the medium guide unit is moved to the second position; and a control unit that controls driving of the rotor, wherein the control unit detects when the sensor is switched between the off state and the on state and determines that the medium guide unit is moved to the first position or to the second position based on the sensor being switched from the off state to the on state and the direction of rotation of the rotor.

2. The medium guide elevating device according to claim 1, wherein the medium guide unit is configured so that a terminal position of the first position and a terminal position of the second position are regulated by abutment of the medium guide unit, and wherein the control unit detects that the medium guide unit is moved to any one of the terminal positions on the basis of variation in load on the rotor.

3. The medium guide elevating device according to claim 2, wherein the control unit controls the rotor to be driven at a lower speed during a period between when the sensor is switched ON to the time when the medium guide unit reaches any one of the terminal positions, than a speed at which the rotor is driven when the position sensor is switched OFF.

4. A recording apparatus comprising the medium guide elevating device according to claim 1.

5. A liquid ejecting apparatus comprising the medium guide elevating device according to claim 1.

* * * * *